US010483704B1

(12) United States Patent
Solland et al.

(10) Patent No.: US 10,483,704 B1
(45) Date of Patent: Nov. 19, 2019

(54) CABLE WITH MULTIPLE ELECTRICAL CONNECTORS

(71) Applicants: Kurt Solland, Goodyear, AZ (US); Debora Monzelowsky, Goodyear, AZ (US)

(72) Inventors: Kurt Solland, Goodyear, AZ (US); Debora Monzelowsky, Goodyear, AZ (US)

(73) Assignee: Kurt Solland, Goodyear, AZ (US)

( * ) Notice: Subject to any disclaimer, the term of this patent is extended or adjusted under 35 U.S.C. 154(b) by 0 days.

(21) Appl. No.: 16/145,833

(22) Filed: Sep. 28, 2018

Related U.S. Application Data

(63) Continuation-in-part of application No. 16/037,253, filed on Jul. 17, 2018, which is a continuation of application No. 15/460,731, filed on Mar. 16, 2017, now Pat. No. 10,027,080, which is a continuation-in-part of application No. 15/296,976, filed on Oct. 18, 2016, now abandoned.

(60) Provisional application No. 62/355,500, filed on Jun. 28, 2016.

(51) Int. Cl.

| | |
|---|---|
| ***H01R 25/00*** | (2006.01) |
| ***H01R 27/00*** | (2006.01) |
| ***H01R 31/06*** | (2006.01) |
| ***H01R 29/00*** | (2006.01) |
| *H01R 24/60* | (2011.01) |

(52) U.S. Cl.
CPC ..... *H01R 27/00* (2013.01); *H01R 29/00* (2013.01); *H01R 31/06* (2013.01); *H01R 24/60* (2013.01)

(58) Field of Classification Search
CPC ..... H01R 27/00; H01R 29/00; H01R 31/06; H01R 24/60
USPC ..... 439/502, 638
See application file for complete search history.

(56) References Cited

U.S. PATENT DOCUMENTS

| | | | | |
|---|---|---|---|---|
| 6,786,734 | B2 * | 9/2004 | Yu | H01R 35/02 439/11 |
| 7,473,141 | B2 * | 1/2009 | Liao | H01R 13/62 439/638 |
| 7,556,535 | B2 * | 7/2009 | Liao | H01R 13/6273 439/640 |
| 7,789,711 | B2 * | 9/2010 | Wu | H01R 24/58 439/165 |
| 8,298,003 | B2 * | 10/2012 | Wu | H01R 31/06 439/501 |
| 8,721,369 | B1 * | 5/2014 | Hsiao | H01R 27/00 439/638 |
| 8,926,372 | B2 * | 1/2015 | McSweyn | H01R 27/02 439/640 |
| 9,004,951 | B2 * | 4/2015 | Wu | H01R 27/00 439/638 |
| 9,219,340 | B2 * | 12/2015 | McSweyn | H01R 27/00 |
| 9,293,876 | B2 * | 3/2016 | Terlizzi | H01R 29/00 |

(Continued)

*Primary Examiner* — Abdullah A Riyami
*Assistant Examiner* — Nelson R. Burgos-Guntin
(74) *Attorney, Agent, or Firm* — Plumsea Law Group, LLC

(57) ABSTRACT

A cable with ends having a body portion enabling rotatable electrical connector plugs to be deployed from a stored position to a ready position. The configuration of the body portion enables the connector plug to be electrically active only in the deployed ready position. The rotation mechanism provides tactile locking sensation. The design of the present cable enables multiple permutations of connector plugs to be provided on either the alpha or beta end of the cable.

20 Claims, 44 Drawing Sheets

(56) References Cited

U.S. PATENT DOCUMENTS

| | | | | |
|---|---|---|---|---|
| 10,027,080 | B2 * | 7/2018 | Solland | H01R 29/00 |
| 2007/0197052 | A1 * | 8/2007 | Liao | H01R 31/06<br>439/11 |
| 2012/0238146 | A1 * | 9/2012 | Liao | H01R 27/02<br>439/660 |
| 2013/0171864 | A1 * | 7/2013 | Farris-Gilbert | H01R 13/58<br>439/445 |
| 2014/0106623 | A1 * | 4/2014 | Wu | H01R 27/00<br>439/638 |
| 2015/0140843 | A1 * | 5/2015 | Wu | H01R 27/02<br>439/142 |
| 2016/0294133 | A1 * | 10/2016 | Xie | H01R 27/02 |

* cited by examiner

1100

| FIRST CONNECTOR, ALPHA END | SECOND CONNECTOR, BETA END |
|---|---|
| USB-A | MICRO-USB and LIGHTNING |
| USB-A and USB-B | MICRO-USB and LIGHTNING |
| USB-C and MiniDP | HDMI |
| USB-C and LIGHTNING | AUX MALE and AUX FEMALE |
| HDMI and VGA | LIGHTNING |
| USB-A | USB-A FEMALE and USB-A MINI FEMALE |
| USB-A | USB-A |
| USB-A | RCA FEMALE and RCA MALE |

FIG. 18

CABLE WITH MULTIPLE ELECTRICAL CONNECTORS

CROSS-REFERENCE TO RELATED APPLICATIONS

This application is a continuation-in-part of pending U.S. patent application Ser. No. 16/037,253 filed Jul. 17, 2018; which is a continuation of U.S. Pat. No. 10,027,080 filed on Mar. 16, 2017 and granted on Jul. 17, 2018; which is a continuation-in-part of U.S. patent application Ser. No. 15/296,976 filed on Oct. 18, 2016; which is a non-provisional of U.S. Provisional Patent Application No. 62/355,500, filed Jun. 28, 2016, entitled "Cable with Multiple Electrical Connectors," the disclosures of which are entirely incorporated herein by reference.

BACKGROUND

The present disclosure relates to electronic cables, and more particularly, to electronic cables that include multiple electrical connectors on an end for charging or transferring data to and from different electronic devices.

Currently, many people own multiple personal electronic devices such as mobile telephones, mp3 music playback devices, digital cameras, tablets, or laptop computers, with different electrical connectors and sockets for connecting these electronic devices to other devices. The cable that pairs with each personal electronic device is also used for power and charging through a power adapter from a customary electrical socket, automotive power outlet, or spare battery pack. Each type of electronic device comes with its own charger or data sync cable, and there is no standard connector. A typical user may carry a mobile phone, a digital camera, and a laptop that all employ different electrical connectors and have different electrical connector sockets. There may be times when a user may want to connect his or her mobile device to a TV in order to share a video or image. There may also be occasions when the audio jack of the electronic device is not compatible with a user's headphones or loudspeaker. In order for these various devices to connect together, people are required to have on hand or carry with them multiple cables for charging, data transfer, or sound playback.

A variety of cables are available for use with multiple electronic devices. These cables include multiple plugs that may be arranged or selected for use with various electronic devices. Of the available cables, many include multiple adapter tips that are added or removed from the cable depending on the plug type that is desired. The removable tips are easily misplaced or lost so that a user would not be able to charge or transfer data from his or her electronic device when desired. These cables may also include hinged plugs that may be located outside the bounds of the cable. These hinged plugs may be caught by external objects and damaged. Further, inactive plugs of the cables available may be easily dirtied or fouled due to the position in which the inactive plugs are stored or placed.

While useful for connecting various electronic devices, these typical cables do not provide a simple, convenient way to connect various electronic devices to other electronic devices. There is a continuing need for a cable that is easy to use, compact, connects multiple devices, and is electrically safe for use. In addition, a user's existing headphones or loudspeakers should be readily available for use with an electronic device that may have different ports. In the evolving market of personal electronic devices, it would be useful for all existing auxiliary devices to be made compatible with newly introduced devices.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

FIG. 18 is a chart depicting various combinations of plugs;

DETAILED DESCRIPTION

Figure 1:
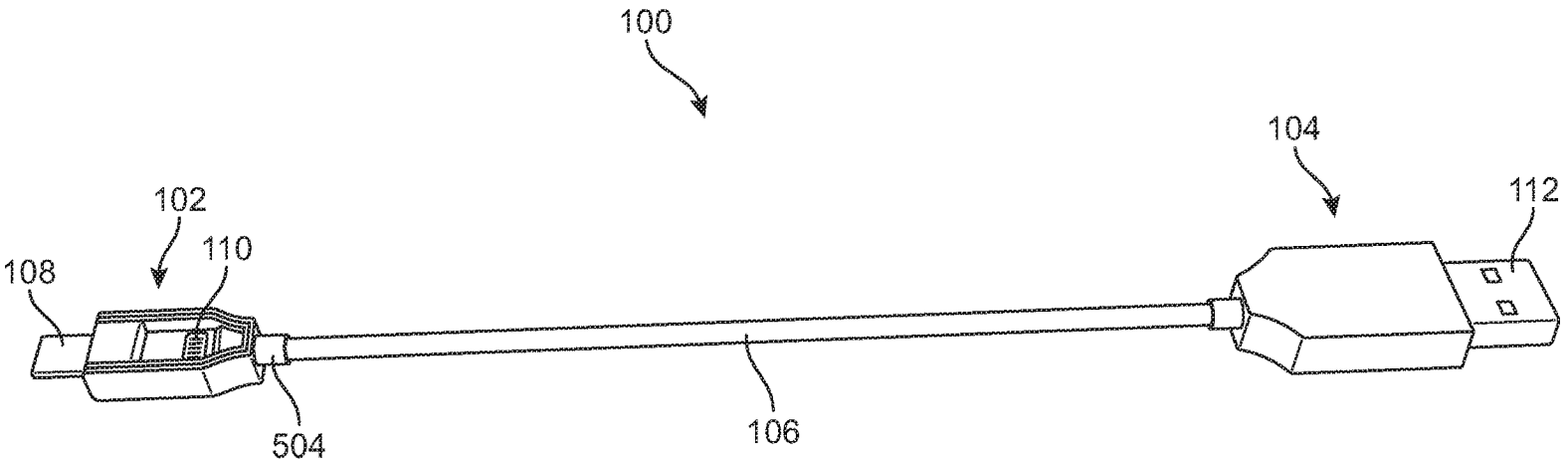
FIG. 1 is a schematic view of an embodiment of a cable.

Referring now to FIG. 1, a cable with electronic connectors is depicted. As shown, cable 100 includes first connector 102 and second connector 104 disposed on either end of cord 106. In some embodiments, first connector 102 and second connector 104 may include various plugs for use in conjunction with various devices. The plugs located within each connector may conform to various standards such as Universal Serial Bus (USB) or may incorporate plugs associated with particular companies such as Apple®, Incorporated. In other embodiments, various other plugs may be utilized within the various connectors. Additionally, cable 100 may be configured to provide unidirectional and bidirectional communication between first connector 102 and second connector 104.

In some embodiments, a cord may have various different flexing properties. In some embodiments, a cord may be pliable or flexible. In some embodiments, cord 106 may include a rubber-type material or flexible plastic to allow cord 106 to be flexible or pliable. The material of cord 106 may also provide insulation for electrical wires within cord 106. Additionally, in some embodiments, the cross section of cord 106 may be substantially circular. By having a circular cross section of cord 106, cord 106 may be bent along various axes with approximately the same magnitude of force. That is, in comparison to a rectangular cross section of a cord, a circular cross section of cord 106 does not resist bending in a particular direction; rather, cord 106 permits bending along all axes with approximately the same magnitude of force applied. A cord with a circular cross-sectional shape may also be easily wrapped and stowed. In other embodiments, cord 106 may have a different cross section to restrict bending along all or some axes.

Further, cord 106 may have varying lengths. In some embodiments, cord 106 may be multiple feet long. For example, cord 106 may be one foot, three feet, four feet, six feet, or ten feet long. In other embodiments, cord 106 may be longer than ten feet or shorter than one foot. In still further embodiments, cord 106 may be a distance between one foot and ten feet.

In some embodiments, first connector 102 may be configured to be attached to cord 106. Cord 106 may include electrical wiring that transfers an electrical signal between first connector 102 and second connector 104. As shown, first connector 102 connects to cord 106 at connection end 504 (see FIG. 6), In some embodiments, the connection between cord 106 and connection end 504 may be soldered, welded, or connection end 504 and cord 106 may be connected to each other by different techniques such as by a threaded cap or by friction or other techniques. In some embodiments, connection end 504 may be narrower than the rest of first connector 102, That is, connection end 504 may have a smaller cross section than the cross section of other portions of first connector 102.

In some embodiments, the connectors may include differing quantities of plugs. In other embodiments, each connector may include two or more plugs. As shown in FIG. 1, first connector 102 includes two plugs while second connector 104 includes a single plug. In other embodiments, second connector 104 may include a greater number of plugs. For ease of description, however, in the embodiment described herein, second connector 104 includes a single plug.

In some embodiments, each connector may include different types of plugs or plugs with different shapes. In other embodiments, the connectors may include the same type or configuration of plugs. As shown in FIG. 1, first connector 102 includes first plug 108 and second plug 110, As shown, first plug 108 may conform to a USB standard such as micro-USB B-type while second plug 110 may conform to another standard or may be associated with a particular company such as Apple®'s Lightning® connector. Second connector 104 includes third plug 112. As shown in FIG. 1, third plug 112 is a USB A-type plug. In other embodiments, various other plugs may be utilized for third plug 112. Further, in some embodiments, female connections may also be utilized. In addition, in some embodiments, a connector may include a plug that is male and a second plug that is in the female configuration. The plugs of the connectors may include various combinations of female plugs and male plugs.

Figure 2:
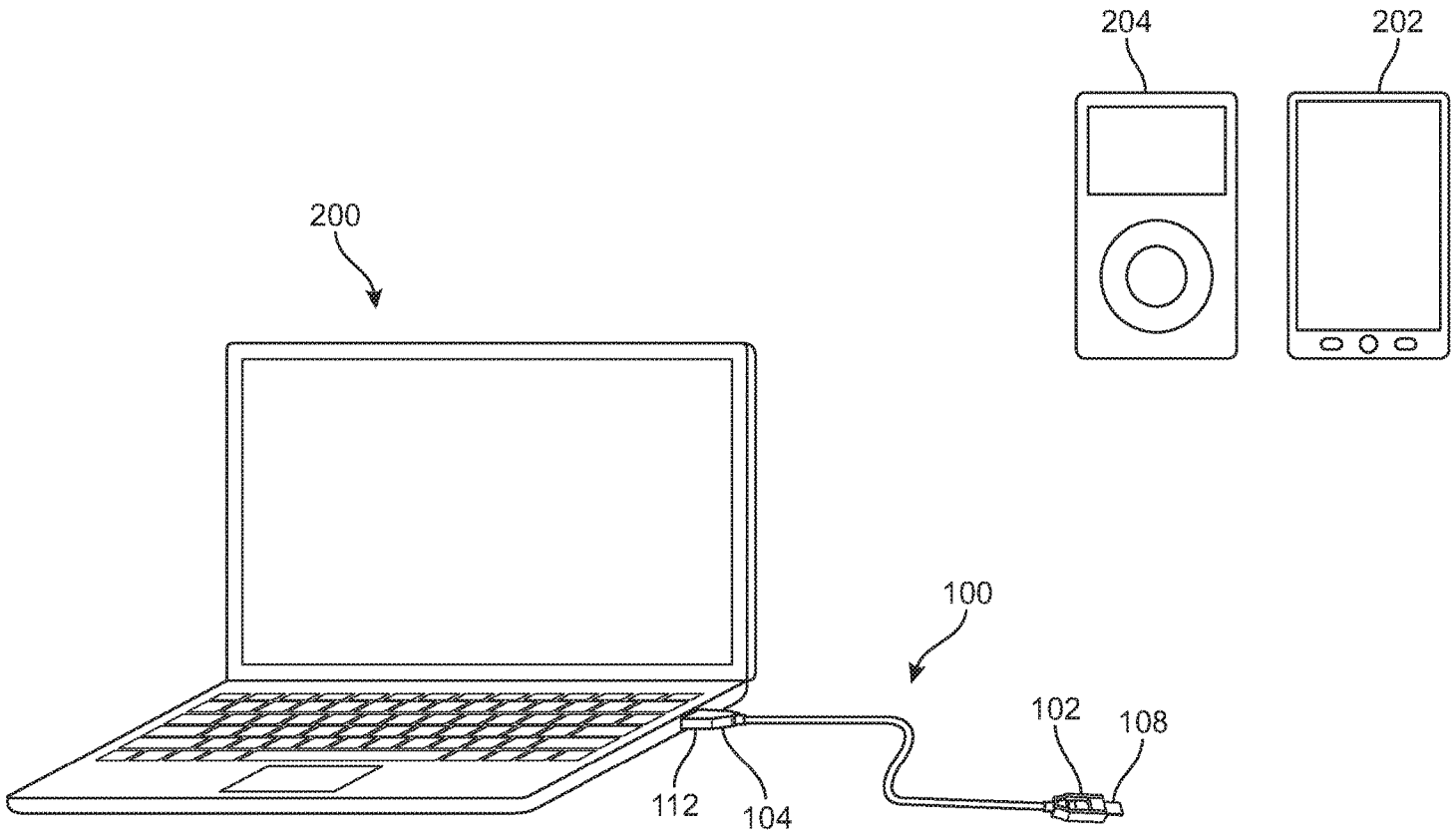
FIG. 2 is a schematic view of an embodiment of the cable connected to a computer.
Figure 3:
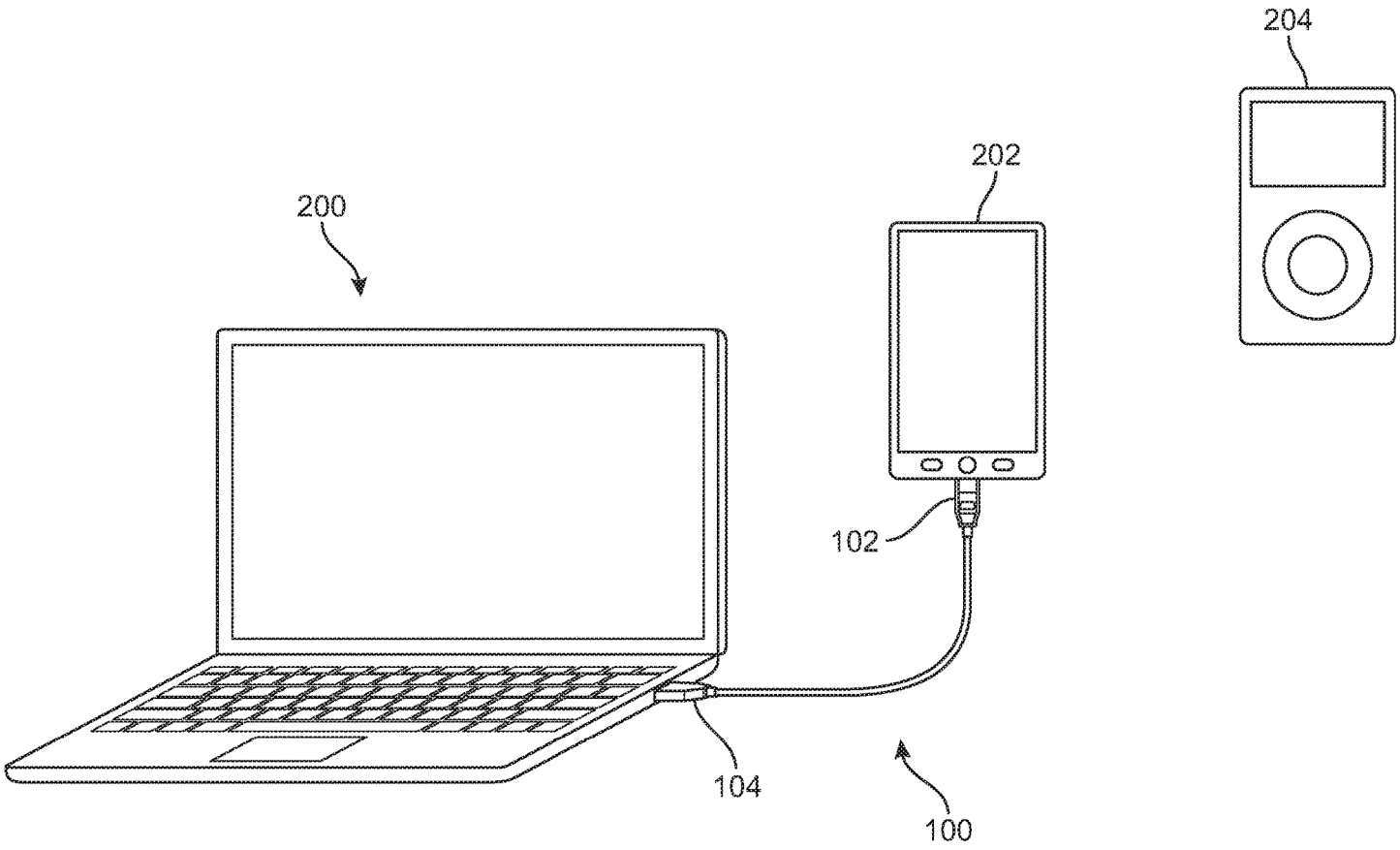
FIG. 3 is a schematic view of an embodiment of the cable attached to the computer and an electronic device.
Figure 4:
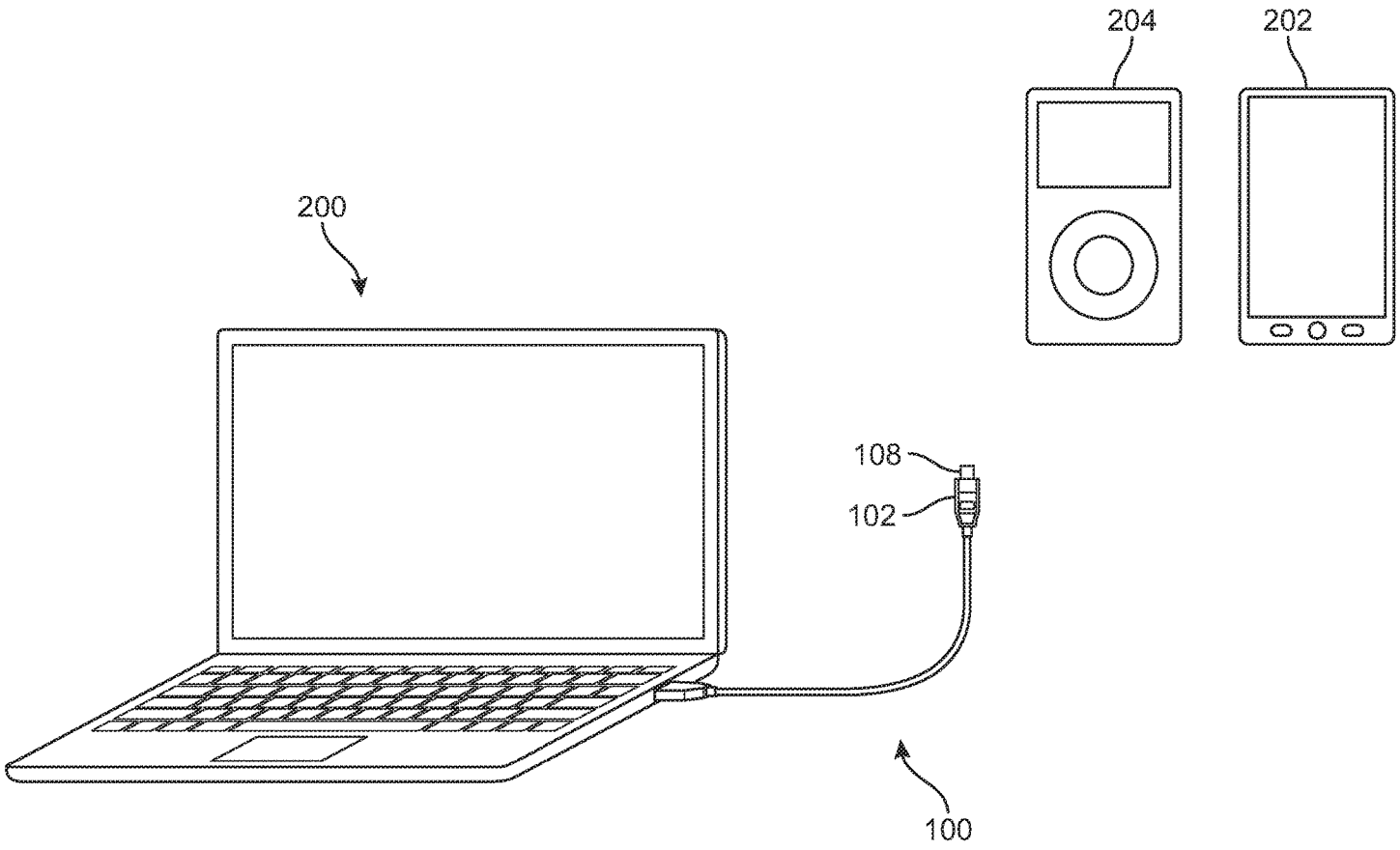
FIG. 4 is a schematic view of an embodiment of the cable connected to the computer and disconnected from the electronic device.

Referring now to FIGS. 2-4, cable 100 may be used in conjunction with computer 200. Although shown as a laptop computer, it should be recognized that other devices besides computer 200 may be used in conjunction with cable 100. Other devices may include various types of electrical devices that include electrical connections compatible with the plugs of cable 100, such as televisions, game consoles, or other electronic devices. Further, in other embodiments, an electrical plug such as a one-hundred and ten volt plug may include various sockets or receptors that are compatible with plugs of cable 100.

In some embodiments, computer 200 may have various sockets for receiving various plugs. In the embodiment shown in FIGS. 2-4, computer 200 may have a receiving socket that is compatible with a USB A-type plug. Third plug 112 (not visible) of second connector 104 may be inserted into the socket of computer 200 thereby electrically connecting third plug 112 with the socket of computer 200. As used herein the term "electrically connected" is used to describe an orientation of location of various electrical components such that the components are configured to transfer electrical currents. For example, electrical current or electrons do not need to be passing from the socket of computer 200 to third plug 112 in order for third plug 112 and the socket of computer 200 to be electrically connected. Rather, third plug 112 may be inserted into the socket of computer 200 and be configured to receive electrical current or electrons. In this configuration, third plug 112 may be electrically connected to the socket of computer 200.

Referring particularly to FIG. 2, two different electronic devices are shown: first device 202 and second device 204. In some embodiments, the devices may be cellular phones, tablets, game consoles, or any other suitable electronic device. In some embodiments, first device 202 and second device 204 may include sockets that are configured to receive differing shapes, sizes, or types of plugs. As shown, first device 202 includes a socket for receiving a micro USB B-type plug. In contrast, second device 204 includes a socket for receiving a Lightning® type plug. In other embodiments, the electronic devices may include various types of sockets.

In some embodiments, a device may be plugged in to computer 200 for various reasons, A user may wish to send data to computer 200, charge the device, retrieve data from the computer, or many other reasons, Generally, data signals or power may be sent or received through cable 100. Additionally, as discussed previously, the device may also be plugged into an outlet adapter to charge the device.

As shown in FIG. 3, first plug 108 (not visible) of first connector 102 may be plugged into the socket of first device 202. A user may perform certain tasks while first device 202 is connected to cable 100 and therefore connected to computer 200. Once a desired action is completed, first device 202 may be removed or disconnected from first plug 108 of first connector 102 of cable 100. As shown in FIG. 4, first device 202 has been disconnected from cable 100.

Figure 5:
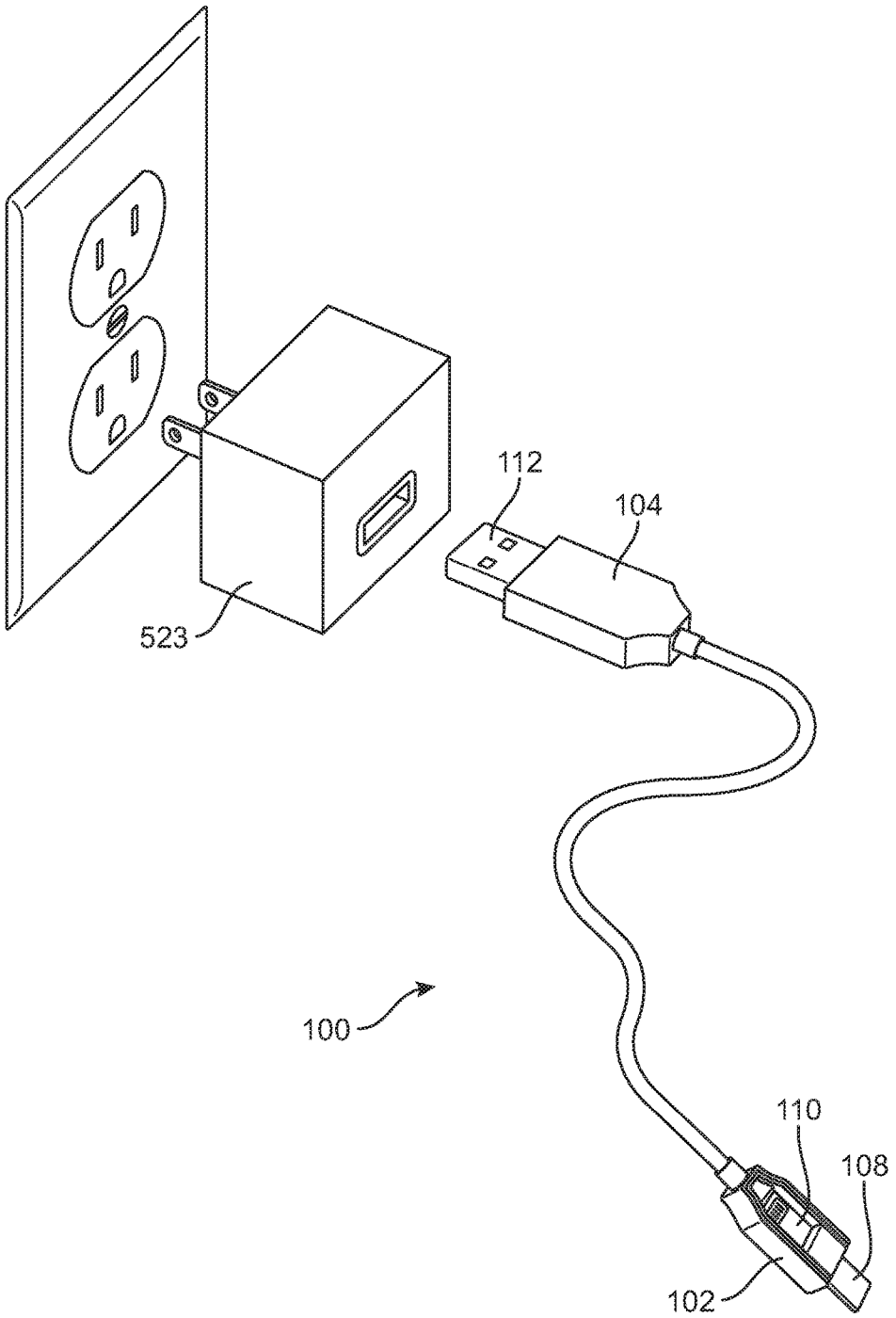
FIG. 5 is a schematic view of an electrical wall socket with a power brick plugged in for powering a USB device.

In some applications, the cable may be used to simply power or charge a device. Although shown previously connected to computer 200, cable 100 may also be connected to a wall socket adapter. FIG. 5 illustrates a conventional wall socket with a power brick receiving third plug 112, shown as a USB A-type connector, as this is a typical powering and charging configuration. The source of power may be a spare battery pack instead of a wall socket, but the configuration of socket adapter 523 may be the same or similar. As shown, third plug 112 of second connector 104 may be inserted into a socket within socket adapter 523. Therefore, cable 100 may be electrically connected to socket adapter 523. One basic use of the cable of the present invention is to enable multiple devices to be charged or powered from a conventional wall socket or battery pack. That is, first connector 102 may be utilized to connect various electrical devices with socket adapter 523 by rotating between first plug 108 and second plug 110.

In some embodiments, a user may wish to connect second device 204 to cable 100 to either computer 200 or socket adapter 523 as discussed previously. For example, the user may wish to charge second device 204 or send or receive data using second device 204, In some embodiments, however, second device 204 may have a socket or connection mechanism that is incompatible with first plug 108. Therefore, in order to connect second device 204 to cable 100, the plugs of first connector 102 may be rotated so that second plug 110 may be configured to be connectable to second device 204.

Figure 8:
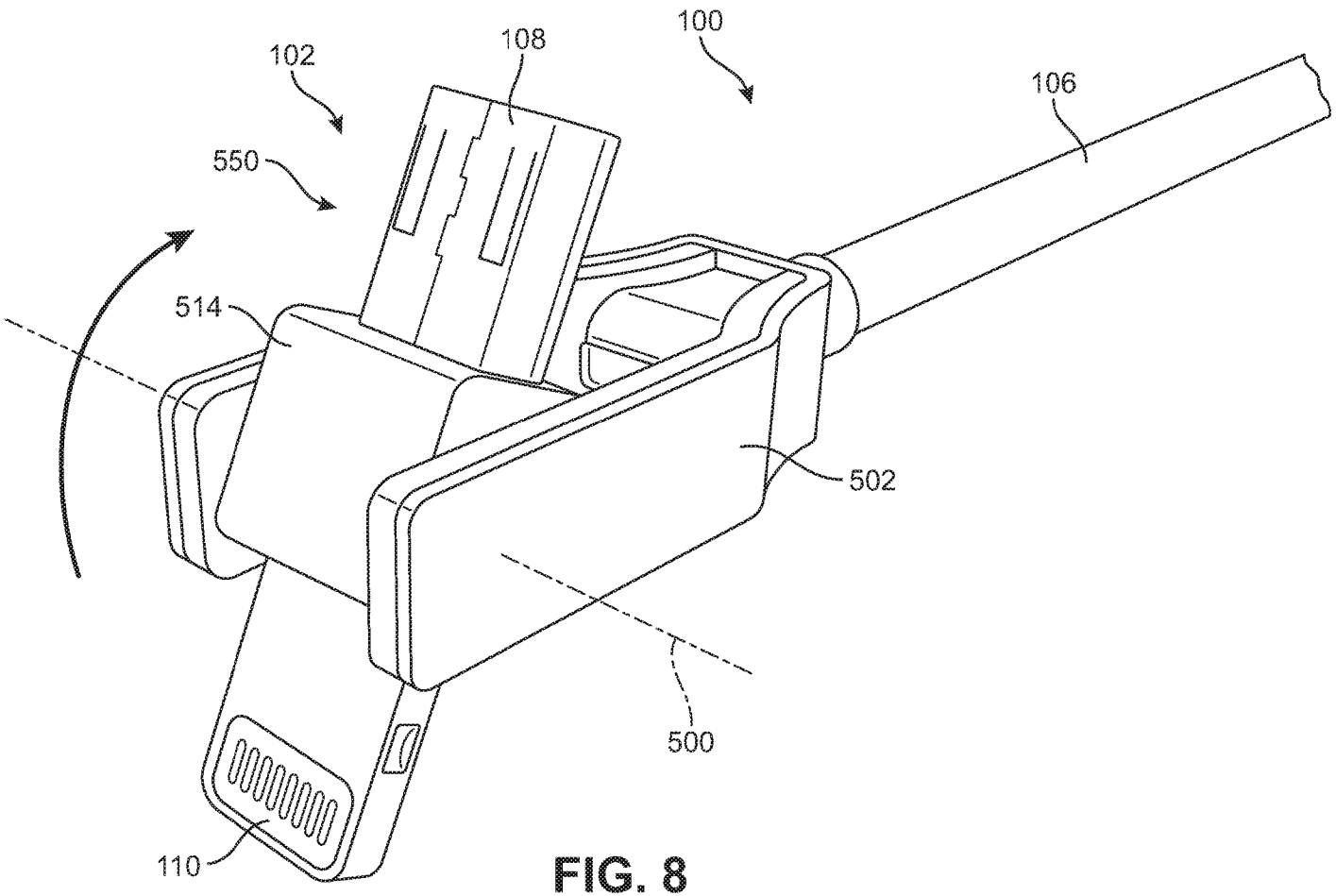
FIG. 8 is an enlarged schematic view of an embodiment of a first connector with the plug assembly in a partially rotated position.
Figure 9:
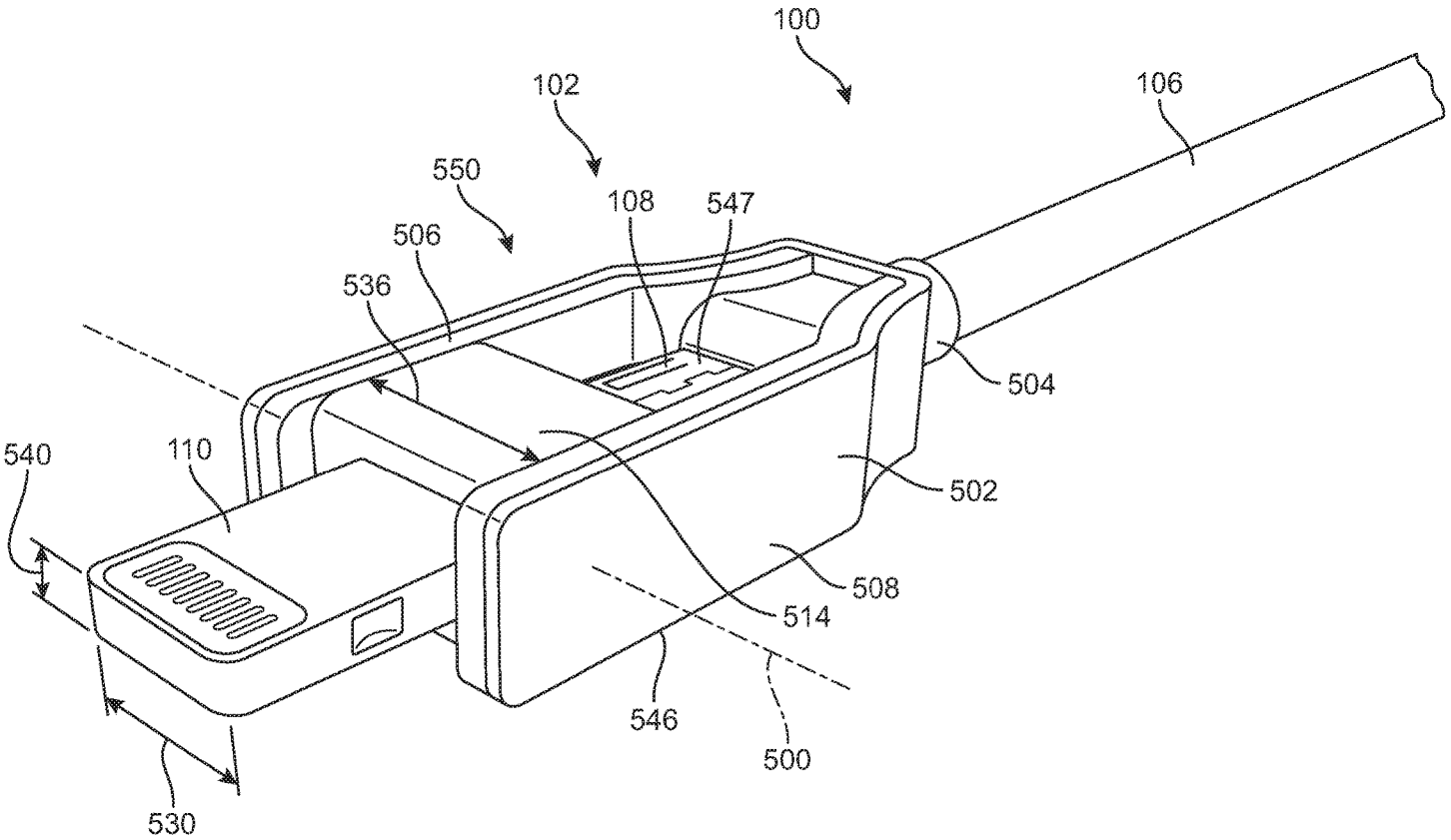
FIG. 9 is an enlarged schematic view of an embodiment of a first connector with the plug assembly in a completely rotated position.
Figure 10:
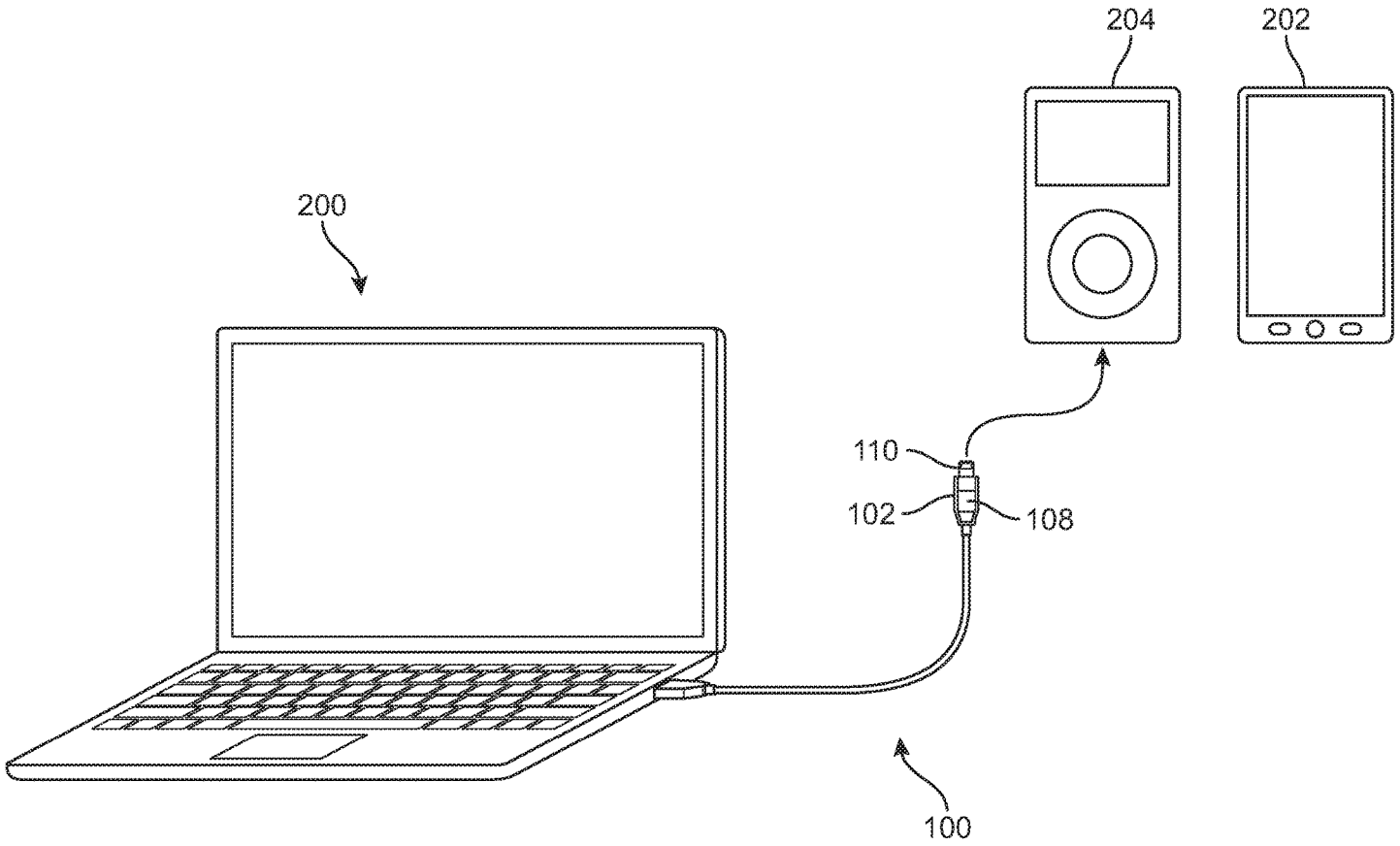
FIG. 10 is a schematic view of an embodiment of the cable connected to the computer.
Figure 11:
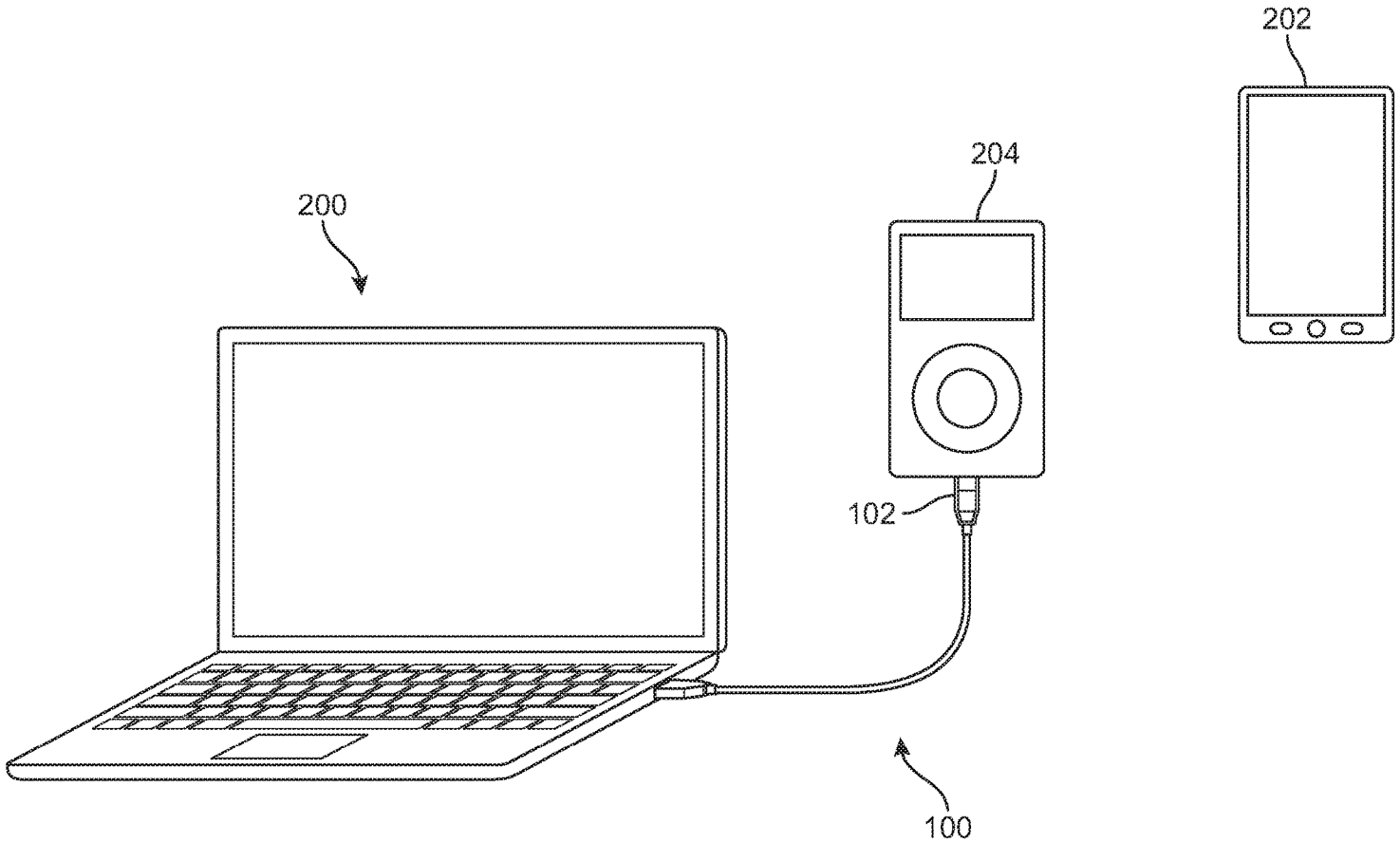
FIG. 11 is a schematic view of an embodiment of the cable connected to the computer and connected to a different electronic device.

In some embodiments, plugs within various connectors may rotate or pivot in order to be accessible. As depicted in FIGS. 6-9, first plug 108 and second plug 110 may rotate so that second plug 110 is able to be connected to various devices. As shown, second plug 110 and first plug 108 may rotate or pivot about axis 500 and swap places such that second plug 110 is exposed outside of the bounds or boundary of body 502 of first connector 102. Therefore, second plug 110 may be rotated such that second plug 110 is configured to be connectable to an electronic device. In some embodiments, as shown in FIGS. 6-9, first plug 108 and second plug 110 may rotate 180 degrees about axis 500. As shown in FIGS. 10 and 11, once rotated second plug 110 may now be plugged into second device 204. In this connected configuration, second device 204 may now be able to communicate with computer 200 or may be charged by socket adapter 523. As such, devices with multiple receiving sockets may be able to be connected to a computer or electrical socket with the same cable. Therefore, the number of cables or adapter pieces that may be necessary to charge or otherwise use with multiple devices may be reduced.

Figure 6:
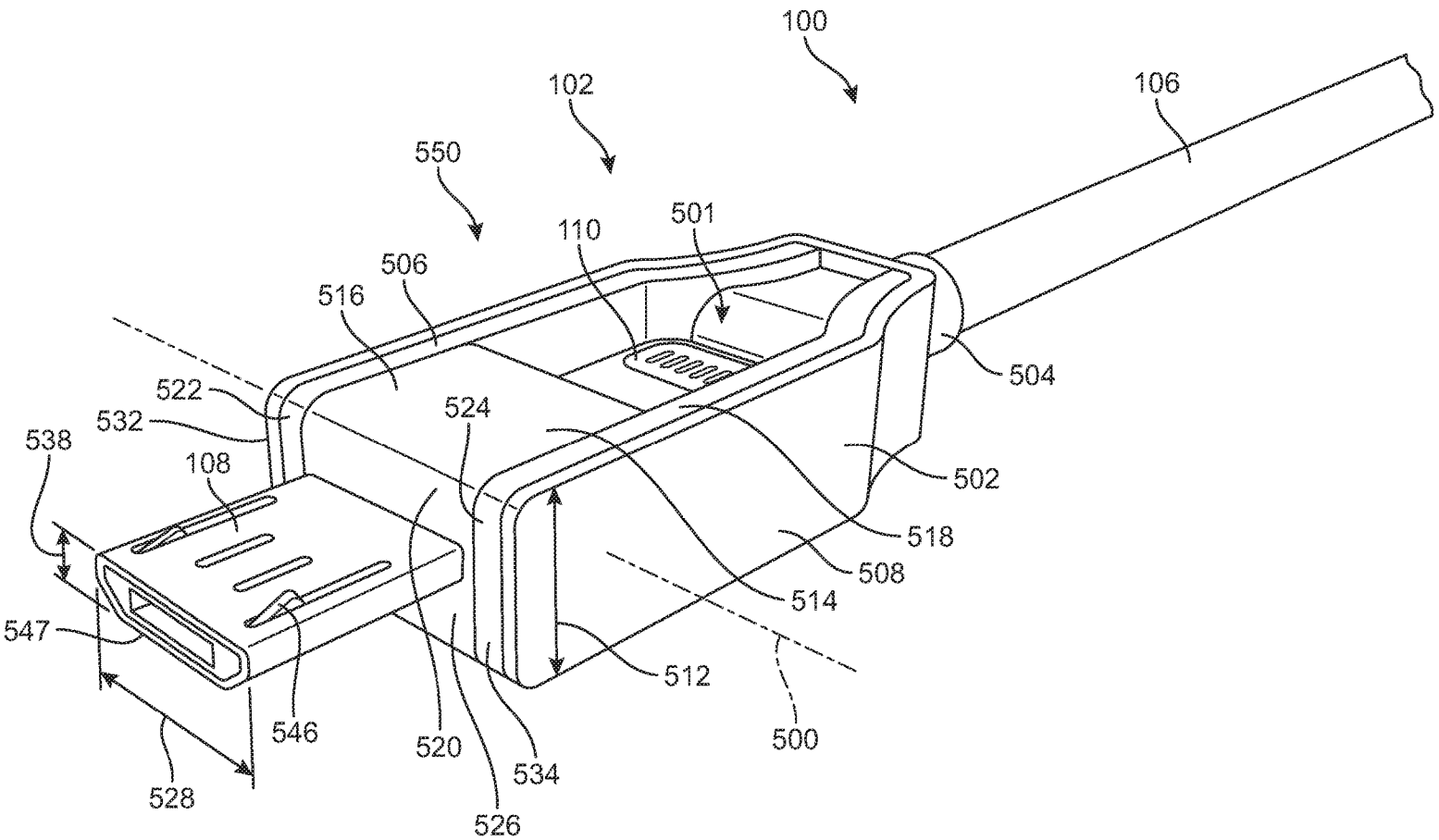
FIG. 6 is an enlarged schematic view of an embodiment of a first connector with a plug assembly.
Figure 7:
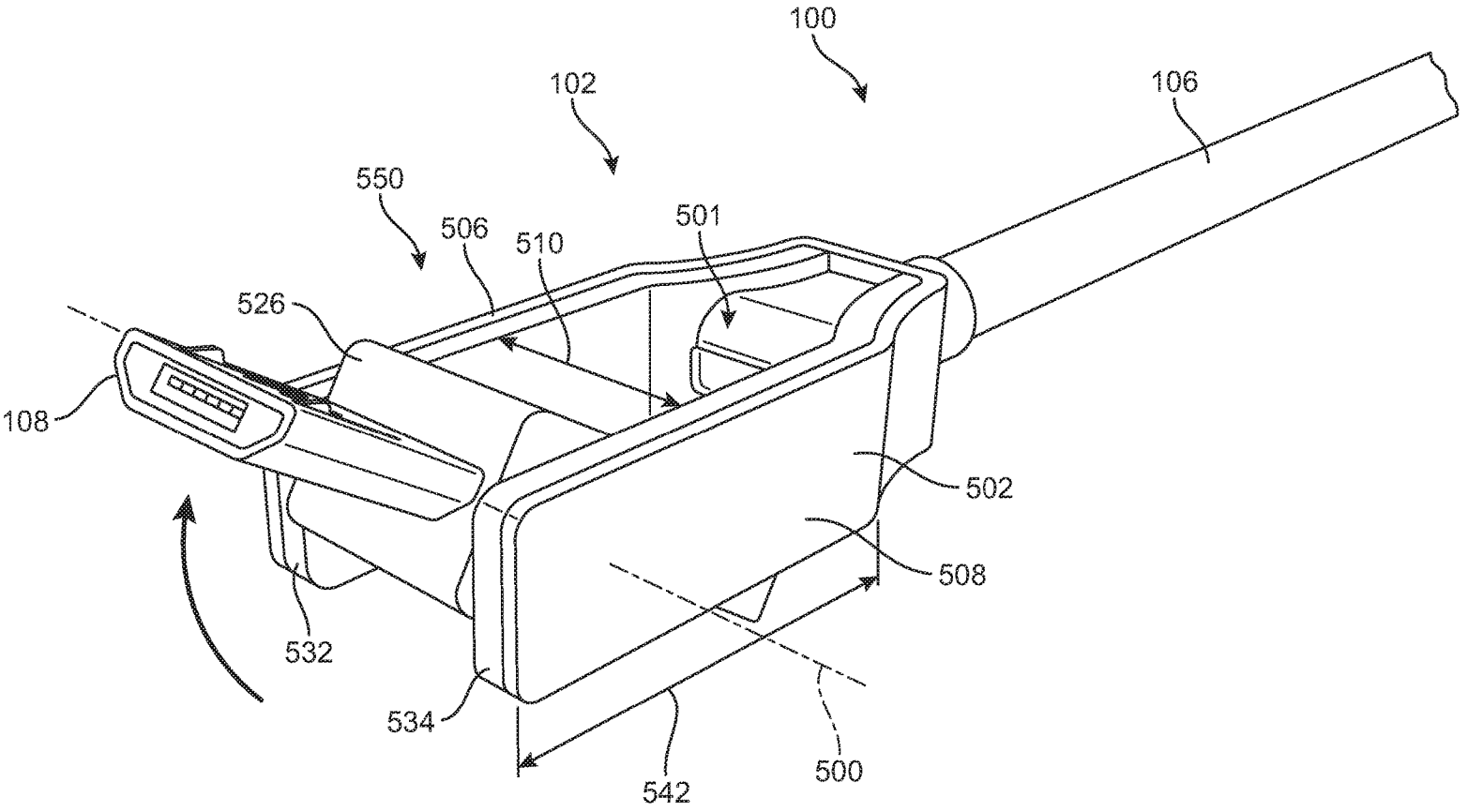
FIG. 7 is an enlarged schematic view of an embodiment of a first connector with the plug assembly in a partially rotated position.

In some embodiments, plugs may be positionable in different orientations within various connectors. Referring specifically to FIG. 6, an enlarged view of first connector 102 is depicted. In this configuration, cable 100 may be configured to receive an electronic device with a socket that corresponds with first plug 108. That is, cable 100 may be in the same configuration as depicted in FIGS. 1-4. As shown in FIG. 6, first plug 108 may be electrically connected to the rest of cable 100 and may therefore be in a ready state for use. Additionally, first plug 108 may be electrically connected to second connector 104. In the configuration as shown in FIG. 6, however, second plug 110 may be in a stowed or stored position and may not be electrically connected or may be electrically disconnected to the rest of cable 100 and may therefore not be ready for use or operation. As shown in FIGS. 7 and 8, neither first plug 108 nor second plug 110 may be ready for use as neither may be electrically connected to the rest of cable 100 in such configurations. As shown in FIG. 10, however, second plug 110 may be ready for use and may be electrically connected to the rest of cable 100. In the configuration shown in FIG. 10, first plug 108 is in a stored configuration and is not electrically connected to cable 100 and is therefore not ready for use. The electrical connections of first plug 108 and second plug 110 are discussed in further detail later in this detailed description. The electrical connections are also depicted in FIGS. 12-15.

In some embodiments, a stored plug may be visible and exposed. As shown in FIG. 6, second plug 110 may be visible through cavity or opening 501. Because second plug 110 is not electrically connected in the stored configuration, second plug 110 may be exposed. By designing cable 100 such that second plug 110 may be exposed, less material may be needed than in other configurations that include a charged or electrically connected plug in the stored configuration. That is because a plug that is not charged or electrically connected may not require a protective case or covering.

In some embodiments, first connector 102 may include provisions to support and secure connectable plugs. In some embodiments, the end of first connector 102 opposite connection end 504 may be configured with a plug for connecting cable 100 to various devices. In some embodiments, body 502 of first connector 102 may have a u-shaped configuration that may facilitate in supporting the various plugs of first connector 102. As shown, body 502 includes opening 501 that extends between first prong 506 and second prong 508 of body 502 of first connector 102. As shown in FIG. 6, second plug 110 may be situated within opening 501 between first prong 506 and second prong 508.

In some embodiments, first prong 506 and second prong 508 may be spaced from each other in order to accommodate the width of various plugs. As seen best in FIG. 7, first prong 506 is spaced from second prong 508 by distance 510. Distance 510 may be greater than or equal to width 528 of first plug 108 (see FIG. 6). Distance 510 may also be greater than or equal to width 530 of second plug 110 (see FIG. 9). In some embodiments, the width of first plug 108 and second plug 110 may be different from each other. Therefore, the distance between first prong 506 and second prong 508 may be greater than or equal to the larger of width 528 of first plug 108 or width 530 of second plug 110. By spacing first prong 506 away from second prong 508 by distance 510, opening 501 between first prong 506 and second prong 508 may be large enough to accommodate both first plug 108 and second plug 110.

The prongs of the connectors may be particularly spaced to reduce or maintain the overall height of the connectors when compared to other conventional connectors. First prong 506 and second prong 508 of first connector 102 are spaced such that the overall width of first connector 102 may be affected rather that the height. Because plug head 514 to which first plug 108 and second plug 110 are attached is configured to rotate about axis 500 that passes width-wise through plug head 514, first prong 506 and second prong 508 are spaced with regard to the width of plug head 514 and the various plugs rather than the height of plug head 514 and the height of various plugs. Electronic devices have become thinner over time (for example MacBook® Air®); however, many electronic devices have not reduced in width. For example, the width of a laptop computer has remained relatively constant or similar. The height or thickness of a laptop computer has changed dramatically, such that the keyboards of some laptop computers can barely accept the thickness of a USB A-type plug. By placing first prong 506 and second prong 508 of first connector 102 along the sides of first connector 102, the height of first connector 102 may not be increased as compared to other conventional connection devices. By reducing the height profile of first connector 102, first connector 102 may not extend beyond the height profile of the electronic device to which first connector 102 is connected. This may prevent first connector 102 from being caught on various external objects and may maintain a clean appearance when connected to an electronic device. Further, by orienting the prongs width-wise, the instances of the prongs being scraped on a lower surface may be reduced.

In some embodiments, various height configurations of body 502 may be utilized. In some embodiments, the height of body 502 may be large enough such that the plugs may be located within the bounds of body 502. That is, when rotated within opening 501 of body 502, the plugs may not be visible from a side view of first connector 102. For example, referring to FIG. 6, second plug 110 may not be visible from a side view of first connector 102. In some embodiments, height 512 of body 502 may be greater than height 540 of second plug 110 (see FIG. 9) and may also be greater than height 538 of first plug 108 (see FIG. 6), In such a configuration, when first plug 108 is rotated into cavity 501 of body 502, first plug 108 may not be visible from a side view of first connector 102. Similarly, when second plug 110 is rotated into cavity 501 of body 502, second plug 110 may not be visible from a side view of first connector 102. By confining the stored plug within the bounds of body 502 of first connector 102, the unused plug may be protected from being caught by external objects. Further, first connector 102 may have a pleasing appearance by securing the unused plug within the bounds of body 502. Although shown as a substantially constant height, in some embodiments, body 502 of first connector 102 may taper or have variations in height. As depicted, however, and for ease of description, body 502 may have a substantially constant height of height 512.

In some embodiments, a connector may include a plug head to which each plug may be secured. In some embodiments the plug head may include electrical connections that correspond to each plug. As shown in FIGS. 6-9, first connector 102 includes plug head 514. As shown, first plug 108 and second plug 110 are connected to plug head 514. In some embodiments, plug head 514 may be located between first plug 108 and second plug 110, That is, in some embodiments, first plug 108 and second plug 110 may be located on opposite sides of plug head 514. As shown in FIGS. 6-9, first plug 108 and second plug 110 may be approximately parallel and in line with body 502 of first connector 102. Further, first plug 108 and second plug 110 may be substantially in line with each other. In other embodiments, first plug 108 and second plug 110 may be located on adjacent sides of plug head 514. The combination of first plug 108 and second plug 110 as well as plug head 514 may be referred to as plug assembly 550.

In some embodiments, a plug head may have various shapes. In some embodiments, the plug head may be rectangular or cube shaped. In other embodiments, the plug head may be cylindrical. In still further embodiments, the plug head may be oval shaped or other shapes. As depicted in FIGS. 6-9, plug head 514 is substantially cube shaped. When rotated into a ready position, plug head 514 may align with body 502 of first connector 102. That is, first surface 516 of plug head 514 may align with upper surface 518 of body 502 of first connector 102 such that a smooth or flush surface is formed. Additionally, in some embodiments, first curved surface 520 of plug head 514 may align with upper curved surface 522 of first prong 506 as well as with upper curved surface 524 of second prong 508. Further, in some embodiments, second surface 526 of plug head 514 may align with end surface 532 of first prong 506 as well as with end surface 534 of second prong 508. In this configuration, a flush or even surface may be formed between second surface 526 of plug head and end surface 532 of first prong 506 as well as with end surface 534 of second prong 508. In some embodiments, similar alignment between the other surfaces of plug head 514 and surfaces of the prongs of body 502 may be present. For example, when plug assembly 550 is rotated such that first plug 108 is in the stowed or stored position, upper surface 518 of body 502 may be similarly aligned with the upward-facing surfaces of plug head 514. Furthermore, the lower surface of the prongs of body 502 may similarly align with surfaces of plug head 514. By aligning multiple surfaces of plug head 514 with surfaces of body 502, first connector 102 may have a clean and polished look. Additionally, the alignment of surfaces may facilitate in preventing debris from accumulating on various portions of first connector 102. Additionally, if debris does build up, aligning the surfaces may facilitate in a cleaning process as the alignment of surfaces may reduce the number of crevices in first connector 102. Further, aligning the surfaces may also reduce the likelihood of portions of first connector 102 getting caught on external objects.

In some embodiments, the plugs of plug assembly 550 may be positioned to restrict rotation of plug assembly 550 during use. In some embodiments, the plugs of plug assembly 550 may be positioned such that when the plugs are inserted into a socket, end surface 534 of second prong 508 and end surface 532 of first prong 506 may abut the device to which the plugs are inserted. For example, as depicted in use in FIG. 3, end surface 534 of second prong 508 and end surface 532 of first prong 506 may abut against a surface of first device 202. By designing first connector 102 such that the end surfaces of body 502 abut surfaces of the device to which first connector 102 is inserted, the stability of first connector 102 may increase when compared to other embodiments. Because the end surfaces of body 502 abut a surface of first device 202, the rotation of first connector 102 may be restricted. Therefore, the rotation of plug head 514 may also be restricted. By restricting rotation of plug assembly 550, accidental electrical disconnection of the plug by rotation may be reduced.

In some embodiments, the width of the plug head may be substantially similar to the distance between the prongs of the body of the connector. As shown in FIGS. 6-9, width 536 (see FIG. 9) of plug head 514 may be substantially similar to distance 510 (see FIG. 7) between first prong 506 and second prong 508. By sizing the width of plug head 514 to be similar to the distance between the prongs of body 502, a smooth and substantially planar surface may be formed that extends from plug head 514 and between the prongs of body 502. The closely fitted nature of plug head 514 between first prong 506 and second prong 508 may also reduce the likelihood that portions of first connector 102 may be caught on external objects. Further, the flush surface may facilitate in preventing dirt or debris from accumulating between plug head 514 and the interior surfaces of first prong 506 and second prong 508.

In some embodiments, the length or depth of opening 501 of body 502 may be sized to particularly accommodate different plugs. As shown in FIGS. 6-9, length 542 (se FIG. 7) of opening 501 may be large enough to accommodate the length of plug head 514 as well as the length of first plug 108 or second plug 110. In some embodiments, first plug 108 and second plug 110 may not have the same lengths. Therefore, length 542 may be long enough to accommodate the longest of first plug 108 and second plug 110 as well as plug head 514. In some embodiments, plug head 514 may also be positioned to accommodate the different length of plugs. For example, plug head 514 may be positioned toward the end surfaces of the prongs in order to provide additional space for either first plug 108 or second plug 110 to fit within opening 501.

In some embodiments, plug head 514 may be positioned such that in certain configurations, the surface of plug head 514 to which a plug abuts may not align with the end surfaces of the prongs. For example, in some embodiments, second surface 526 may be positioned beyond end surface 532 of first prong 506 as well as beyond end surface 534 of second prong 508. Plug head 514 may be positioned in such a configuration so as to permit sufficient distance for second plug 110 to fit within opening 501 when second plug 110 is not in use. By changing the position of plug head 514 within body 502, more or less distance may be provided for the out-of-use plug.

In some embodiments, the orientation of various surfaces of plugs may change when a plug is moved from or to the stored or unused position. Referring particularly to FIG. 6, upper surface 546 of first plug 108 faces upward and lower surface 547 (not visible) of first plug 108 faces downward. As plug assembly 550 is rotated as shown in FIGS. 6-9, the orientation of the surfaces of first plug 108 changes. Referring now to FIG. 9, lower surface 547 of first plug 108 now faces upward and upper surface 546 (not visible) faces downward. In some embodiments, various designs may be placed on lower surface 547 of first plug 108 to provide first connector 102 with a polished or clean appearance. Additionally, information regarding second plug 110 may be placed on lower surface 547. Information may include identifying which surface of second plug 110 is the upper surface in order to facilitate insertion of second plug 110 into a corresponding socket with ease.

Figure 12:
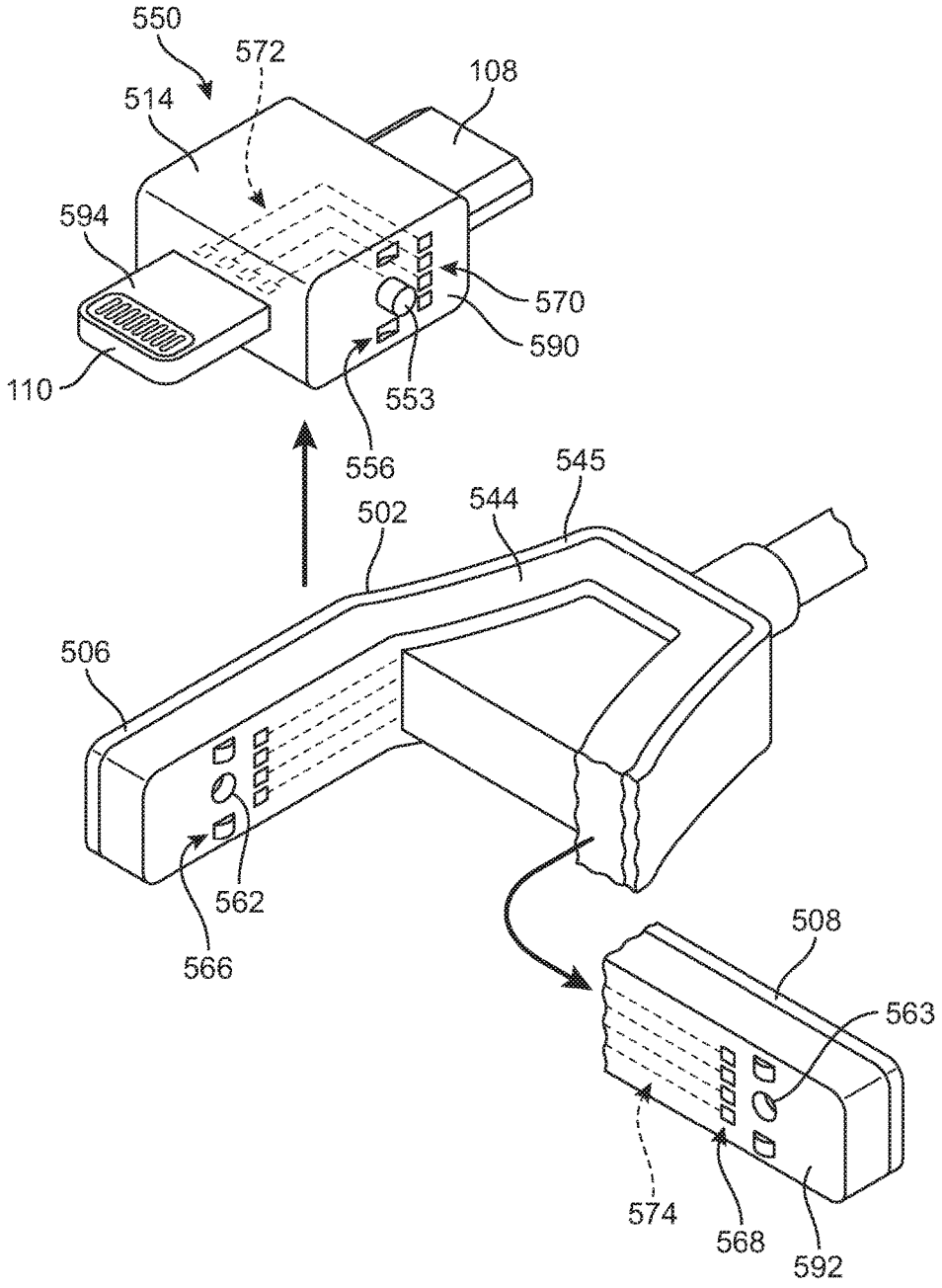
FIG. 12 is an exploded isometric view of an embodiment of a plug assembly and a body portion of the first connector.

Referring now to FIGS. 12-15, various views of first connector 102 and portions of first connector 102 are depicted. Referring particularly to FIG. 12, body 502 of first connector 102 is depicted separately from plug assembly 550. As shown, plug assembly 550 comprises first plug 108, second plug 110, and plug head 514. Additionally, FIG. 12 also includes a cutaway view of body 502 so that the interior surface of first prong 506 as well as the interior surface of second prong 508 may be seen.

In some embodiments, the plugs of a particular connector may be positioned in various orientations with respect to other portions of the connector. For example, as shown in FIG. 12, plug head 514 includes interior surface 590. Additionally, second prong 508 includes interior surface 592. When assembled, interior surface 590 of plug head 514 is aligned and substantially parallel to interior surface 592 of second prong 508. Upper surface 594 of second plug 110 may be oriented such that upper surface 594 of second plug 110 is substantially perpendicular to interior surface 592 of second prong 508 as well as interior surface 590 of plug head 514. In this orientation, upper surface 594 may remain substantially perpendicular to interior surface 592 of second prong 508 as well as interior surface 590 of plug head 514 although plug assembly 550 may be rotated.

Figure 13:
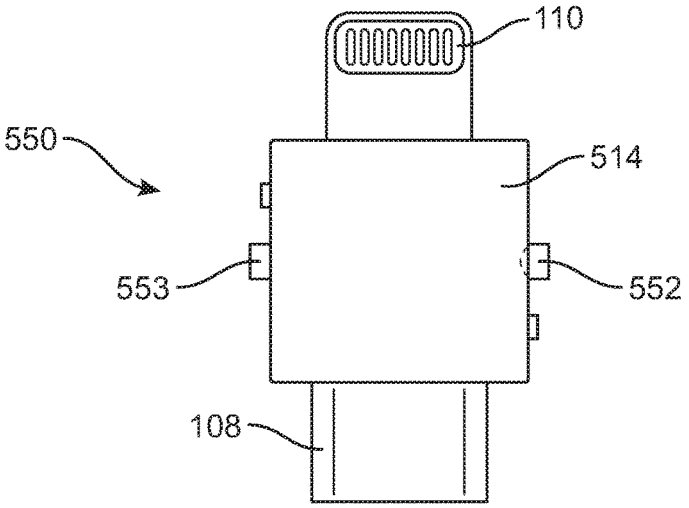
FIG. 13 is a top view of an embodiment of the plug assembly.

In some embodiments, plug assembly 550 may include features to facilitate connecting or joining plug assembly 550 with body 502. In some embodiments, plug assembly 550 may include a rod or first axle 552 that may assist is securing plug assembly 550 with body 502. Additionally, first axle 552 may also assist in allowing plug assembly 550 to rotate with respect to body 502. In some embodiments, first axle 552 may extend through plug head 514 from one side of plug head 514 to the other side. In other embodiments, multiple axles may be utilized. For example, as shown in FIG. 13, first axle 552 is located along a first side of plug head 514 and second axle 553 is located on an opposite side of plug head 514. In some embodiments, first axle 552 and second axle 553 may be separate pieces. In some embodiments, first axle 552 and second axle 553 may be co-molded or co-formed with the body of plug head 514. In still further embodiments, first axle 552 and second axle 553 may be separate pieces that are attached to plug head 514 after plug head 514 has been formed.

In some embodiments, the axles of plug assembly 550 may interact with a corresponding depression, opening, or hole in body 502. As shown best in FIG. 12, first prong 506 includes first opening 562 and second prong 508 includes second opening 563. The size and depth of first opening 562 and second opening 563 may correspond to the size and depth of the axles of plug assembly 550. In some embodiments, first opening 562 may extend through first prong 506 and second opening 563 may extend through second prong 508. As depicted, however, first opening 562 extends partially through first prong 506 and second opening 563 extends partially through second prong 508. Therefore, each of the openings may be considered blind holes.

In some embodiments, first axle 552 may be positioned within first opening 562 and second axle 553 may be positioned within second opening 563. In some embodiments, when assembled with body 502, plug assembly 550 may be able to spin or rotate about the axles. That is, there may be sufficient space or clearance within the connection of the axles and the openings to allow for plug assembly 550 to be freely rotated.

In some embodiments, body 502 may hold or support plug assembly 550 when assembled together. In some embodiments, body 502 may be formed of a resilient material that may provide a spring-like effect to plug assembly 550. For example, first prong 506 and second prong 508 may press against plug assembly 550 such that first axle 552 does not fall out of first opening 562 and second axle 553 does not fall out of second opening 563. The resilient nature of body 502 may therefore rotatably secure plug assembly 550 with body 502 thereby preventing plug assembly 550 from falling out while also allowing plug assembly 550 to rotate freely through opening 501. As used in this detailed description, "rotatably secure" is used to describe a state where an object or portion is able to rotate about an axis; however, the item is restricted from moving laterally or vertically with respect to the portions to which the object is rotatably secured. As shown in FIG. 12, plug assembly 550 is configured to be able to rotate about first axle 552; however, plug assembly 550 is restricted from moving laterally or vertically with respect to body 502.

In some embodiments, body 502 may be composed of different materials. In some embodiments, body 502 may include a resilient, spring-like material as well as an insulating material. As shown, body 502 includes interior portion 544 and exterior portion 545. In some embodiments, interior portion 544 may comprise an insulating material, such as a rubber or a plastic material. Interior portion 544 may extend around opening 501 and may be disposed adjacent plug assembly 550 as well as exterior portion 545. Interior portion 544 may provide an area or space in which to locate electrical wires. Exterior portion 545 may be located along the exterior portion of body 502. Exterior portion 545 may be formed of a resilient material such as aluminum, steel, plastic, or other material. Exterior portion 545 may facilitate in providing a spring-like compressive force to plug assembly 550. Additionally, exterior portion 545 may protect various portions of first connector 102.

In some embodiments, plug assembly 550 and body 502 may include provisions to secure plug assembly 550 in place at a specified orientation with respect to body 502, In some embodiments, the provisions may be configured to orient first plug 108 and second plug 110 in various configurations. Plug assembly 550 may therefore resist any unintentional rotation of plug assembly 550 during use. In some embodiments, the provisions may orient the plugs such that the plugs are substantially parallel with the length of body 502. For example, as seen in FIG. 9, second plug 110 extends away from body 502 in a substantially parallel manner.

Figure 14:
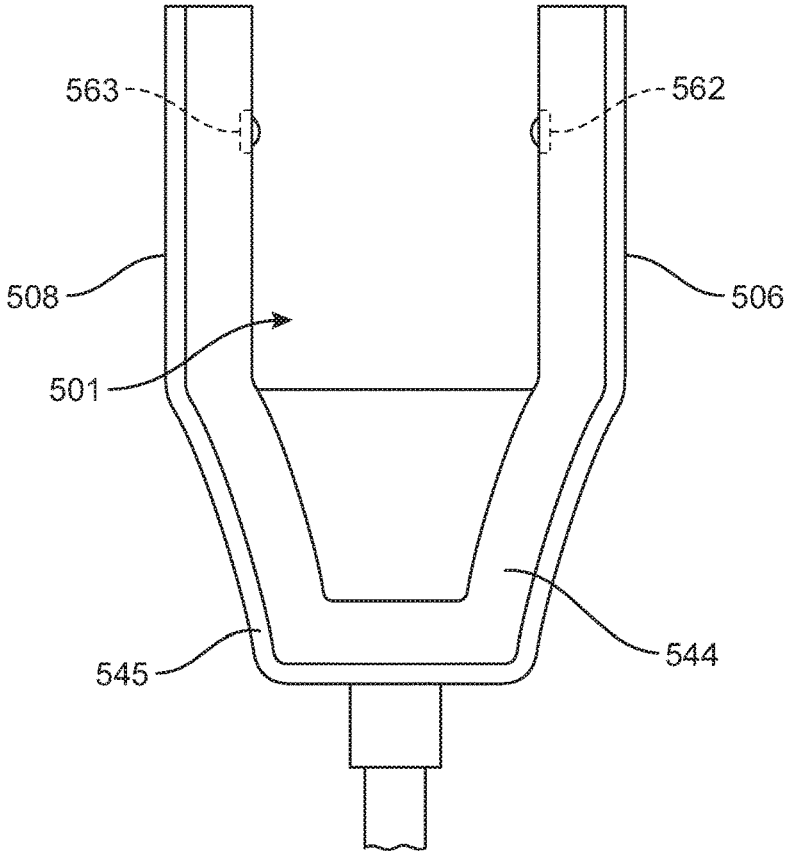
FIG. 14 is a top view of an embodiment of the body portion of the first connector.

In some embodiments, a detent mechanism may be used to secure plug assembly 550 in particular orientations. In some embodiments, provisions on plug head 514 as well as body 502 may be used to provide a detent mechanism for first connector 102, As shown in FIGS. 12-14, plug head 514 includes plurality of depressions 556 located adjacent to first axle 552 and second axle 553. In some embodiments, the distance of the depth of plurality of depressions 556 may be less than the distance of the length of first axle 552 or second axle 553. Additionally, in some embodiments, body 502 may include plurality of extensions 566 that are positioned adjacent to first opening 562 as well as second opening 563. In some embodiments, the location of plurality of extensions 566 may be similarly spaced around first opening 562 and second opening 563 as are plurality of depressions 556 around first axle 552 and second axle 553. In other embodiments, plurality of extensions 566 as well as plurality of depressions 556 may be located in other locations.

In some embodiments, plurality of depressions 556 and plurality of extensions 566 may be spaced such that when plug assembly 550 is located within body 502, plurality of extensions 566 may align with plurality of depressions 556. When plurality of extensions 566 align with plurality of depressions 556, plug assembly 550 may be partially restricted from motion. That is, when aligned, plurality of extensions 566 may click into plurality of depressions 556 and restrict plug assembly 550 from rotating further. Although plurality of depressions 556 are shown on both sides of plug head 514 and plurality of extensions 566 are shown on both first prong 506 and second prong 508, in other embodiments a single side of plug head 514 may include a plurality of extensions and a single prong may include a plurality of extensions. For example, in another embodiment, only second prong 508 may include plurality of extensions 566 and only the side of plug head 514 adjacent second prong 508 may include corresponding plurality of depressions 556. Further, in other embodiments, plug head 514 may include extensions while body 502 includes corresponding depressions.

Referring now to FIGS. 6-9 the use of the detent mechanism may be explained. Referring to FIG. 6, the detent mechanism may be engaged. That is, plurality of extensions 566 may be located within plurality of depressions 556. In this position, plug assembly 550 may be partially locked into place such that plug assembly 550 is restricted from freely rotating. In FIG. 7, plug assembly 550 is being rotated. In order for plug assembly 550 to be rotated from the position in FIG. 6 to the position of plug assembly 550 in FIG. 7, a magnitude of force is pressed against plug assembly 550 to rotate plug assembly 550. The magnitude of force required to move plug assembly 550 from the position as depicted in FIG. 6 to the position as depicted in FIG. 7 is greater than the magnitude of force required to move plug assembly 550 from the position as depicted in FIG. 7 to the position as depicted in FIG. 8 because plurality of extensions 566 are not locked in place in FIG. 7. Because body 502 may be formed of a resilient material, as plug assembly 550 is pressed in FIG. 6, first prong 506 and second prong 508 may press slightly away from each other as plurality of extensions 566 are moved out of plurality of depressions 556. Then plug assembly 550 may be moved to the orientation shown in FIG. 7, Additionally, because first axle 552 and second axle 553 are longer than plurality of extensions 566, plug assembly 550 may remain within body 502, because first axle 522 is still located within first opening 562 and second axle 553 is still located within second opening 563. As plug assembly 550 continues to be rotated, plurality of extensions 566 may click into plurality of depressions 556 as shown in FIG. 9. The detent mechanism therefore restricts plug assembly 550 from freely rotating at all times in order to partially secure the plugs of plug assembly 550 in various orientations.

In some embodiments, first connector 102 may include provisions to electrically connect various plugs with cord 106, As seen in FIG. 12, in some embodiments, body 502 may include first plurality of body contacts 568. Further, plug head 514 may include first plurality of plug head contacts 570. In some embodiments, first plurality of plug head contacts 570 may align with first plurality of body contacts 568. In some embodiments, the detent mechanism described previously may be oriented such that plug assembly 550 may be partially secured at an orientation that aligns first plurality of plug head contacts 570 with first plurality of body contacts 568.

In some embodiments, first plurality of body contacts 568 may be in physical contact with first plurality of plug head contacts 570 at various positions. When first plurality of body contacts 568 are in contact with first plurality of plug head contacts 570, an electrical connection may be formed. In some embodiments, first plurality of body contacts 568 may be electrically connected to second plug 110. As shown in FIG. 12, first plurality of plug head electrical connections 572 extend between and connect second plug 110 to first plurality of plug head contacts 570. Although first plurality of plug head contacts 570 is shown as including four contacts, the number of contacts of first plurality of plug head contacts 570 may be less than or greater than four. In some embodiments, first plurality of plug head electrical connections 572 may be located within plug head 514. By placing first plurality of plug head electrical connections 572 within plug head 514, plug head 514 may insulate first plurality of plug head electrical connections 572 from various external influences. This placement may reduce the likelihood of damage to first plurality of plug head electrical connections 572.

In a similar fashion, first plurality of body contacts 568 is shown as including four contacts. In other embodiments, the number of first plurality of body contacts 568 may be less than or greater than four. Further, first plurality of body contacts 568 may be electrically connected to other portions of cable 100. As shown in FIG. 12, first plurality of body electrical connections 574 may extend or pass within body 502, through interior portion 544. For example, as shown in FIG. 12, first plurality of body electrical connections 574 extend within and through second prong 508 of body 502. In some embodiments, placing first plurality of body electrical connections 574 within interior portion 544 of body 502 may insulate first plurality of body electrical connections 574 from various external influences. This placement may reduce the likelihood of damage to first plurality of body electrical connections 574.

Figure 15:
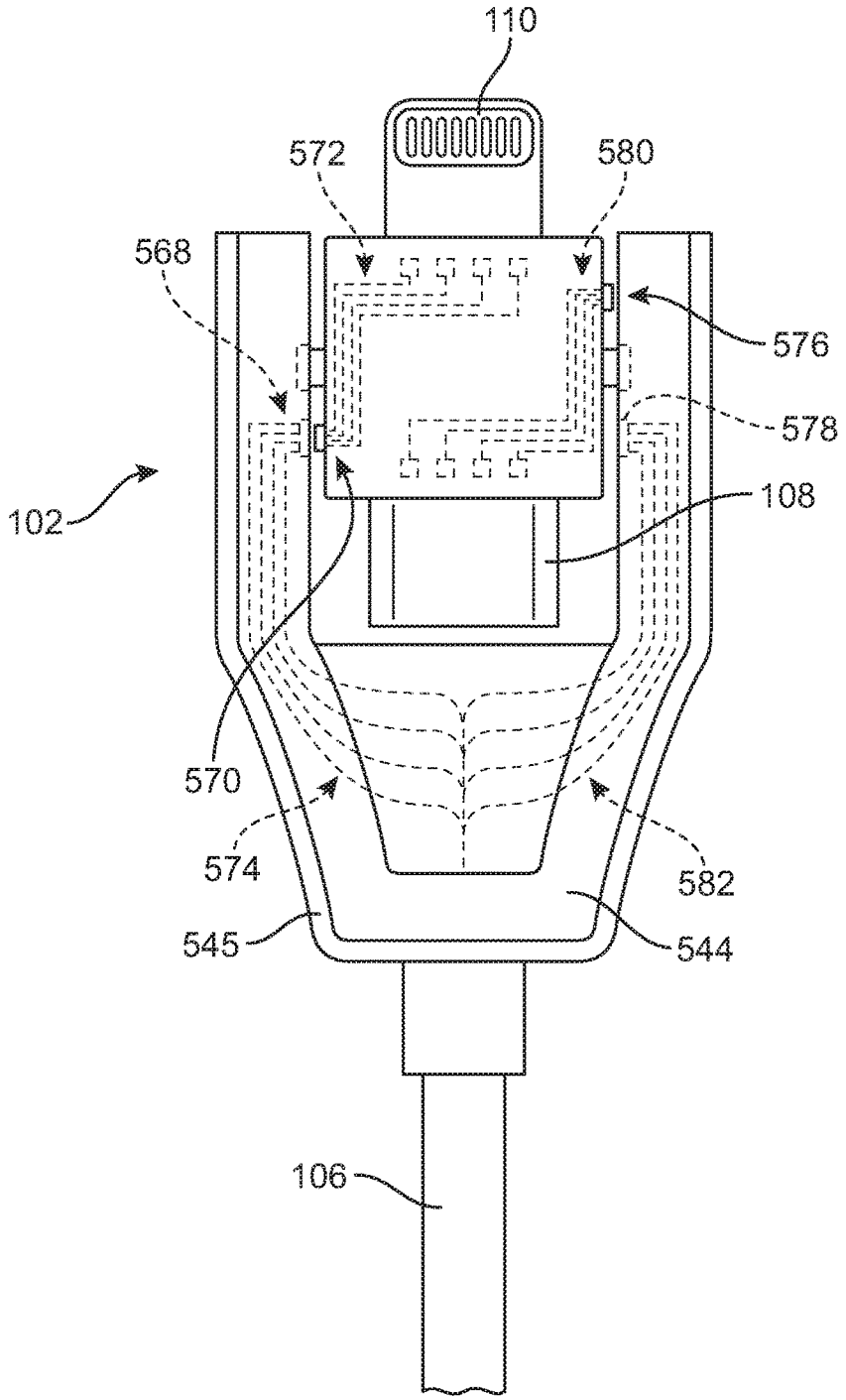
FIG. 15 is an enlarged top view of an embodiment of the first connector.

In some embodiments, an unused or stored plug may not be electrically connected. In some embodiments, the plug head contacts may be located along different areas of plug head 514 to prevent multiple plugs from being electrically connected at the same time. In other embodiments, body contacts may be located along different areas of body 502 to prevent multiple plugs from being charged at the same time. Referring to FIG. 15, first connector 102 is shown in a position such that second plug 110 is electrically connected to the other components of cable 100 and therefore able to accept an electrical charge. As shown, first plurality of plug head contacts 570 are aligned and contact first plurality of body contacts 568. Therefore, electricity may pass from first plurality of body electrical connections 574 to first plurality of body contacts 568 through first plurality of plug head electrical connections 572 and ultimately to second plug 110. Additionally, electrons may also pass in the opposite direction from second plug 110. In this configuration, however, first plug 108 may not be electrically connected and therefore may not be able to receive data or electrons. As shown, second plurality of head contacts 576 are not in alignment with second plurality of body contacts 578. Therefore, even if second plurality of body contacts 578 is electrically charged, the electrical charge does not pass on to second plurality of head contacts 576 and therefore does not pass through second plurality of plug head electrical connections 580 to first plug 108. Therefore, in this configuration, first plug 108 may not be electrically charged. By designing first connector 102 such that the unused or stored plug is not electrically charged, the likelihood of electrical shorts from first plug 108 may be reduced.

In some embodiments, plurality of body electrical connections may connect to one another within interior portion 544 of body 502. Referring to FIG. 15, first plurality of body electrical connections 574 may connect to second plurality of body electrical connections 582. Therefore, first plurality of body electrical connections 574 and second plurality of body electrical connections 582 may be electrically charged at the same time. Therefore, in some embodiments, both first plurality of body contacts 568 and second plurality of body contacts 578 may be electrically charged at the same time. Additionally, the electrical wires from cord 106 may connect to both first plurality of body electrical connections 574 and second plurality of body electrical connections 582.

Figure 16:
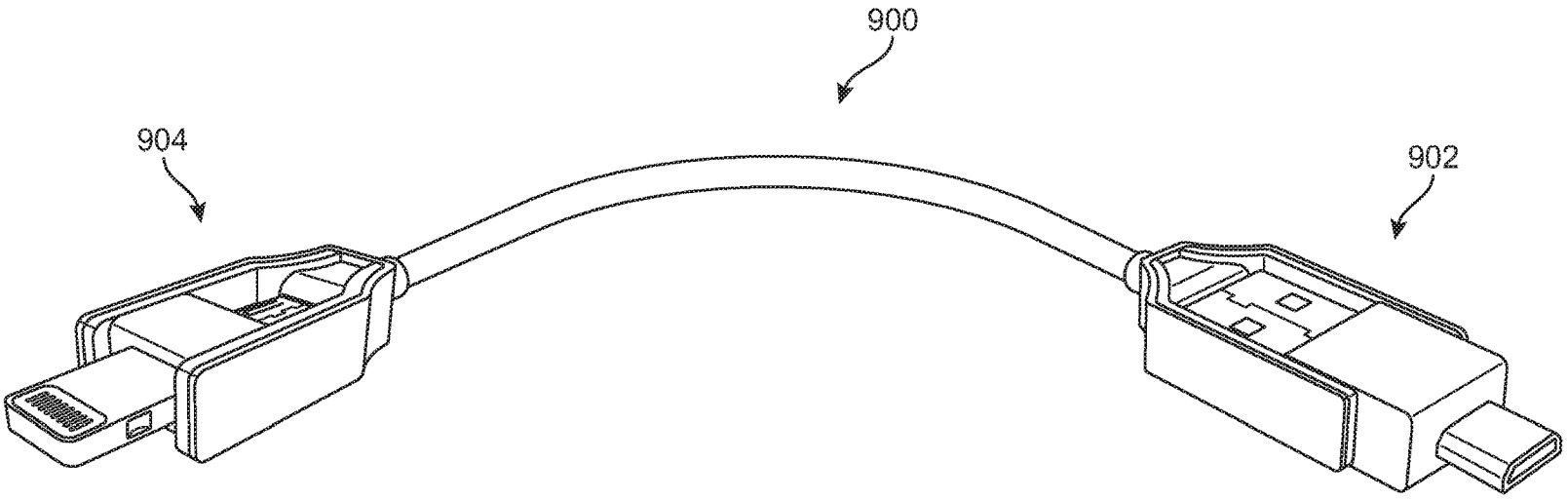
FIG. 16 is an alternate embodiment of a cable.

In another embodiment, a cable may include connectors with multiple plugs. As shown in FIG. 16, cable 900 includes first connector 902 and second connector 904. In contrast to second connector 104 of cable 100, second connector 904 includes multiple plugs. Therefore, in this embodiment, both first connector 902 and second connector 904 include multiple plugs rotatable within their respective body portions. Both first connector 902 and second connector 904 may include plug assemblies that rotate in a similar manner as plug assembly 550 described previously. Therefore, the quantity of combinations of different plug configurations may be larger in cable 900 as opposed to cable 100. By having an array of different connection options a greater quantity of different electrical devices may be connected using the same cable. This may reduce the number of cables that a user may need to carry around to connect electronic devices to each other.

Figure 17:
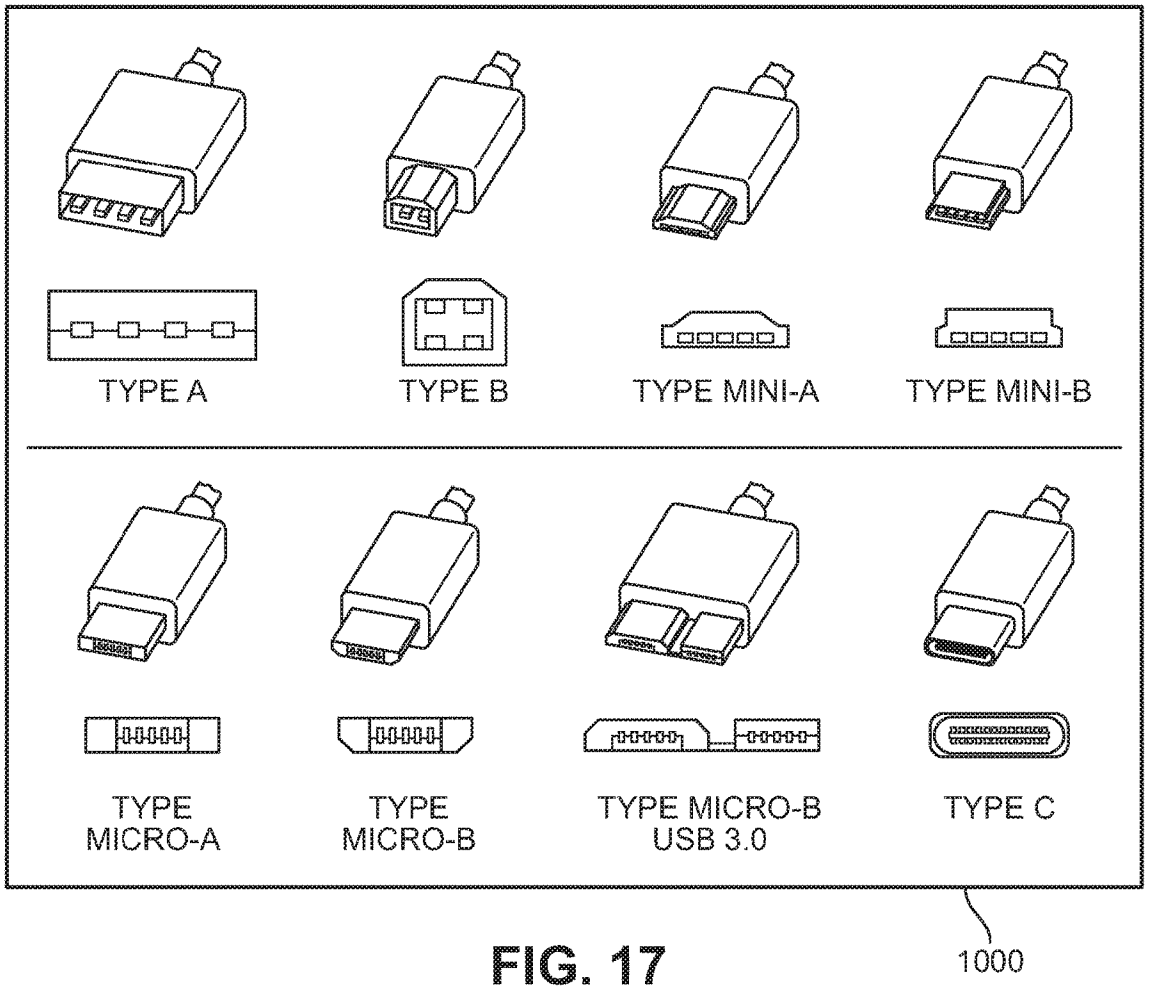
FIG. 17 is a chart depicting various plugs.

Referring now to FIGS. 17 and 18, chart 1000 and chart 1100 are depicted. For ease of reference, this chart may refer to the ends of the cable as the alpha a end and the beta β end. Each of the alpha and beta ends may have the body portion with a rotatable connector disposed therein. The rotatable mechanism mounted on the body portion on either the alpha or beta end of a cable will provide multiple permutations of combinations. Depending on the electronic devices that need to be connected together for power, data, and audio transfer purposes, almost an endless amount of combinations are possible for the connectors. Chart 1000 illustrates some of the types of plugs that are candidates for the cable of the present invention.

Any of the plugs depicted in chart 1000 could be on either of the rotatable ends of either the alpha or beta connector ends of the cable. The principles of the present invention allow for any of these plugs or more including, and not limited to, mini HDMI, Displayport, various Apple connectors such as the FireWire (IEEE 1394), the 30-pin docking plug, the Lightning® connector plug, and the Thunderbolt® connector plug to be included in a rotatable plug assembly. In some embodiments, these various plugs may be backward and forward compatible with the Micro-USB B-type and the USB C-type connectors. Since many users own devices made by Apple® that require these types of plugs, and also own devices made by other manufacturers that use more standardized USB connector plugs, the need for a multi-functional cable with different types of plugs for the connectors becomes evident. Additionally, many other plugs in addition to the plugs depicted in chart 1000 may be incorporated into various configurations of cables.

In some various embodiments, different plugs may be provided with the connectors. As shown in Chart 1100, various configurations are shown of a cable. The cable may include a first connector (the alpha end), and a second connector (the beta end). In some embodiments, each connector may include multiple plugs rotatable about the body portion. In other embodiments, one connector may include multiple plugs while the other connector may be configured with a single plug. Further, both female and male types of connectors may be used. As depicted in chart 1100, multiple types of plugs and configurations may be possible. Some plugs may correspond to audio data, while others correspond to visual data. Further, some plugs may correspond to data transferring or audio playback. As shown, multiple different combinations of plugs may be possible. By having various types of plugs on a single cable, the number of cables required to send or receive data, or charge multiple devices may be reduced. Chart 1100 is not meant to be limiting; it only lists some possible combinations as exemplary.

Figure 19:
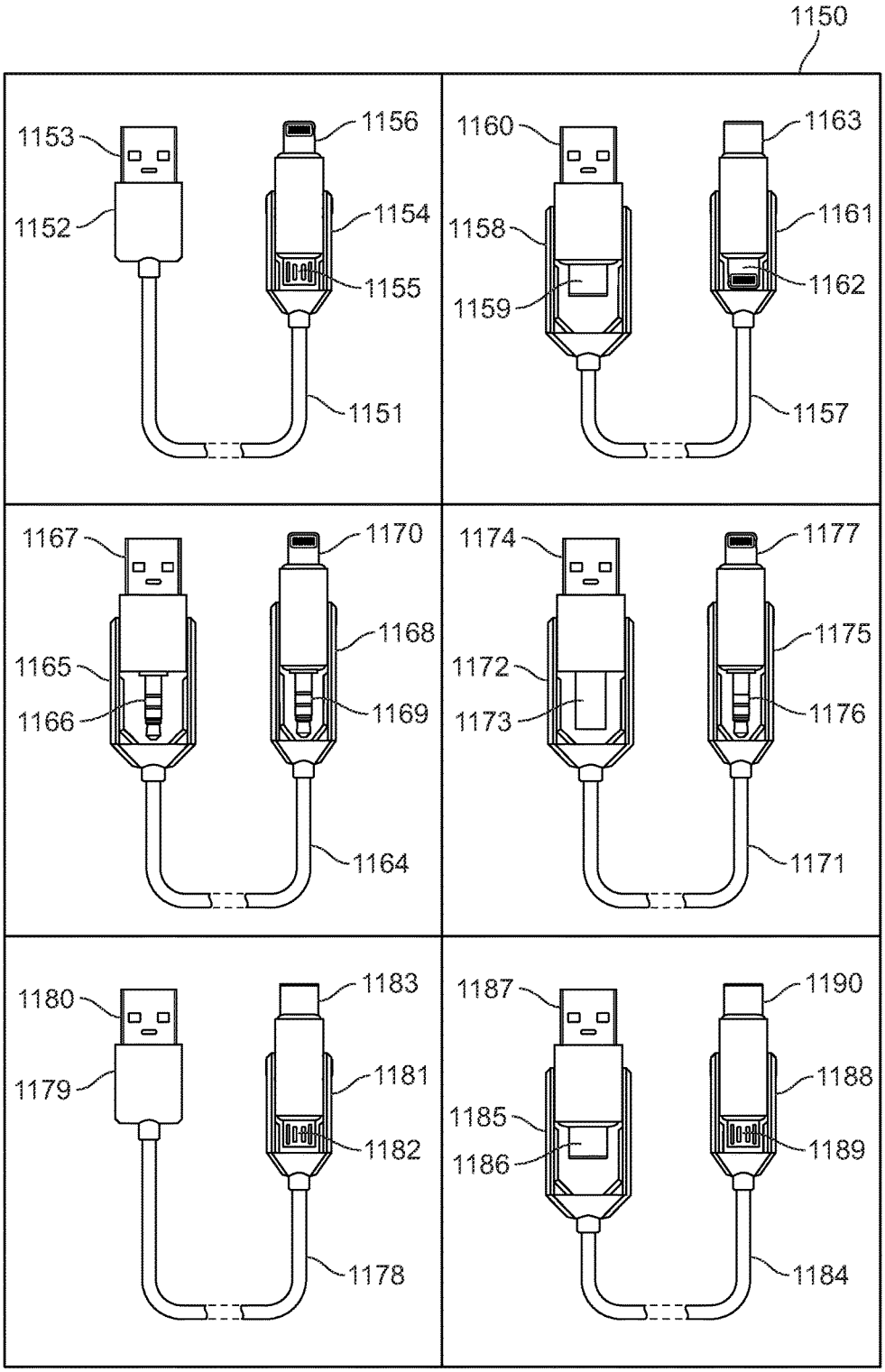
FIG. 19 is a chart depicting various embodiments of cables with various plug combinations.

Referring now to FIG. 19, a chart that depicts various combinations of connectors and plugs for various cables is shown. Chart 1150 depicts six cables with different combinations of plugs on each of the connectors. Chart 1150 is not meant to be limiting; however, chart 1150 depicts various cables that may be useful to users for various reasons. Cable 1151 includes first connector 1152 with first plug 1153. As shown, first plug 1153 may be a USB A-type plug. Cable 1151 may also include second connector 1154. Second connector 1154 may include second plug 1155 and third plug 1156. As shown, second plug 1155 may be a micro-USB type plug while third plug 1156 may be a Lightning® type plug, Cable 1151 may be used to transfer data or charge Apple® products or micro-USB products.

Cable 1157 includes first connector 1158 with first plug 1159 and second plug 1160. As shown, first plug 1159 may be a USB C-type plug and second plug 1160 may be a USB C-type plug. Cable 1157 may also include second connector 1161. Second connector 1161 may include third plug 1162 and fourth plug 1163. As shown, third plug 1162 may be a Lightning® type plug while fourth plug 1163 may be a USB C-type plug, Cable 1157 may be used to transfer data or charge Apple® products or USB-C type products. Additionally, the charging port may be a socket that accepts either USB A-type plugs or USB C-type plugs.

Cable 1164 includes first connector 1165 with first plug 1166 and second plug 1167. As shown, first plug 1166 may be an audio connector such as a 3.5 millimeter jack. Second plug 1167 may be a USB A-type plug. Cable 1164 may also include second connector 1168. Second connector 1168 may include third plug 1169 and fourth plug 1170. As shown, third plug 1169 may be an audio connector such as a 3.5 millimeter jack while fourth plug 1170 may be a Lightning® type plug. Cable 1164 may be used to transfer data or charge Apple® products, Additionally, cable 1164 may allow a user to utilize an analog audio cable to listen to music.

Cable 1171 includes first connector 1172 with first plug 1173 and second plug 1174. As shown, first plug 1173 may be a female audio connector such as a socket to receive a 3.5 millimeter jack. Second plug 1174 may be a USB A-type plug. Cable 1171 may also include second connector 1175. Second connector 1175 may include third plug 1176 and fourth plug 1177. As shown, third plug 1176 may be an audio connector such as a 3.5 millimeter jack while fourth plug 1177 may be a Lightning® type plug. Cable 1171 may be used to transfer data or charge Apple® products. Additionally, cable 1171 may allow a user to utilize an analog audio cable to listen to music. For example, a user may be able to plug headphones into second plug 1173 and insert fourth plug 1177 into a socket that accepts Lightning® type plugs.

Cable 1178 includes first connector 1179 with first plug 1180. As shown, first plug 1180 may be a USB A-type plug, Cable 1179 may also include second connector 1181. Second connector 1181 may include second plug 1182 and third plug 1183. As shown, second plug 1182 may be a micro-USB type plug while third plug 1183 may be a USB C-type plug, Cable 1178 may be used to transfer data or charge micro-USB products as well as USB C-type products.

Cable 1184 includes first connector 1185 with first plug 1186 and second plug 1187. As shown, first plug 1186 may be a USB C-type plug and second plug 1187 may be a USB A-type plug. Cable 1184 may also include second connector 1188. Second connector 1188 may include third plug 1189 and fourth plug 1190. As shown, third plug 1189 may be a micro-USB type plug while fourth plug 1190 may be a USB C-type plug. Cable 1184 may be used to transfer data between or charge products that utilize USB C-type plugs or USB A-type plugs.

Referring now to FIGS. 20-25, an alternate embodiment of a connector is depicted. As shown, in this embodiment connector 1200 includes plug assembly 1250. Plug assembly 1250 includes first plug 1208, second plug 1210, and plug head 1214. Plug assembly 1250 may be rotatable about axis 1201 in a similar manner as previously discussed with reference to first connector 102. For purposes of convenience and clarity, a single side of connector 1200 is discussed. It should be recognized that in some embodiments, similar configurations may be present on either side of connector 1200.

Figure 20:
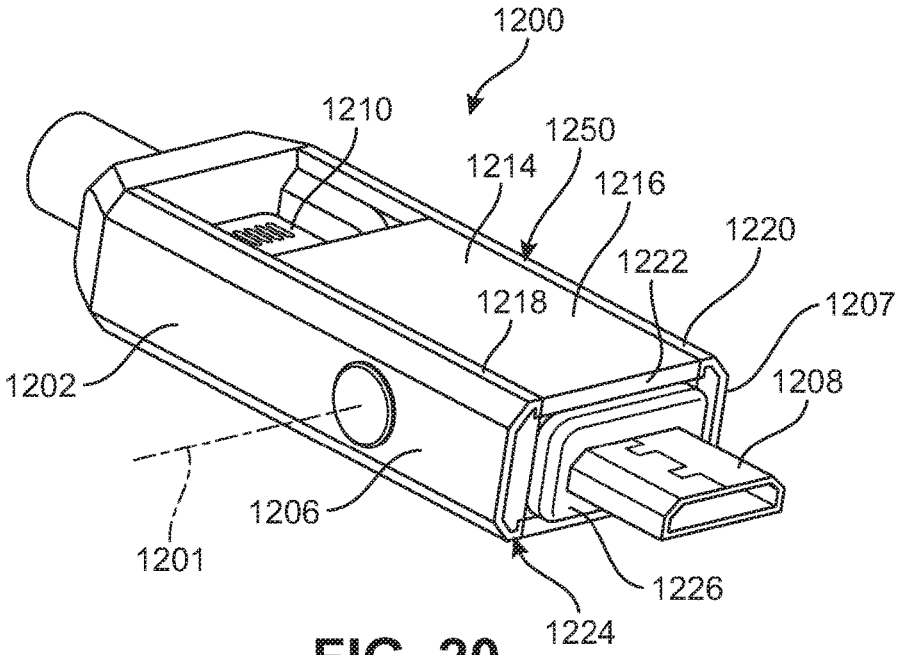
FIG. 20 is a schematic view of another alternate embodiment of a cable connector.
Figure 21:
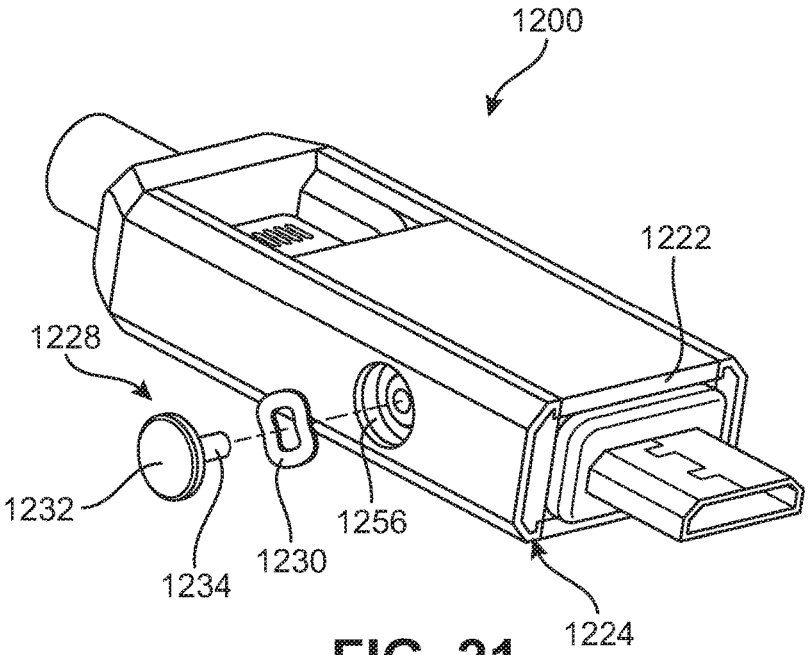
FIG. 21 is a schematic view of the connector in FIG. 20 shown partially disassembled.

In some embodiments, the plug assembly of connector 1200 may vary from previous embodiments. As show in FIGS. 20-22, first surface 1216 of plug head 1214 may align with various portions of body 1202. As shown, first surface 1216 may align with first upper surface 1218 of first prong 1206 and first surface 1216 may also align with second upper surface 1220 of second prong 1207 of body 1202 such that the surfaces are flush with each other. Additionally, portions of second surface 1222 may align with end surfaces 1224 of first prong 1206 and second prong 1207. As shown in FIGS. 20 and 21, in some embodiments, portions of plug assembly 1250 may extend beyond end surfaces 1224 of first prong 1206 and second prong 1207. As shown, elevated portion 1226 extends beyond end surfaces 1224. In some embodiments, a plug, such as first plug 1208 may be attached or abut elevated portion 1226. Elevated portion 1226 may be used to space a plug away from body 1202 to diminish obstructions when connecting the plugs of connector 1200 to various devices.

Referring now specifically to FIG. 21, particular portions of connector 1200 are shown in an exploded view. As shown, securement axle 1228 and spring 1230 are shown removed from body 1202 of connector 1200. In some embodiments, securement axle 1228 may include head 1232 that has a greater cross section than pin 1234. Additionally, in some embodiments, head 1232 may be substantially the same size as spring 1230. In other embodiments, head 1232 may be larger than spring 1230. By designing head 1232 to be larger than spring 1230, head 1232 may be able to compress spring 1230 toward other components of connector 1200. In some embodiments, the same or similar configuration may be present on the opposite side of body 1202.

In some embodiments, a connector may be configured with a detent mechanism. As shown in FIGS. 20-25, an alternate embodiment of a detent mechanism is depicted. As shown, the detent mechanism includes spring 1230 and securement axle 1228. Spring 1230 and securement axle 1228 may be situated through aperture 1256 within body 1202. Referring to FIG. 20, securement axle 1228 is shown assembled with other portions of connector 1200. In this configuration, head 1232 of securement axle 1228 compresses spring 1230 against portions of connector 1200. As shown in FIG. 21, spring 1230 is a wavy circular spring; however, other springs such as compression spiral springs, leaf springs, or torsion-type springs may be used. In some embodiments, securement axle 1228 may be secured to various portions of body 1202 of connector 1200 such that spring 1230 is restricted from exiting body 1202 through aperture 1256. In some embodiments, securement axle 1228 may be permanently secured to body 1202 while in other embodiments securement axle 1228 may include threaded portions on pin 1234 to enable removal from connector 1200.

Figure 22:
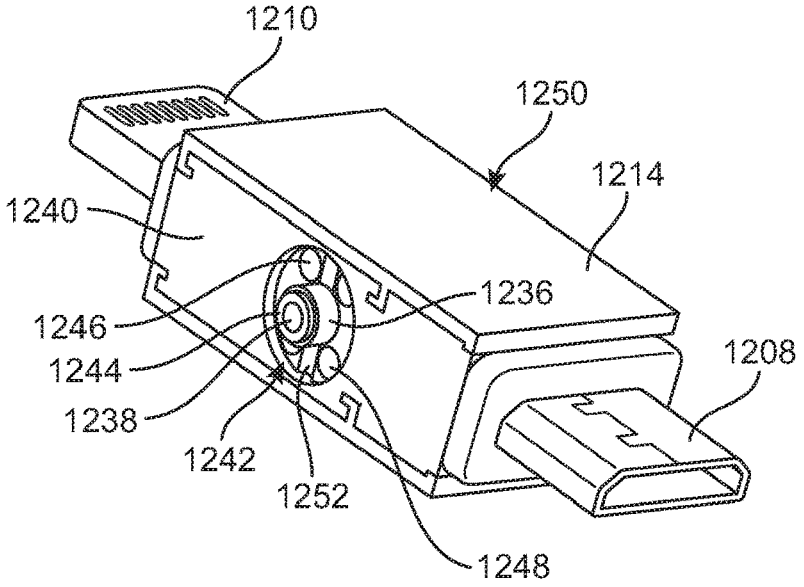
FIG. 22 is a schematic view of the connector of FIG. 20 with only the plug assembly in isolation.
Figure 23:
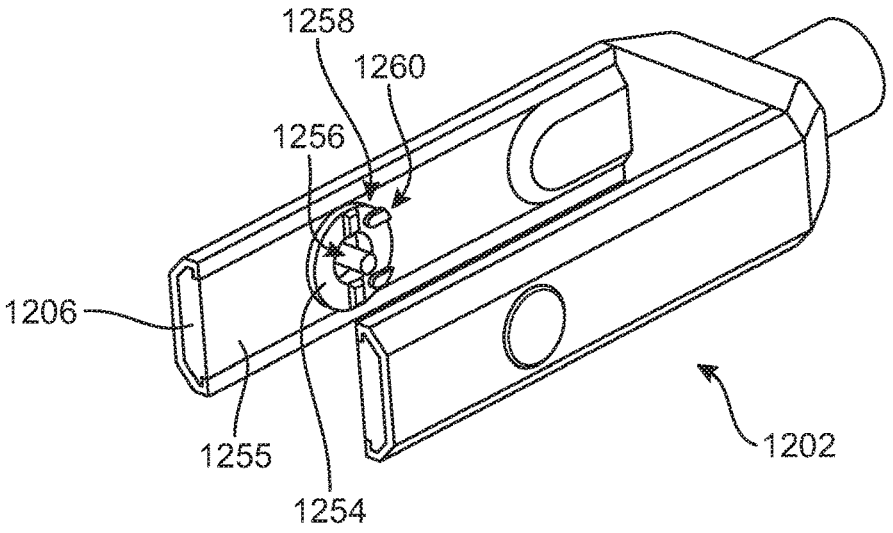
FIG. 23 is a schematic view of the connector of FIG. 20 with only the body portion in isolation.

Referring now to FIGS. 22 and 23, plug assembly 1250 and body 1202 are depicted in isolation from each other, Referring particularly to FIG. 21, an isometric view of plug assembly 1250 is depicted. Plug assembly 1250 includes first plug 1208, second plug 1210, and plug head 1214. Pin receiving portion 1236 is located on side surface 1240 of plug head 1214. Pin receiving portion 1236 also includes receiving aperture 1238. In some embodiments, outer surface 1244 of pin receiving portion 1236 may extend beyond side surface 1240. In other embodiments, outer surface 1244 of pin receiving portion 1236 may be substantially parallel or aligned with side surface 1240. In still further embodiments, outer surface 1244 of pin receiving portion 1236 may be recessed from side surface 1240.

In some embodiments, side surface 1240 may include a recessed portion. In some embodiments, recessed portion 1242 may include electrical contacts that are electrically connected to first plug 1208 and second plug 1210. As shown, recessed portion 1242 includes first set of contacts 1246 that are electrically connected to first plug 1208 as well as second set of contacts 1248 that are electrically connected to second plug 1210. The number and particular location of the contacts may be varied. For example, as discussed previously with regard to another embodiment, the contacts may be located on opposite sides of plug head 1214. Further, in some embodiments, contacts on either side of plug head 1214 may be electrically connected to portions of body 1202 at the same time, That is, in some embodiments, contacts that are associated with first plug 1208 may be located on either side of plug head 1214 and these contacts may be electrically connected with corresponding receiving contacts on either prong of connector 1200 at particular orientations.

In some embodiments, recessed portion 1242 may include further depressions or recessed portions. As shown in FIG. 22, set of depressions 1252 may be located opposite from one another and abutting pin receiving portion 1236. Set of depressions 1252 may correspond to protrusions or extensions that are located on body 1202. Set of depressions 1252 may be oriented to position plug assembly 1250 in particular locations such that the contacts may be electrically connected to portions of connector 1200 when a particular plug is in a ready state for use.

Referring now to FIG. 23, body 1202 is shown in an isometric view. As shown, body 1202 includes elevated portion 1254 that extends inward from interior side surface 1255 of body 1202. Elevated portion 1254 may surround aperture 1256 that extends through body 1202, Further, elevated portion 1254 includes set of protrusions 1258 that extend further inward beyond elevated portion 1254. In some embodiments, set of protrusions 1258 may be similarly shaped and sized such that set of protrusions 1258 are configured to accept set of depressions 1252 from plug assembly 1250. That is, in some embodiments, set of protrusions 1258 may have a positive or extending shape. Set of depressions 1252 may have a negative or receding shape. In some embodiments, the negative shape of set of depressions 1252 may be similar in shape to the positive shape of set of protrusions 1258. Further, set of receiving contacts 1260 may be position through elevated portion 1254. Set of receiving contacts 1260 may be configured to contact either first set of contacts 1246 or second set of contacts 1248. That is, when plug assembly 1250 is rotated about axis 1201, different contacts from plug assembly 1250 may contact set of receiving contacts 1260 of body 1202. These contacts of plug assembly 1250 may be electrically connected to either first plug 1208 or second plug 1210.

When assembled, the various components of connector 1200 may interact with each other such that plug assembly 1250 may be rotated and partially secured at various locations. When assembled, pin 1234 may pass through spring 1230 and aperture 1256 of body 1202. Pin 1234 then may extend into receiving aperture 1238 of pin receiving portion 1236. In this configuration, pin 1234 may allow plug assembly 1250 to rotate about axis 1201. In some embodiments, spring 1230 may be pressed against outer surface 1244 of pin receiving portion 1236 of plug assembly 1250. This compressive force may secure plug assembly 1250 within body 1202 such that plug assembly 1250 is partially restricted from rotating. Additionally, spring 1230 may provide a compressive force such that set of protrusions 1258 set or click into set of depressions 1252 in plug head 1214. This compressive force may secure plug assembly 1250 in place when rotated into a ready position. Additionally, in some embodiments, a second spring may be located on the opposite side of body 1202. Therefore, compressive forces may be pressing against plug assembly 1250 from both sides of connector 1200. By having multiple springs, additional support may be provided to plug assembly 1250.

Figure 24:
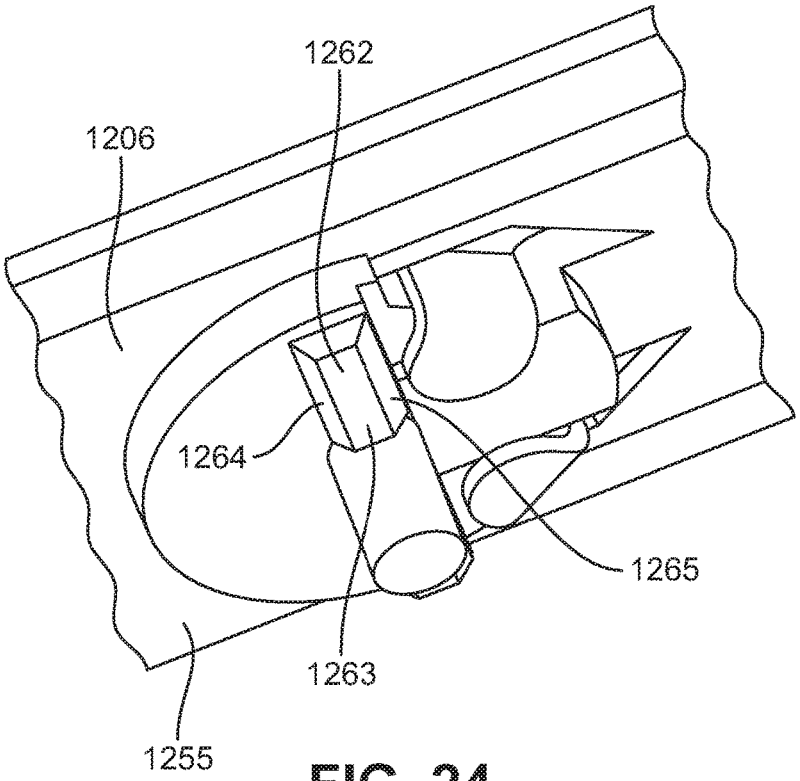
FIG. 24 is an enlarged schematic view of a portion of a detent mechanism.

Additionally, in some embodiments, the detent mechanism may be particularly shaped to secure the connector in the ready-for-use position. As shown in FIG. 24 and particularly in FIGS. 25 and 26, the shape of the protrusions of the detent mechanism may be seen in greater detail. In some embodiments, protrusions from set of protrusions 1258 may have a generally polygonal cross-sectional shape. In some embodiments, a triangular cross-sectional shape may be utilized. In other embodiments; a trapezoidal shape may be utilized. In still further embodiments, other cross-sectional shapes may be utilized.

Figure 25:
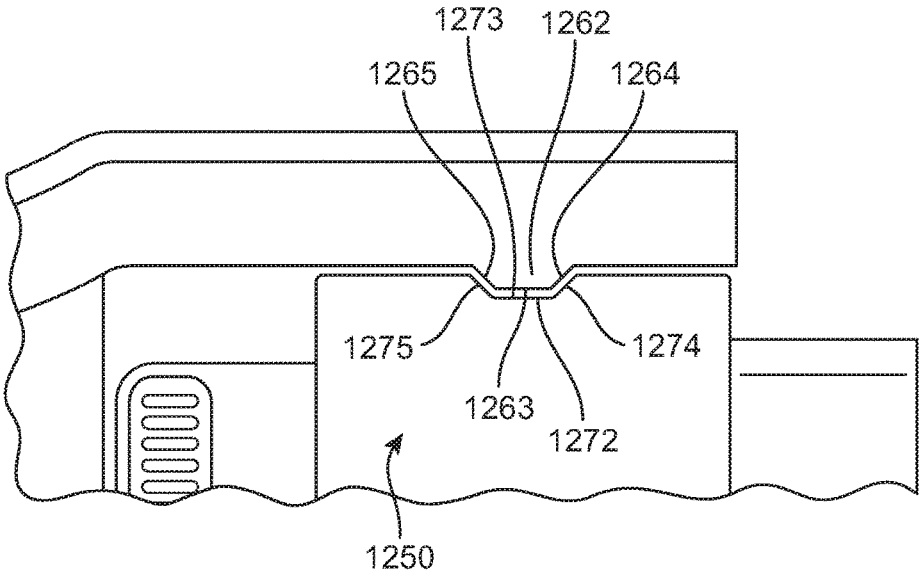
FIG. 25 is a schematic top view of a portion of the detent mechanism of the connector.
Figure 26:
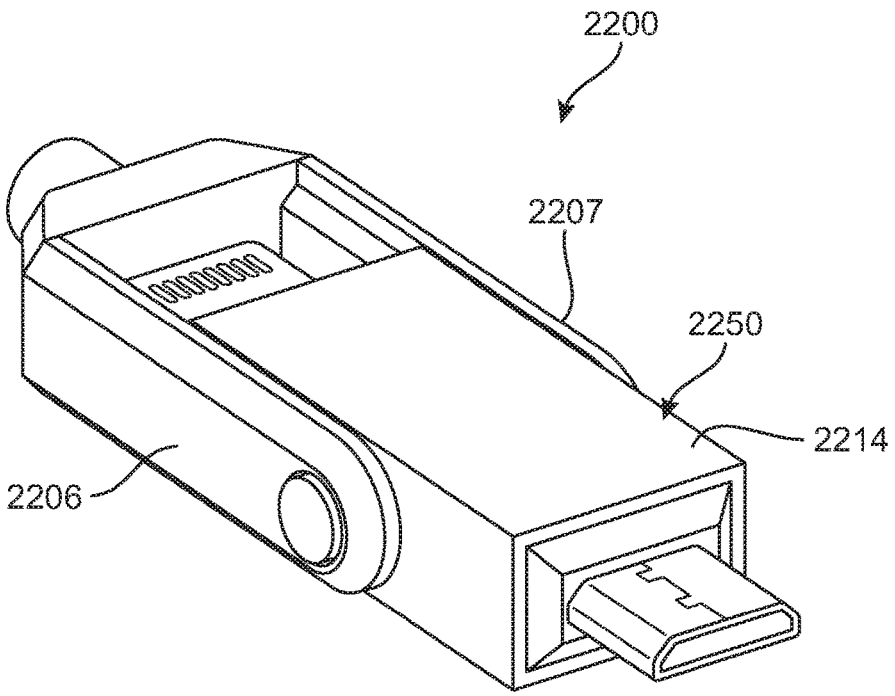
FIG. 26 is schematic view of another embodiment of a connector.

As shown in FIGS. 25 and 26, protrusion 1262 of first prong 1206 may have a trapezoidal shape. As shown; protrusion 1262 includes first surface 1263, second surface 1264, and third surface 1265, As shown, first surface 1263 may be substantially parallel to interior side surface 1255. Additionally, as shown second surface 1264 may be at an angle with respect to interior side surface 1255. In some embodiments, third surface 1265 may also be at an angle with respect to interior side surface 1255. In some embodiments, the angle at which third surface 1265 is located with respect to interior side surface 1255 may be substantially similar to the angle at which second surface 1264 is located with respect to interior side surface 1255. In other embodiments, the angle at which the surfaces are oriented may be different.

In some embodiments, the surfaces of protrusions of the detent mechanism may be linear. As shown in FIGS. 24 and 25, the surfaces of protrusion 1262 are substantially linear. In other embodiments, the surfaces may be continuously slope or tapered. In still further embodiments, the surfaces may be irregularly shaped or sloped. In the embodiments shown in FIGS. 22-24, the linear surfaces may assist in providing a substantial click or snap into place of plug assembly 1250. By having defined angles in both depression 1272 and protrusion 1262, a user may be able to easily deduce when plug assembly 1250 has snapped into place because the click or snap may be easily and clearly defined when plug assembly 1250 is in place.

Referring now to FIG. 25, the interaction between protrusion 1262 and depression 1272 is depicted. In some embodiments, the depressions of set of depressions 1252 may correspond in shape and size to the protrusions of set of protrusions 1258, As shown in FIG. 25, depression 1272 is shaped to accept protrusion 1262. As shown, first surface 1273 of depression 1272 may correspond to first surface 1263 of protrusion 1262. Additionally, second surface 1274 of depression 1272 may correspond to second surface 1264 of protrusion 1262. Further, third surface 1275 of depression 1272 may correspond to third surface 1275 of protrusion 1262. As shown, therefore, each of the surfaces of protrusion 1262 matches with a corresponding surface of depression 1272. When plug assembly 1250 is rotated, the various surfaces of the protrusions and depressions may align to secure plug assembly 1250 in place.

The use of the trapezoidal-shaped depressions and protrusions may assist in providing securement of plug assembly 1250 in place. By using flat surfaces with edges, the magnitude of force necessary to rotate plug assembly 1250 into and out of the secured position may be increased in relation to other embodiments. By changing the angle of the protrusion and the depression, the magnitude of force necessary may be tuned to a particular lever. By changing the angle of second surface 1264 and third surface 1265 in conjunction with the corresponding depression surfaces, the force required may be increased or decreased. A protrusion with a steeper second surface 1264 and third surface 1265 may require a greater magnitude of force to move plug assembly 1250 into and out of a secured position than a protrusion with more gradually sloped surfaces. For example, an embodiment that includes second surface 1264 and third surface 1265 oriented at a 60-degree angle with respect to interior side surface 1255 may require a greater magnitude of force to rotate plug assembly 1250 than an embodiment that includes second surface 1264 and third surface 1265 oriented at a 15-degree angle. Therefore, the magnitude of force required to rotate plug assembly 1250 out of a secured position may be altered or tuned by changing the angle of the surfaces of the protrusions and depressions.

Referring now to FIG. 26, and alternate embodiment of a connector is depicted. As shown connector 2200 includes plug assembly 2250 that is secured between first prong 2206 and second prong 2207. As shown in this embodiment, first prong 2206 and second prong 2207 may not extend the full length of plug head 2214 of plug assembly 2250. In this embodiment, the axis around which plug assembly 2250 rotates may be adjacent to the end of first prong 2206 and second prong 2207. By reducing the length of first prong 2206 and second prong 2207, the quantity of material used to form connector 2200 may be reduced when compared to other embodiments. Additionally, by reducing the length of first prong 2206 and second prong 2207, the chance of first prong 2206 and second prong 2207 catching on an external object may be reduced.

Figure 27:
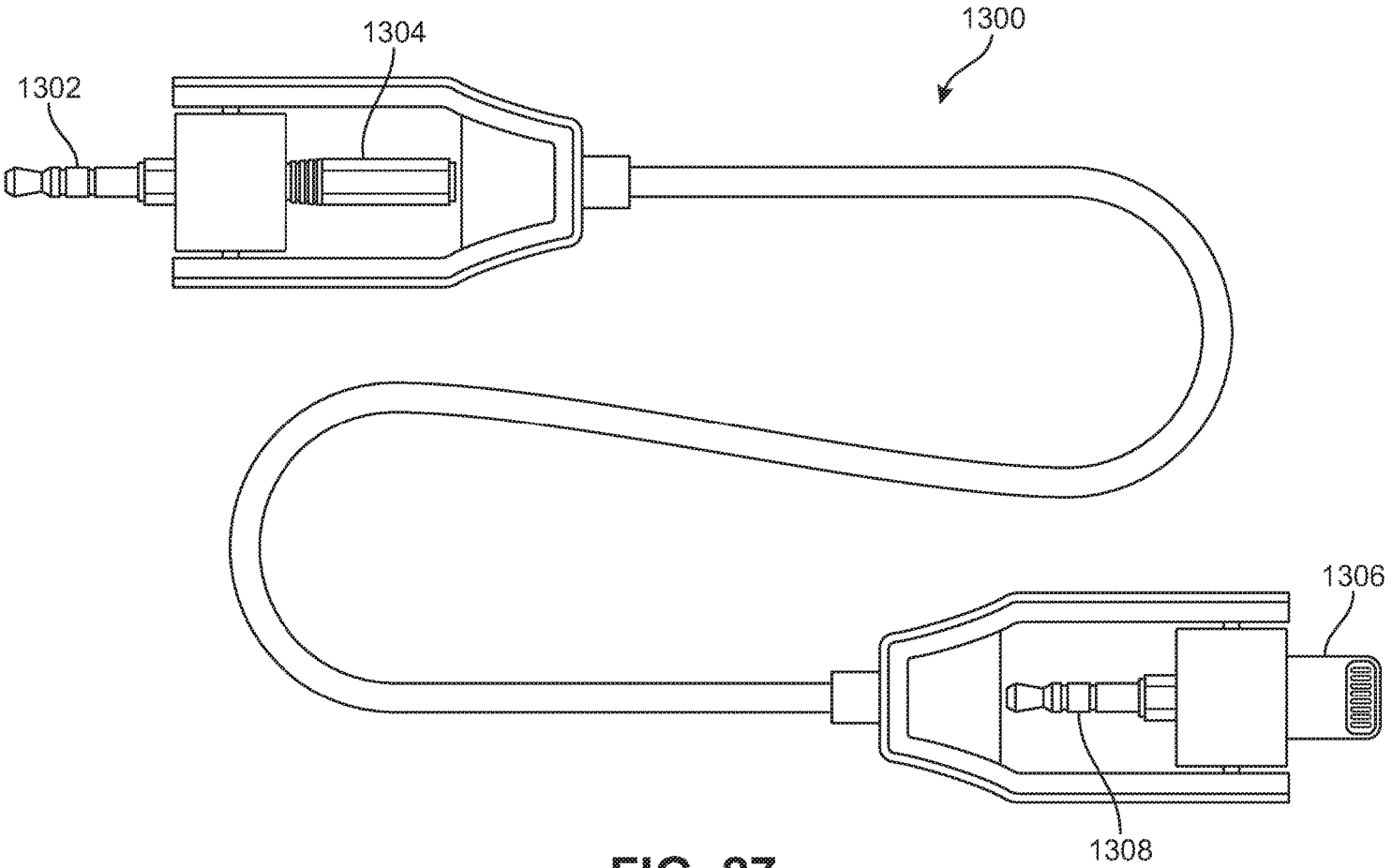
FIG. 27 is a schematic view of an alternate embodiment of a cable with various connectors.

A particular issue faced by device users is resolved with a cable having the connectors and plugs depicted in FIG. 27. This particular configuration is directed at the problem of making newly produced devices backwards compatible with a user's audio equipment such as headphones, earbuds, or external loudspeakers. In the embodiment of FIG. 27, a first end of cable 1300 has a 3.5 millimeter audio connector, rotatable between male plug 1302 and female socket 1304. The second end has a connector with Lightning® plug 1306 rotatable with a 3.5 millimeter audio male plug 1308. This particular cable embodiment enables the user of a newly issued smartphone or other device having the Lightning® jack for audio to use his or her existing headphones or external loudspeakers that use a standard 3.5 millimeter audio plug. Lightning® plug 1306 may be inserted into a corresponding socket and male plug 1302 of the alpha end may be inserted into a corresponding device such as an external speaker set. Additionally, female socket 1304 may be deployed rather than male plug 1302. With female socket 1304 rotated to a ready position, the 3.5 millimeter end of an existing set of headphones may be inserted into female socket 1304. Additionally, if the connectors are rotated so that female socket 1304 is deployed at the first end, male plug 1308 could be deployed on the second end to convert this cable to a standard audio auxiliary cable for connecting a device with a 3.5 millimeter audio jack to an auxiliary port, for example. Based on the principles described and illustrated herein, the body portion for each of these connector ends will include the necessary electrical configuration for enabling the rotation of the plugs and electrical connectivity. That is, the body portions cable 1300 may be built in accordance with the body portion depicted in FIGS. 6-9 and 12-15, or FIGS. 20-26.

Due to the multitude of permutations possible, and the varying individual needs of users, it would be within the scope of the present invention to enable customized ordering of the cable. It is possible that a user may have a need for a particular combination of connector plugs for a permanent installation of audio/visual or communications components. In those situations, it would be helpful for a user to be able to order the exact configuration of connector plugs. The possibilities afforded by the body portion design enable the alpha and beta ends of the cable to contain any combination of connector plugs.

Figure 28:
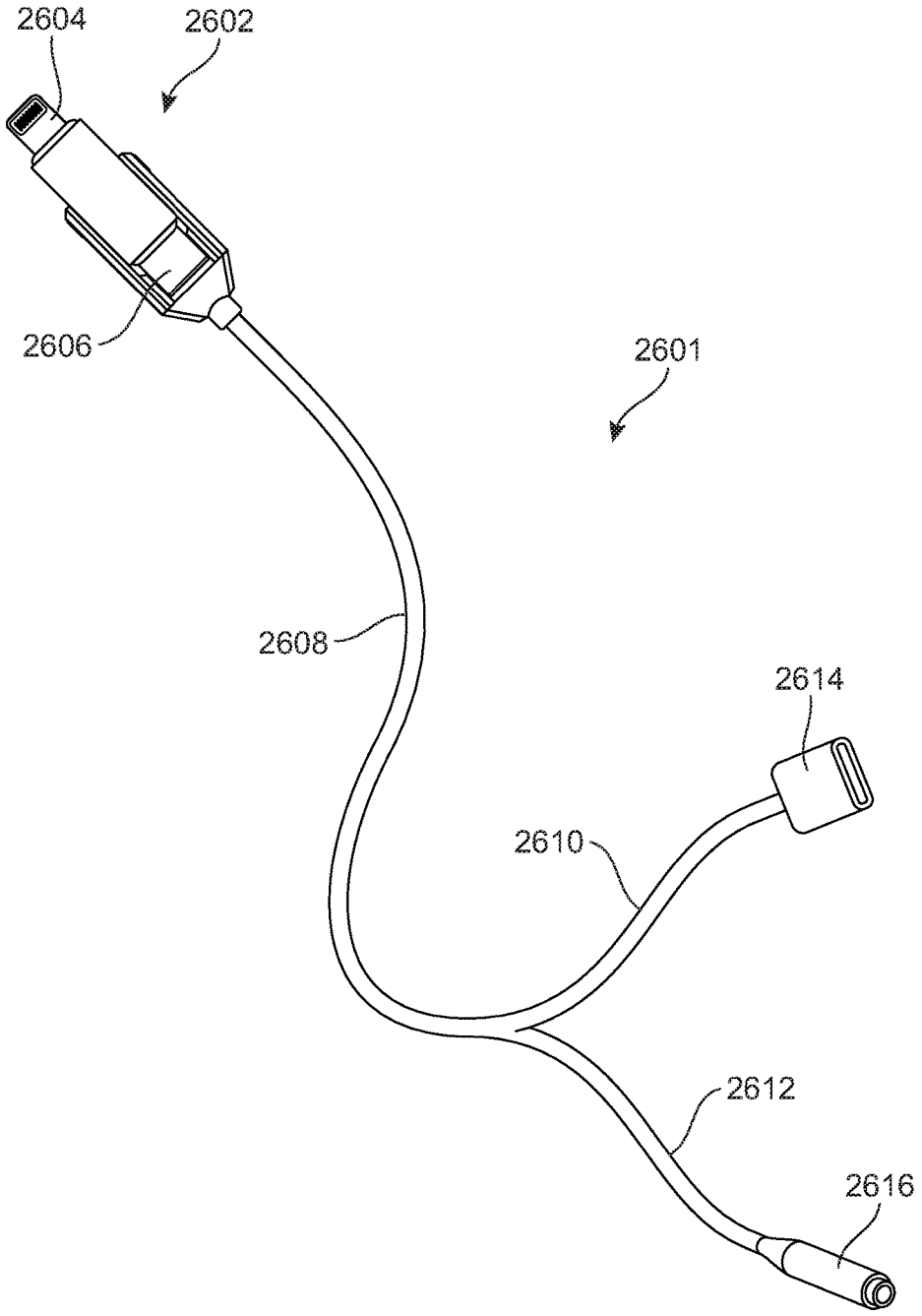
FIG. 28 is a schematic view of another alternate embodiment of a cable with various connectors.

Referring now to FIG. 28, an alternate embodiment of a cable is depicted. In some embodiments, a device to which a cable is configured to connect to may have a single port or opening into which the cable may be inserted. Users, however, may wish to conduct multiple operations or tasks at the same time. For example, a user may wish to listen to music while also charging his or her device. Cable 2601 is configured to allow a user to conduct multiple tasks at the same time. As shown, connector 2602 includes first plug 2604 and second plug 2606. As depicted first plug 2604 may be a Lightning® type plug while second plug 2606 may be a USB type A plug. As described previously, the connectors may have various types of plugs, and the plugs described are for illustrative purposes.

In some embodiments, cord 2608 may include a split such that various plugs may be utilized at the same time. As shown, cord 2608 splits such that cord 2608 includes first portion 2610 and second portion 2612. As shown, second connector 2614 may be attached to first portion 2610 of cord 2608. Additionally, third connector 2616 may be connected to second portion 2612 of cord 2608. As depicted, second connector 2614 includes a Lighting® type female socket whereas third connector 2616 is a 3.5 millimeter female audio connector. Depending on the type of use desired for a particular cable, the types of plugs on each of the connectors may be changed during manufacturing to optimize the use of the cable.

In the configuration as shown in FIG. 28, cable 2601 may be utilized to charge a device as well as to listen to music through the device. For example, first plug 2604 may be inserted into a female Lightning® socket, for example, into an iPhone® or other Apple® product. A Lightning® plug may be inserted into the female socket of second connector 2614 to charge the device. Further, a jack for a headphone or other audio device may be inserted into the socket of third connector 2616. In this configuration, therefore, a user may be able to charge his or her electronic device while also enjoying music.

Figure 29:
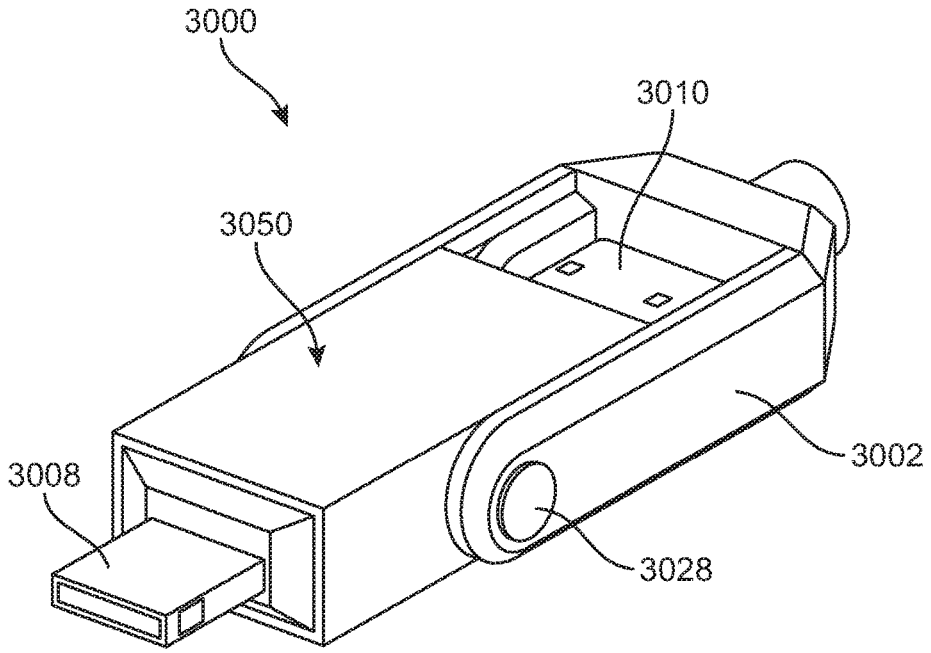
FIG. 29 is a schematic view of another alternate embodiment of a connector.

Referring now to FIGS. 29-37, an alternate embodiment of a connector is depicted. Referring specifically to FIG. 29, connector 3000 includes plug assembly 3050 and body 3002. Plug assembly 3050 includes first plug 3008 and second plug 3010. The plugs may be various types as discussed previously with regard to previous embodiments. Connector 3000 may be configured to permit first plug 3008 and second plug 3010 to rotate about securement axle 3028 to allow for each plug to be used in connection with an electronic device. In a similar manner to previous embodiments, in the stored position a plug may not be electrically connected to the rest of the cable. For example, second plug 3010 as shown in FIG. 29 is in a stored position and therefore is not electrically connected to body 3002 or the rest of the cable (not shown) to which connector 3000 is attached.

Figure 30:
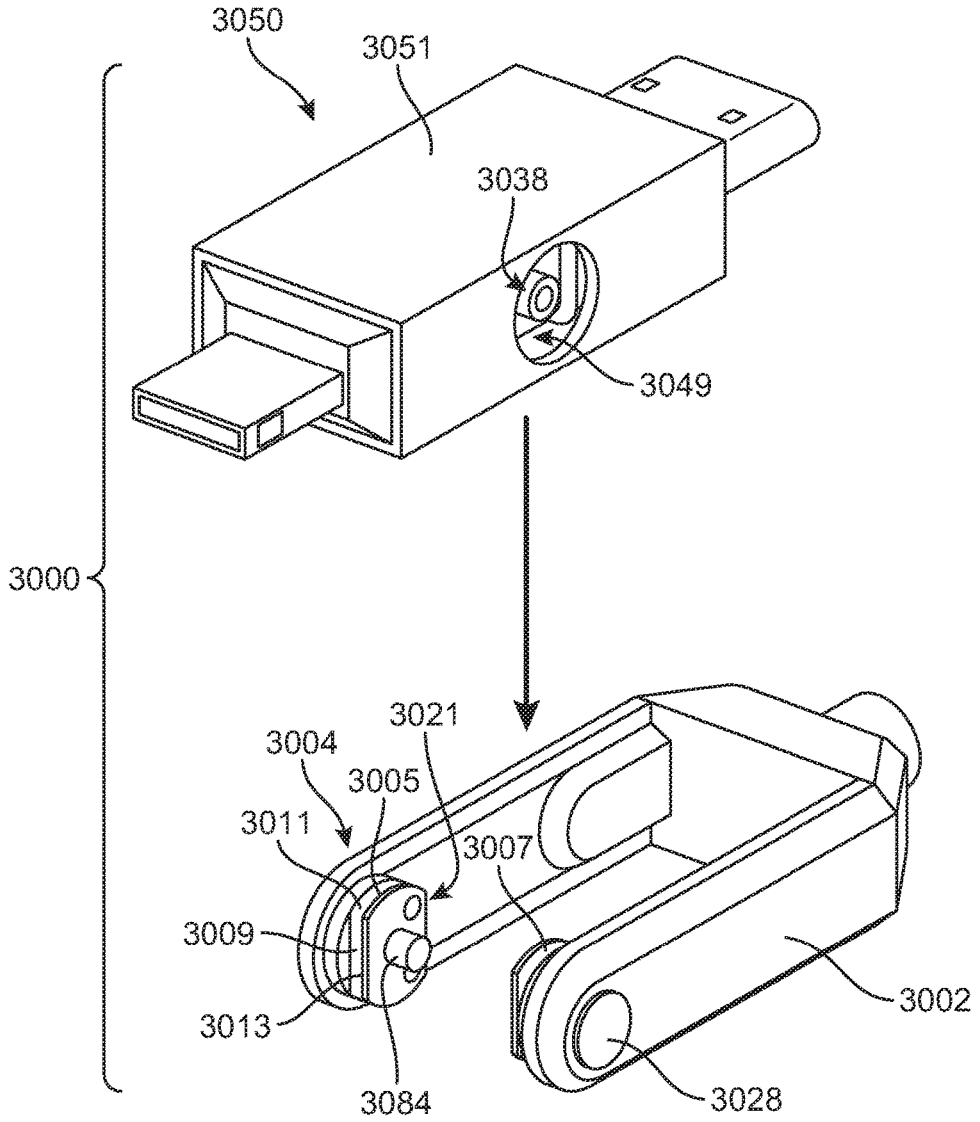
FIG. 30 is an exploded schematic view of an embodiment of a connector.

Referring now to FIG. 30, connector 3000 is shown in a partially exploded view. As shown, plug assembly 3050 is separated from body 3002. Plug assembly includes cover 3051 that may cover or protect components within plug assembly 3050. In some embodiments, cover 3051 may include opening 3049 that may align with components of body 3002. Additionally, cover 3051 may also align with receiving aperture 3038 located within plug assembly 3050. In some embodiments, receiving aperture 3038 may align with pin 3084 of securement axle 3028. As with previous embodiments, pin 3084 may assist in securing plug assembly 3050 to body 3002 such that plug assembly 3050 does not fall away from or out of body 3002. Additionally, in some embodiments, opening 3049 may be sized such that a detent may pass through opening 3049.

In some embodiments, body 3002 may be equipped with plurality of detents 3004. Plurality of detents 3004 may be located on one or both of the prongs of body 3002. As shown in FIG. 30, body 3002 includes first detent 3005 and second detent 3007. In some embodiments, plurality of detents 3004 may extend inwards from the prongs of body 3002. Additionally, in some embodiments, the detents of plurality of detents 3004 may have the same or similar geometry. Further, in some embodiments, plurality of detents 3004 may include through holes that allow pins from securement axles to pass through the detents.

In some embodiments, the detents may be particularly shaped to interact with a spring or other mechanism to assist in rotating and securing plug assembly 3050. Referring specifically to first detent 3005, a groove may extend around a side surface of first detent 3005. As shown, groove 3009 extends around first detent 3005 along a plane that is perpendicular to the through hole through which pin 3084 extends. This groove may provide a nesting area for a spring which will be discussed in detail below.

In some embodiments, the detents may be shaped to lock plug assembly 3050 in place during use. As shown, first detent 3005 includes a curved upper side surface 3011. As shown, upper side surface 3011 includes a groove as discussed above and additionally is curved along a circular path that mimics or is similar to the curvature of opening 3049 of cover 3051. That is, the curvature of upper side surface 3011 is along a different plane that a curvature from groove 3009. This curved surface may assist in pushing or urging plug assembly 3050 to rotate into position when plug assembly 3050 is combined with body 3002. Additionally, in some embodiments a lower side surface may also be curved. The lower side surface may face in the opposite direction than that of upper side surface 3011. For example, upper side surface 3011 is curved toward an upper surface of body 3002 whereas lower side surface is curved away from the upper surface of body 3002. In other words, the lower side surface of first detent 3005 is curved toward the lower surface of body 3002. Additionally, first detent 3005 includes substantially planar central side surfaces. For example, first central side surface 3013 is substantially planar. Although not visible, first central side surface 3013 may be parallel to a second central side surface. As discussed in further detail below, plug assembly 3050 may be in a stable or secured position when springs are located along first central side surface 3013 and the second central side surface.

In some embodiments, portions of body 3002 may include contacts for completing electrical systems or circuits. As shown, first detent 3005 includes set of contacts 3021. In some embodiments, second detent 3007 may also include a set of contacts arranged in a similar manner. Set of contacts 3021 may be formed of a metal or other conductive material. Set of contacts 3021 may be electrically connected to the rest of a cable that includes connector 3000. Set of contacts 3021 may therefore function similarly to that of first plurality of body contacts 568 as discussed with reference to a previous embodiment.

Figure 31:
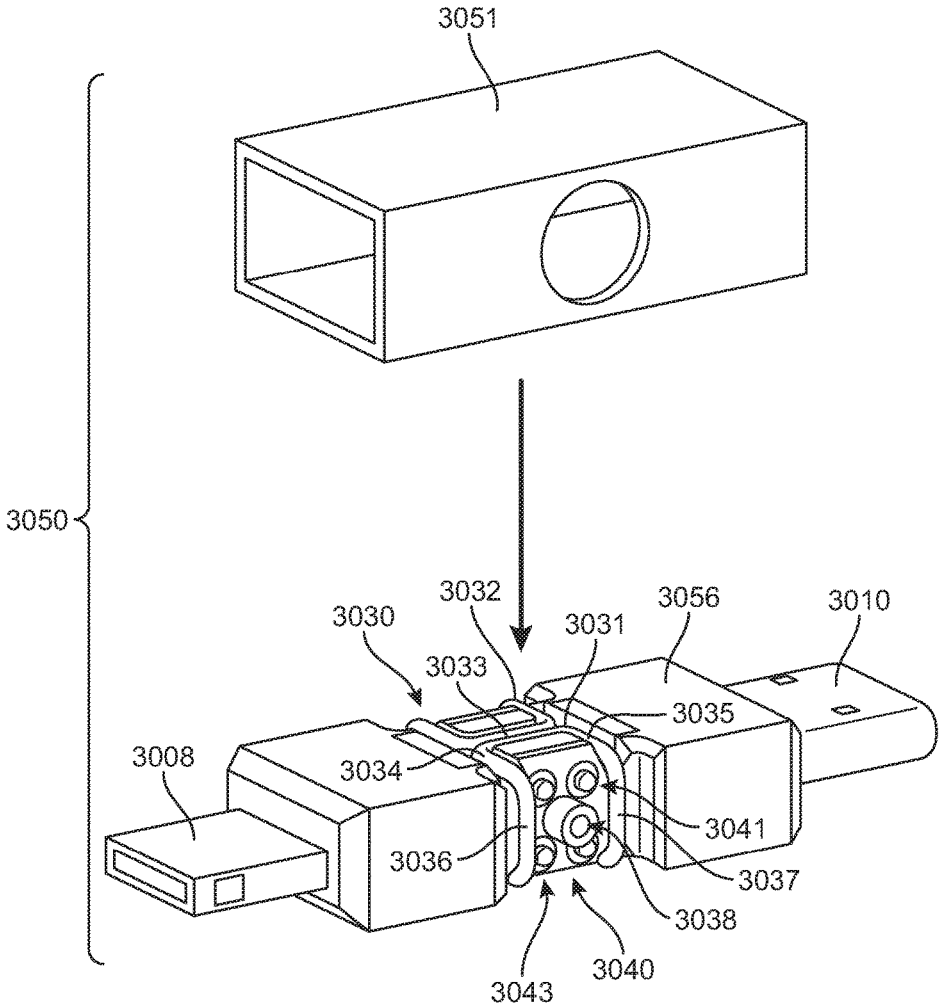
FIG. 31 is an exploded schematic view of an embodiment of a plug assembly.

Referring now to FIG. 31, plug assembly 3050 is depicted in a partially exploded view. As shown, cover 3051 has been removed from the rest of plug assembly 3050 for ease of viewing and description. As shown, the internal aspects of plug assembly 3050 are depicted. In some embodiments, plug assembly 3050 may include mechanisms for connecting the plugs of plug assembly to body 3002 and by extension the rest of the cable to which connector 3000 is attached. In some embodiments, stationary contacts may be utilized on plug assembly 3050. In other embodiments, movable contacts may be utilized. As shown in FIG. 31, plurality of pogo pins 3040 may be utilized to provide an electrical connection between the plugs of plug assembly 3050 and body 3002. In some embodiments, plurality of pogo pins 3040 may interact with printed circuit boards, whereas in other embodiments, the contacts from plurality of pogo pins 3040 may be directly connected to each of the plugs of plug assembly 3050. Plurality of pogo pins 3040 may be biased to be in an extended position. When in the extended position, plurality of pogo pins 3040 may not provide an electrical connection to the plugs of plug assembly 3050. When compressed, plurality of pogo pins 3040 may be configured to provide an electrical connection from one side of the pogo pins to the other side of the pogo pins.

In some embodiments, plurality of pogo pins 3040 may be arranged to connect to particular plugs. For example, plurality of pogo pins 3040 may be separated into first set of pogo pins 3041 and second set of pogo pins 3043. First set of pogo pins 3041 may be electrically connected to first plug 3008 when first set of pogo pins 3041 are depressed. Similarly, second set of pogo pins 3043 may be electrically connected to second plug 3010 when second set of pogo pins are depressed. Using pogo pins may allow for multiple cycles between connection and disconnection of the plugs in a consistent and dependable manner. Additionally, by utilizing pogo pins the amount of scraping done by the pins during rotation of plug assembly 3050 may be reduced when compared to other embodiments. Because the pogo pins are movable when depressed, and in some embodiments rounded, the amount of friction provided by the pogo pins to various portions of plurality of detents 3004 may be reduced when compared to embodiments that do not include pogo pins connection mechanisms.

In some embodiments, plug assembly 3050 may include provisions for providing a connection mechanism between plug assembly 3050 and body 3002. In some embodiments, a portion of plug assembly 3050 may interact with plurality of detents 3004. As shown, plug assembly 3050 may include set of springs 3030. Set of springs 3030 includes first spring 3031 and second spring 3032. Although depicted as two separate springs, set of springs 3030 could be formed of a single spring, or additionally may be formed of more than two springs. Referring specifically to first spring 3031, first spring 3031 may be wrapped around a portion of the interior of plug assembly 3050. That is, first spring 3031 may pass between cover 3051 and interior plug head 3056 of plug assembly 3050. Therefore, first spring 3031 may be prevented from dislodging or moving by cover 3051.

In some embodiments, the geometry of the springs may assist in securing the springs to interior plug head 3056. Further, the geometry of the springs may assist in securing plug assembly 3050 to body 3002, As shown, first spring 3031 includes first longitudinal portion 3033 that extends within a groove of interior plug head 3056. A second longitudinal portion (not visible) of first spring 3031 may be located on the opposite side of interior plug head 3056 from first longitudinal portion 3033. First spring 3031 may be bent or shaped such that first longitudinal portion 3033 and the second longitudinal portion grip or squeeze interior plug head 3056 to prevent first spring 3031 from becoming dislodged or moved during use. First lateral portion 3034 and second lateral portion 3035 extend from first longitudinal portion 3033 toward a side surface of interior plug head 3056. In some embodiments first lateral portion 3034 and second lateral portion 3035 may be substantially parallel to each other. In other embodiments, first lateral portion 3034 and second lateral portion 3035 may angle away from or toward one another. First spring 3031 may also include a third lateral portion and a fourth lateral portion that are located on the opposite side of interior plug head 3056. Additionally, first spring 3031 includes first side portion 3036 and second side portion 3037. First side portion 3036 may be substantially parallel to second side portion 3037. Additionally, first side portion 3036 and second side portion 3037 may be biased or positioned inwards toward receiving aperture 3038. That is, first lateral portion 3034 and second lateral portion 3035 may be positioned to bias the side portions of first spring 3031 toward receiving aperture 3038. As shown, first side portion 3036 may be substantially perpendicular to first lateral portion 3034. Additionally, second side portion 3037 may also be substantially perpendicular to second lateral portion 3035. Further, first side portion 3036 and second side portion 3037 may extend in a vertical direction with respect to plug assembly 3050 when either first plug 3008 or second plug 3010 is electrically connected to body 3002. First side portion 3036 and second side portion 3037 may also connect to a third lateral portion and a fourth lateral portion of first spring 3031 that are located along a lower surface of interior plug head 3056.

Figure 32:
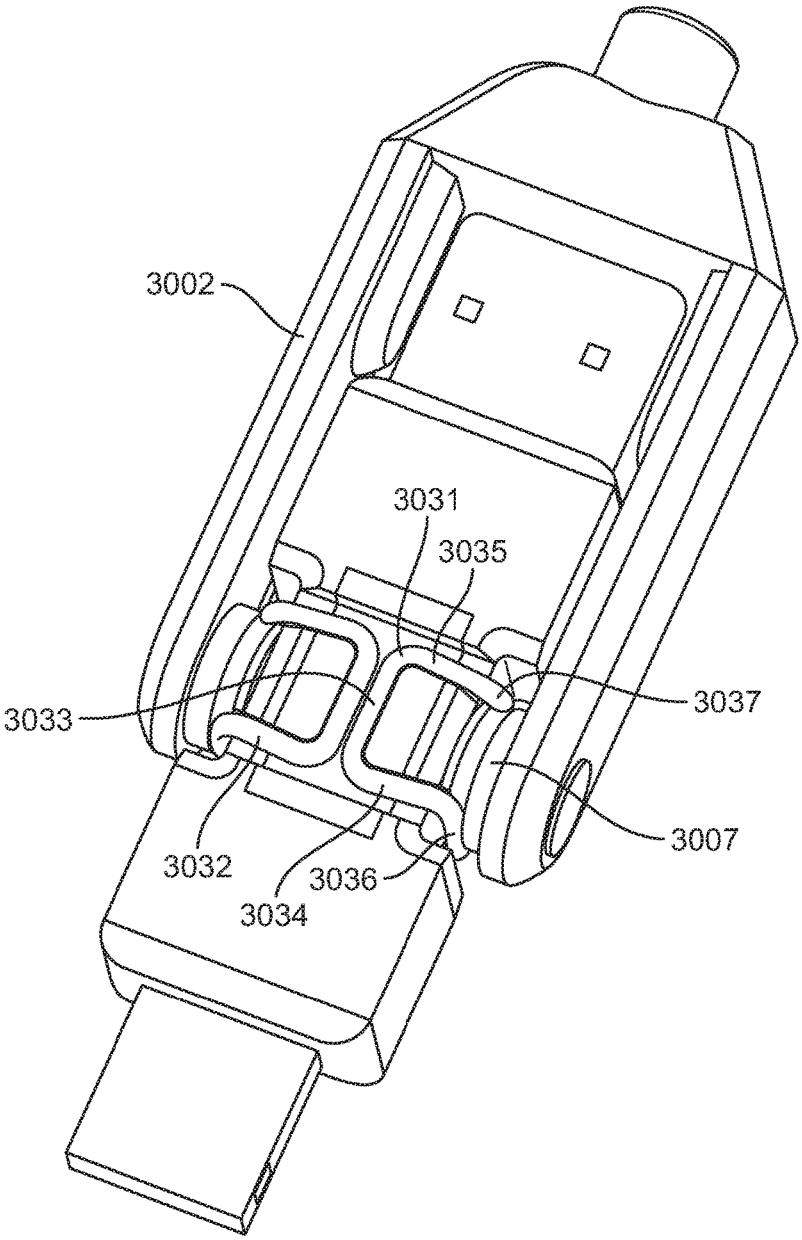
FIG. 32 is a schematic view of an embodiment of a connector without a covering.

Referring now to FIG. 32, plug assembly 3050 is shown in conjunction with body 3002. Cover 3051 has been removed from this view for ease of viewing and description. As shown, first side portion 3036 and second side portion 3037 of first spring 3031 are located along the flat or planar central side surfaces of second detent 3007. First side portion 3036 and second side portion 3037 may be biased toward the central side surfaces of second detent 3007 with sufficient force to prevent first spring 3031 from falling out of the groove within second detent 3007. That is, first side portion 3036 and second side portion 3037 may grip or press against the central side surfaces of second detent 3007.

Figure 33:
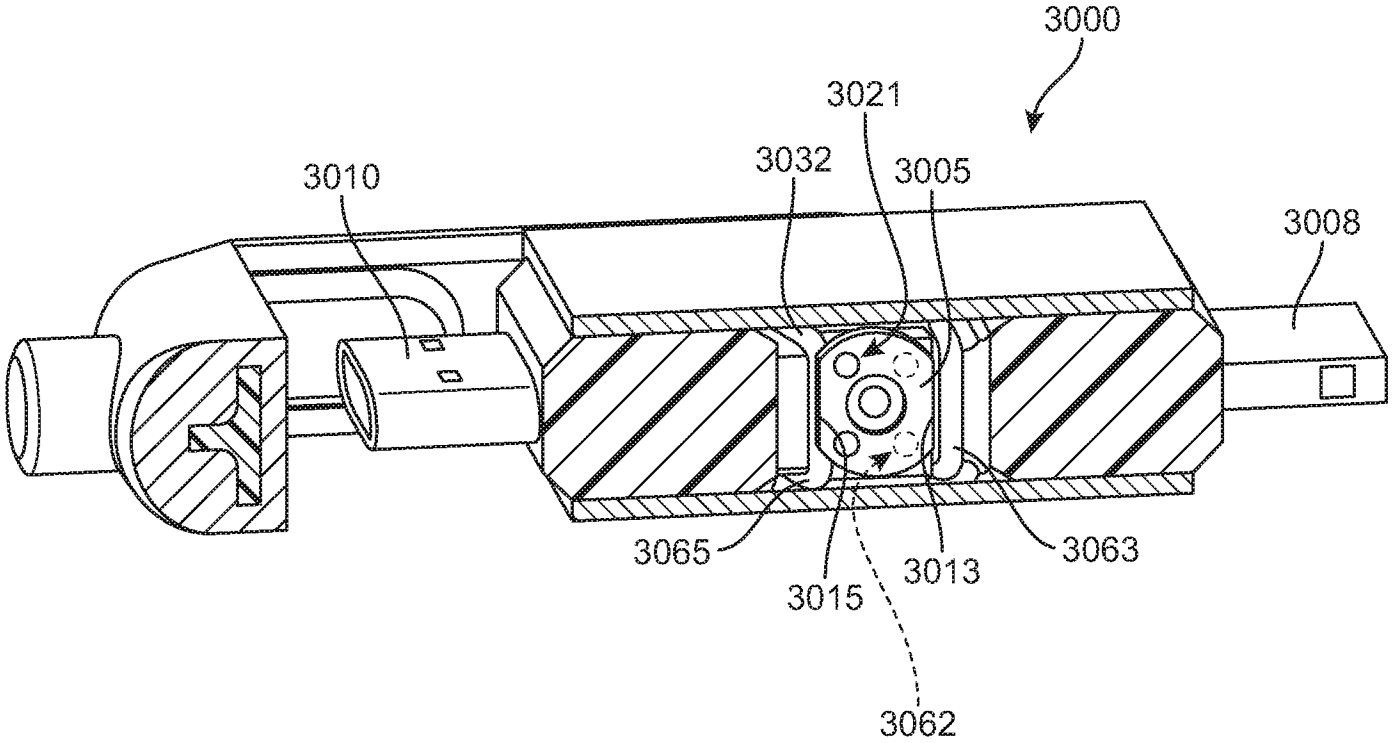
FIG. 33 is a cutaway view of an embodiment of a connector.

Referring now to FIG. 33, a section cut of connector 3000 is depicted. This section cut extends through first detent 3005 as well as through portions of second spring 3032, First detent 3005 and second spring 3032 are not shown with cross-hatching for ease of description and viewing. In this position set of contacts 3021 may contact third set of pogo pins 3060 (not shown) such that first plug 3008 is electrically connected to body 3002. That is, third set of pogo pins 3060 may align with set of contacts 3021. Set of contacts 3021 may compress third set of pogo pins 3060 such that an electrical connection passes from set of contacts 3021 through third set of pogo pins 3060 and to first plug 3008, Additionally, in the position as shown fourth set of pogo pins 3062 may not contact set of contacts 3021. Therefore, second plug 3010 may not be electrically connected to body 3002 in the position as shown.

First side portion 3063 of second spring 3032 interacts with first central side surface 3013 of first detent 3005 and second side portion 3065 interacts with second central side surface 3015. In this manner first side portion 3063 and second side portion 3065 may grab or pinch first detent 3005. This grabbing or pinching may assist in securing plug assembly 3050 to body 3002. Further, the flat or planar surfaces of first central side surface 3013 and second central side surface 3015 may assist in clicking or partially securing plug assembly 3050 into position such that the pogo pins align with set of contacts 3021.

Figure 34:
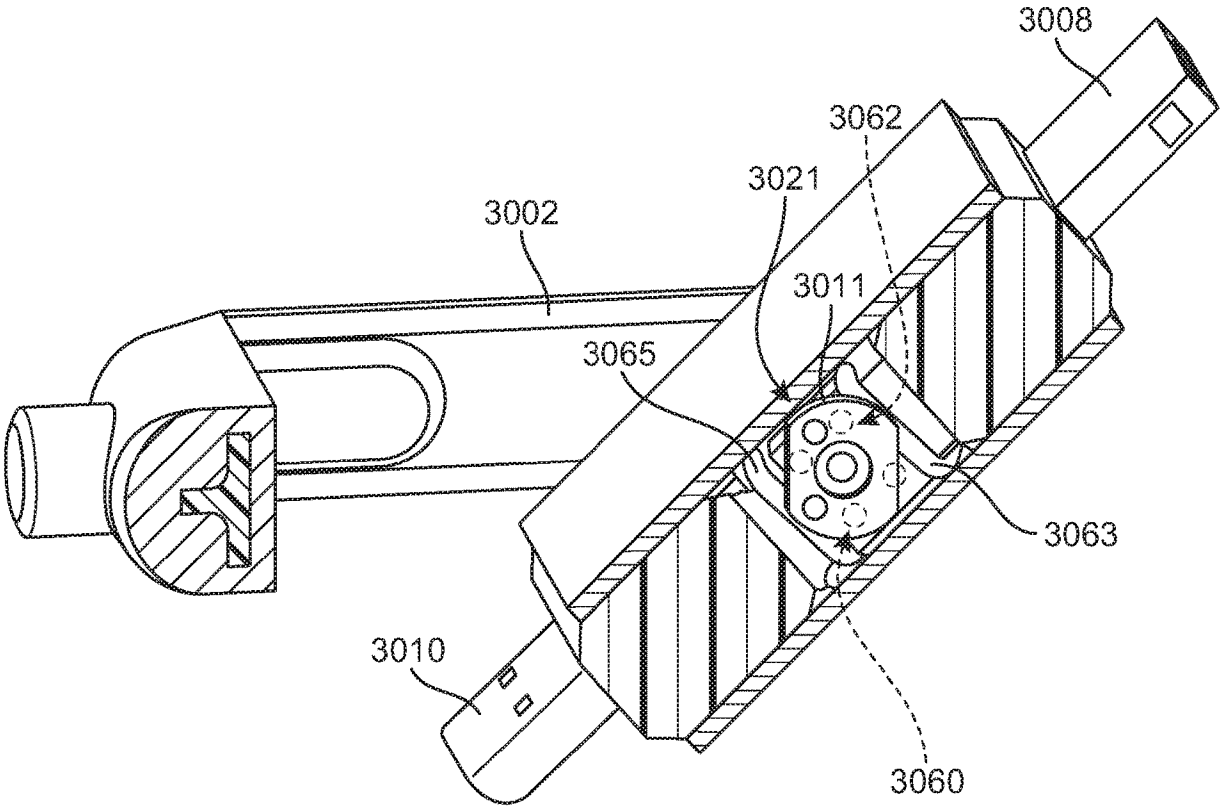
FIG. 34 is a cutaway view of an embodiment of a connector in a rotated orientation.

Referring now to FIG. 34, plug assembly 3050 is partially rotated. In this position, neither first plug 3008 nor second plug 3010 are electrically connected to body 3002 or the rest of connector 3000. That is because the pogo pins do not align with set of contacts 3021 of body 3002. As shown, neither third set of pogo pins 3060 nor fourth set of pogo pins 3062 align with set of contacts 3021. In this position first side portion 3063 of second spring 3032 has rotated such that first side portion 3063 is contacting upper side surface 3011 of first detent 3005. Second side portion 3065 is contacting the opposite lower side surface of first detent 3005. Because upper side surface 3011 is curved as discussed previously, plug assembly 3050 may be biased or urged to rotate back to the previous position as depicted in FIG. 33. Therefore, as a user rotates plug assembly 3050 the user may feel feedback from the spring and detent mechanism. This feedback may be useful to the user in order to signify to the user that the device is not in a ready state for use.

Figure 35:
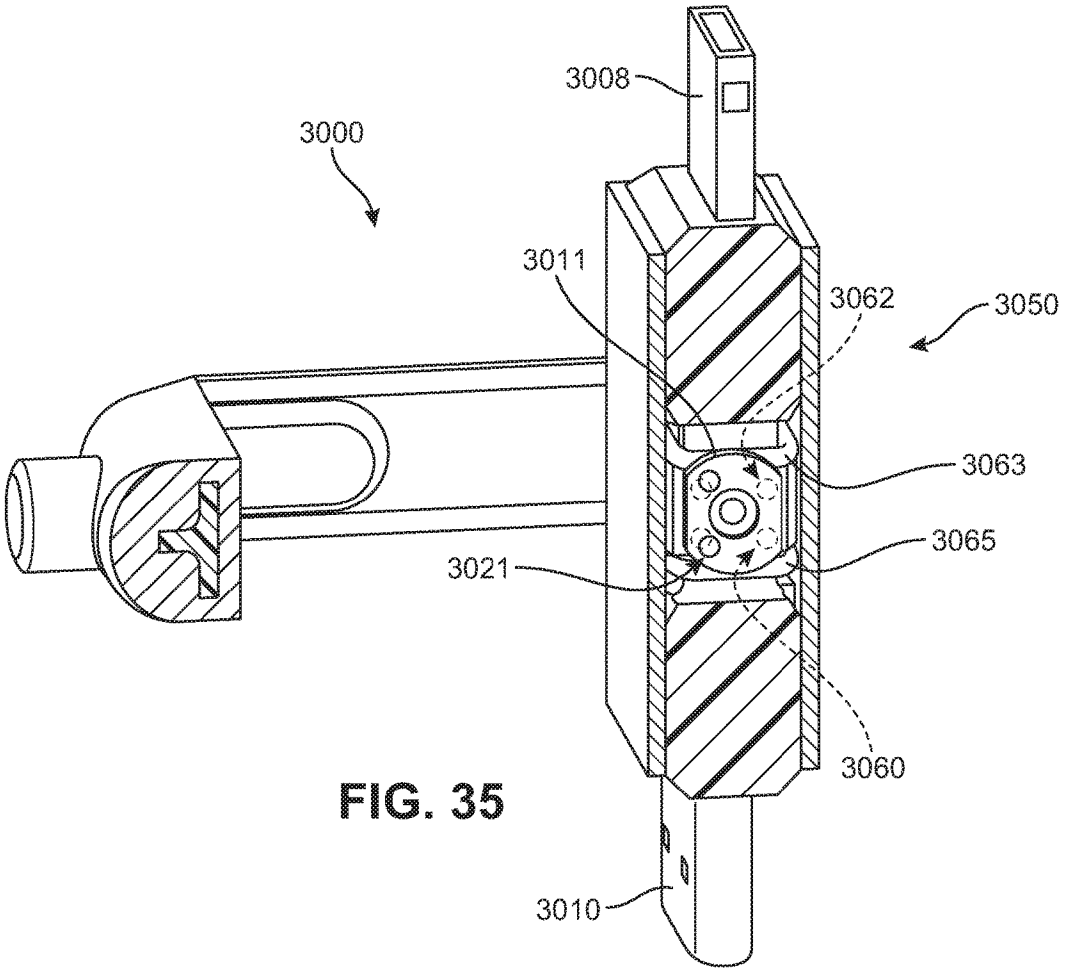
FIG. 35 is another cutaway view of an embodiment of a connector in a rotated orientation.

Referring now to FIG. 35, first side portion 3063 is located along the curved surface of upper side surface 3011. In this position plug assembly 3050 may be easily rotated. Because upper side surface 3011 and opposite lower side surface are curved, a small amount of force is sufficient to force plug assembly 3050 to continue rotating. This design may minimize the amount of time that plug assembly 3050 is rotated and may also minimize accidental rotation of plug assembly 3050. Additionally, in this position neither first plug 3008 nor second plug 3010 are electrically connected to body 3002. As shown, a single pogo pin of third set of pogo pins 3060 may partially contact set of contacts 3021. Additionally, a single pin of fourth set of pogo pins 3062 may partially contact set of contacts 3021, Because only a single pogo pin of either set is contacting set of contacts 3021, a full electrical connection may not be made. For example, in some embodiments, only a first pogo pin of a set may correspond to a negative charge and a second pogo pin may correspond to a positive charge. Therefore, with only one of the pogo pins contacting set of contacts 3021, neither third set of pogo pins 3060 nor fourth set of pogo pins 3062 may complete a circuit.

Figure 36:
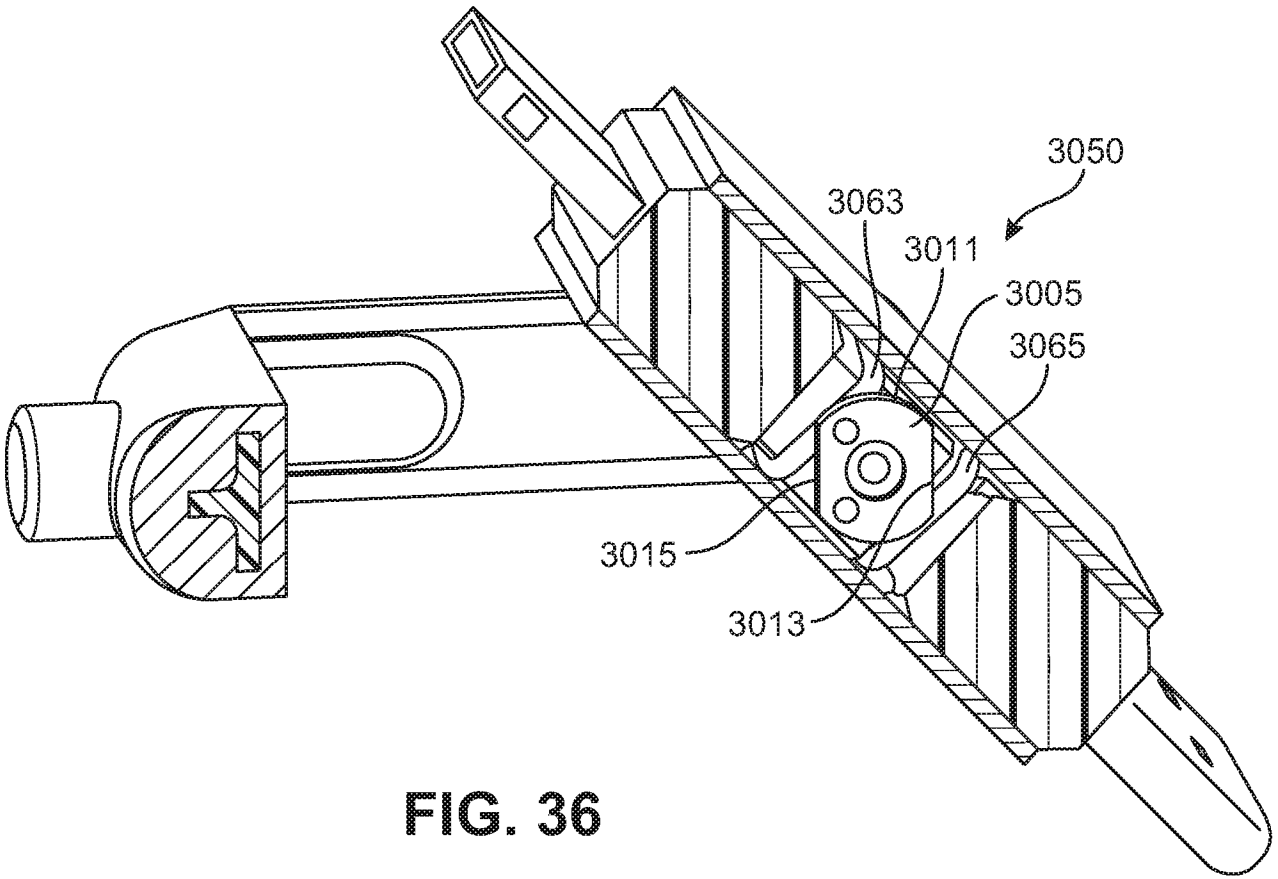
FIG. 36 is a cutaway view of an embodiment of a connector in a rotated orientation.
Figure 37:
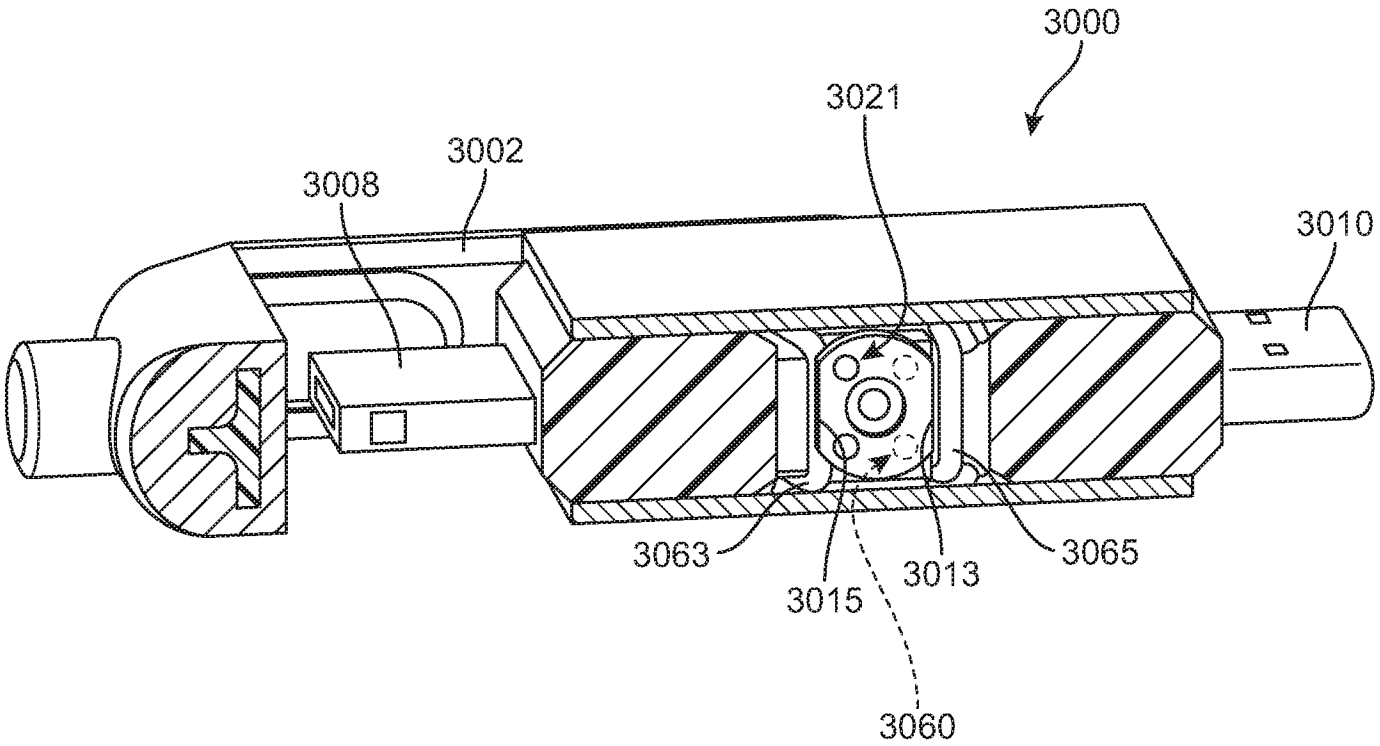
FIG. 37 is a cutaway view of an embodiment of a connector in a rotated orientation.

Referring now to FIGS. 36 and 37, plug assembly 3050 is shown rotating into a secured position. As shown in FIG. 36, first side portion 3063 of second spring 3032 is located along a downward slope of upper side surface 3011. The downward slope of upper side surface 3011 may assist in urging plug assembly 3050 to rotate into the position as shown in FIG. 37. Further, as plug assembly 3050 moves from the position as shown in FIG. 36 to the position as shown in FIG. 37, plug assembly 3050 may snap or click into place. The flat or planar sides of first central side surface 3013 and second central side surface 3015 may allow for first side portion 3063 and second side portion 3065 to rest securely within the groove of first detent 3005.

As shown in FIG. 37, set of contacts 3021 align with fourth set of pogo pins 3062 that electrically connect second plug 3010 with body 3002. Further, third set of pogo pins 3060 do not align with set of contacts 3021 and therefore first plug 3008 is not electrically connector to body 3002. Therefore, in the position of FIG. 37, second plug 3010 is electrically connected to body 3002 and the rest of connector 3000.

Figure 38:
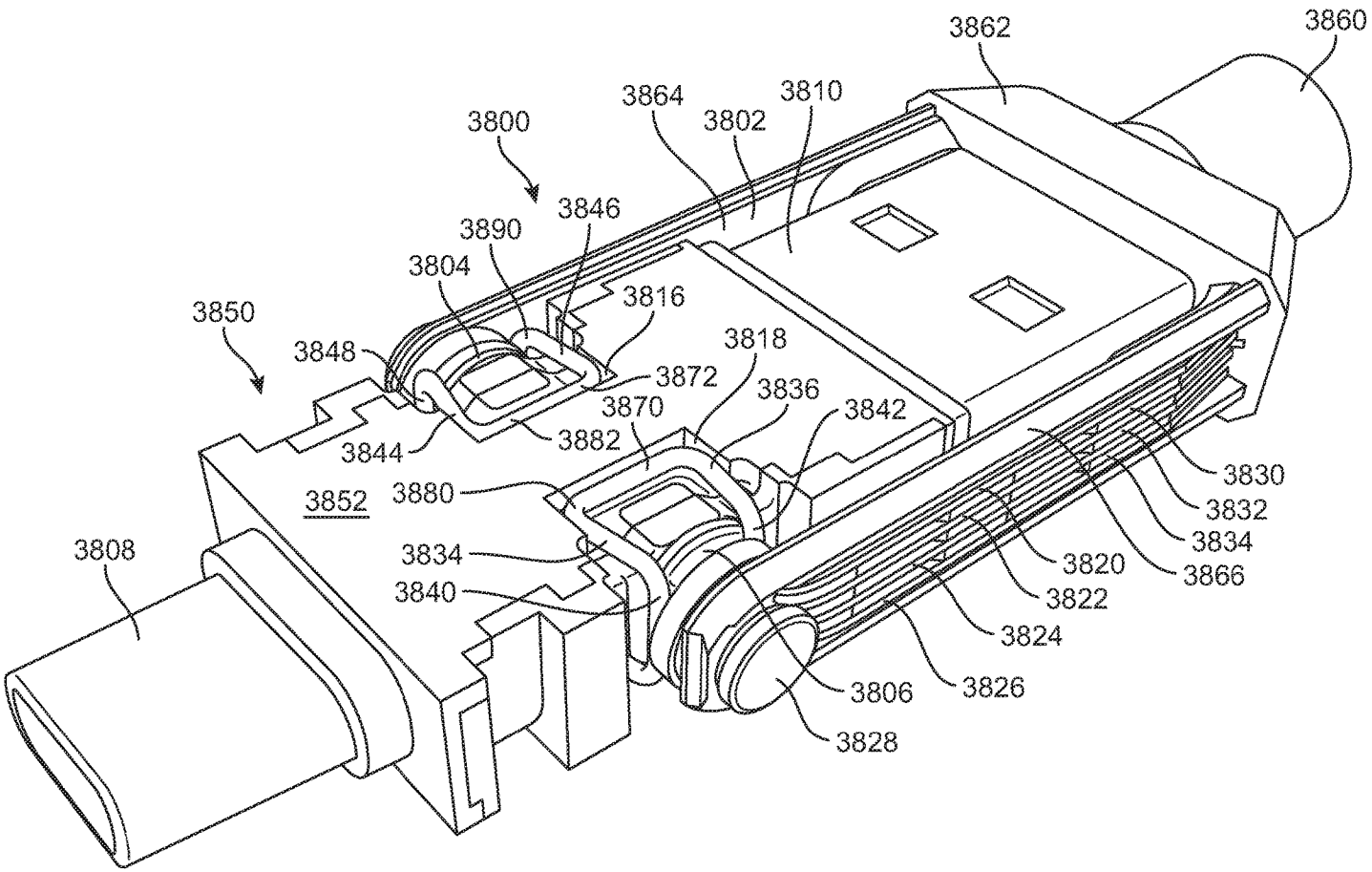
FIG. 38 is schematic view of an embodiment of a connector in a first position.
Figure 39:
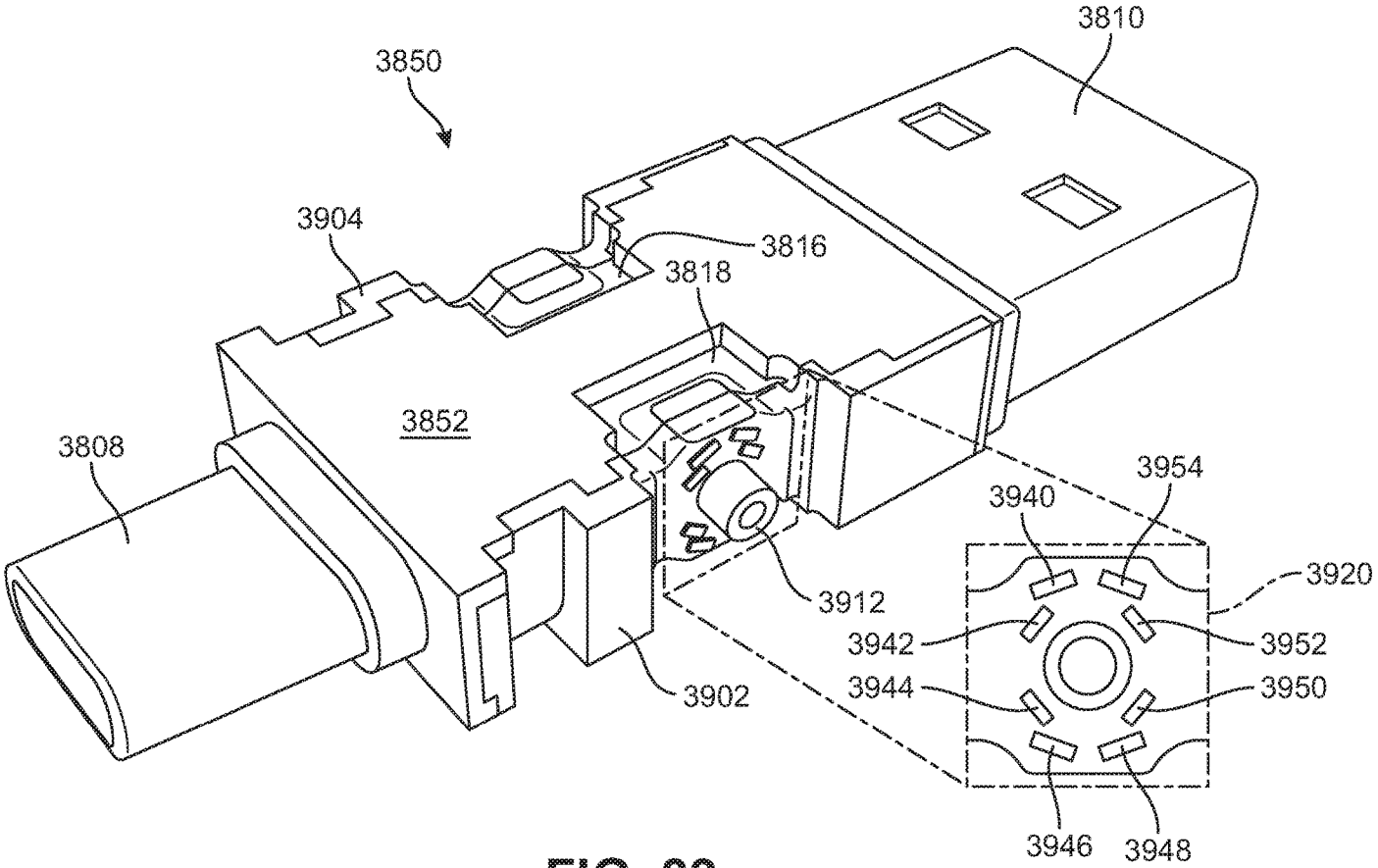
FIG. 39 is an isolated view of the plug head of FIG. 38.
Figure 40:
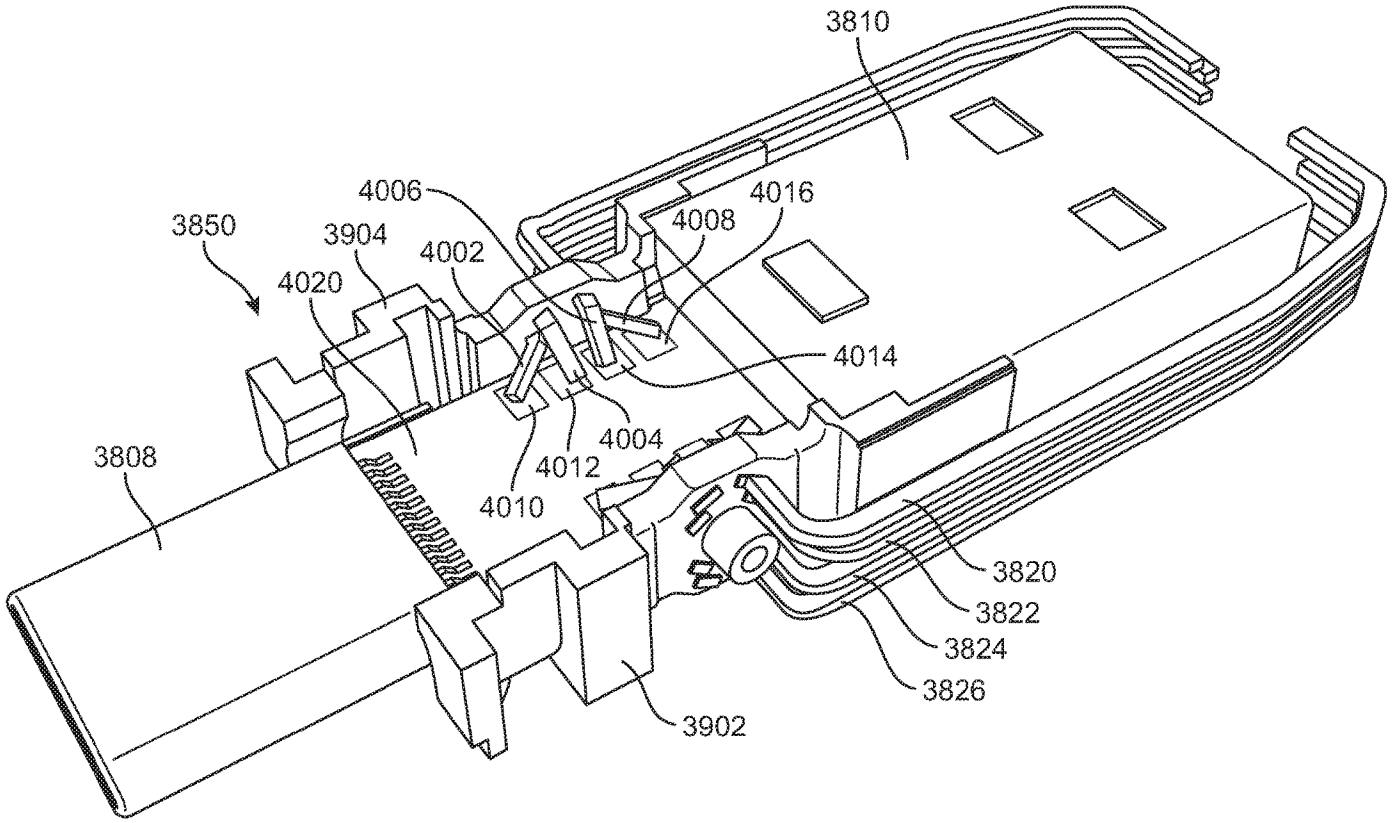
FIG. 40 is the connector of FIG. 38 with housing components removed.
Figure 41:
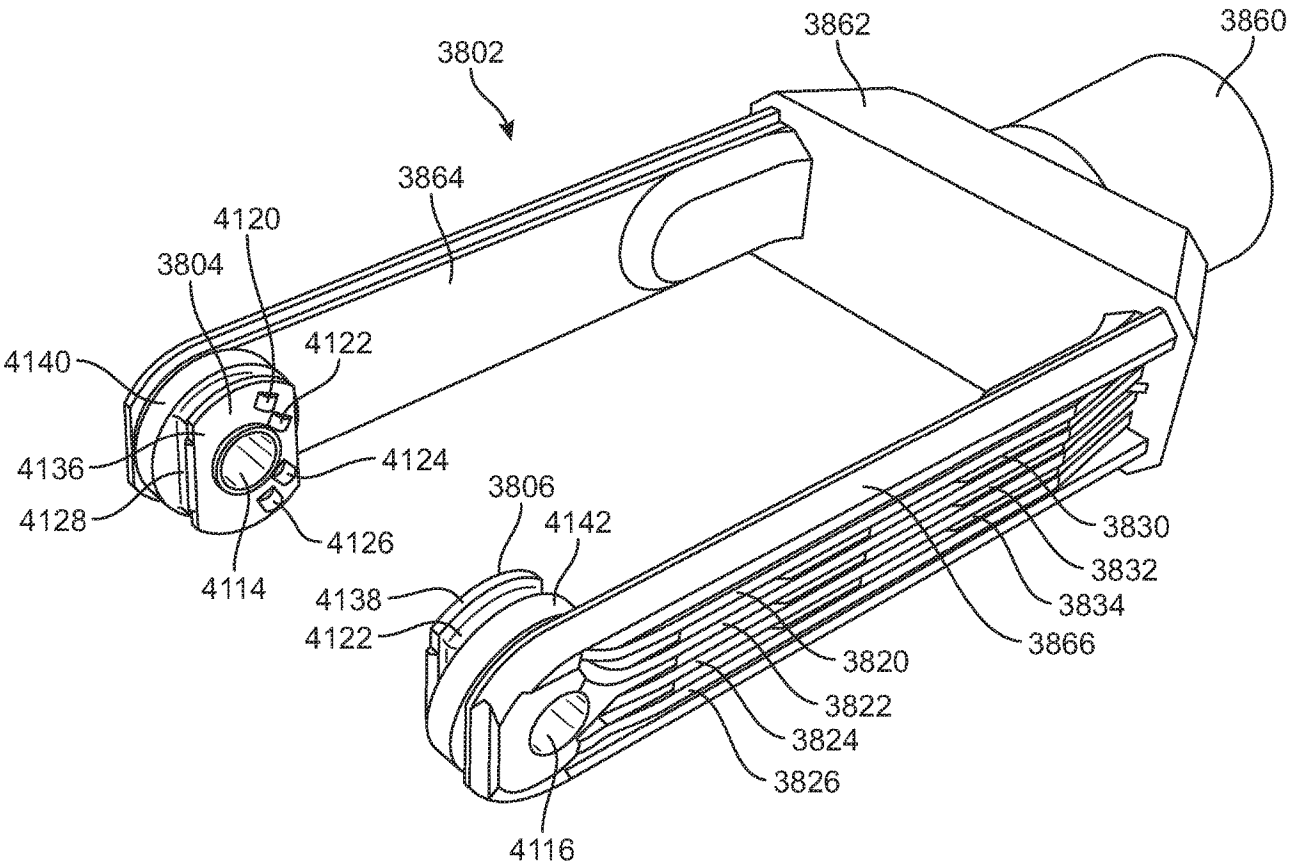
FIG. 41 is an isolated view of the body of FIG. 38.
Figure 42:
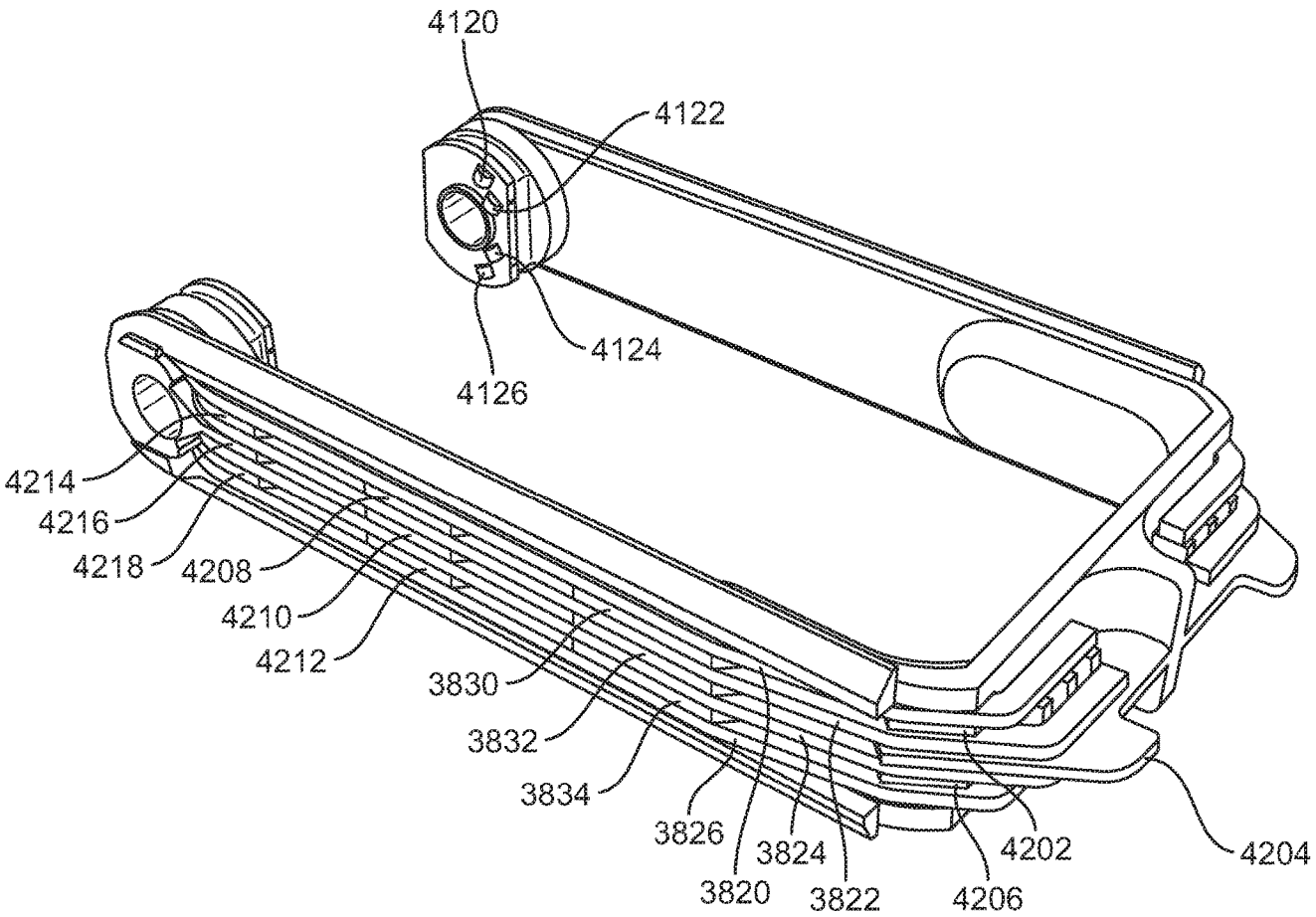
FIG. 42 is an isolated view of the body of FIG. 38 from a different perspective.

FIGS. 38-45 illustrate an embodiment of a connector. Referring specifically to FIG. 38, a connector 3800 includes a plug head 3850 and a body 3802. Plug head 3850, shown in isolation in FIG. 39, includes a first plug 3808 on a first end and a second plug 3810 on a second end opposite the first end. The plugs may be various types as discussed previously with regard to previous embodiments. Body 3802, shown in isolation in FIG. 41, is u-shaped with a first prong 3864 and a second prong 3866 extending from a base 3862. Body 3802 includes a housing cover (not shown) that protects the components of the body, such as the wires carried by the body. The housing cover may be similar to those shown in other embodiments, such as the embodiment shown in FIG. 12.

Each of first prong 3864 and second prong 3866 have a terminal end that connects to plug head 3850 such that first plug 3808 and second plug 3810 rotate about a point of attachment to body 3802 to allow for each plug to be used in connection with an electronic device. For example, FIG. 38 shows first plug 3808 in an active position in which first plug 3808 is electrically connected to the rest of the cable. In a similar manner to previous embodiments, in the stored position a plug may not be electrically connected to the rest of the cable. For example, second plug 3810 as shown in FIG. 38 is in a stored position and therefore is not electrically connected to body 3802 or the rest of the cable (not shown) to which connector 3800 is attached. It is understood that the first prong 3864 has all of the same components as second prong 3866. The components of first prong 3864 are a mirror image of the components of second prong 3866.

Figure 48:
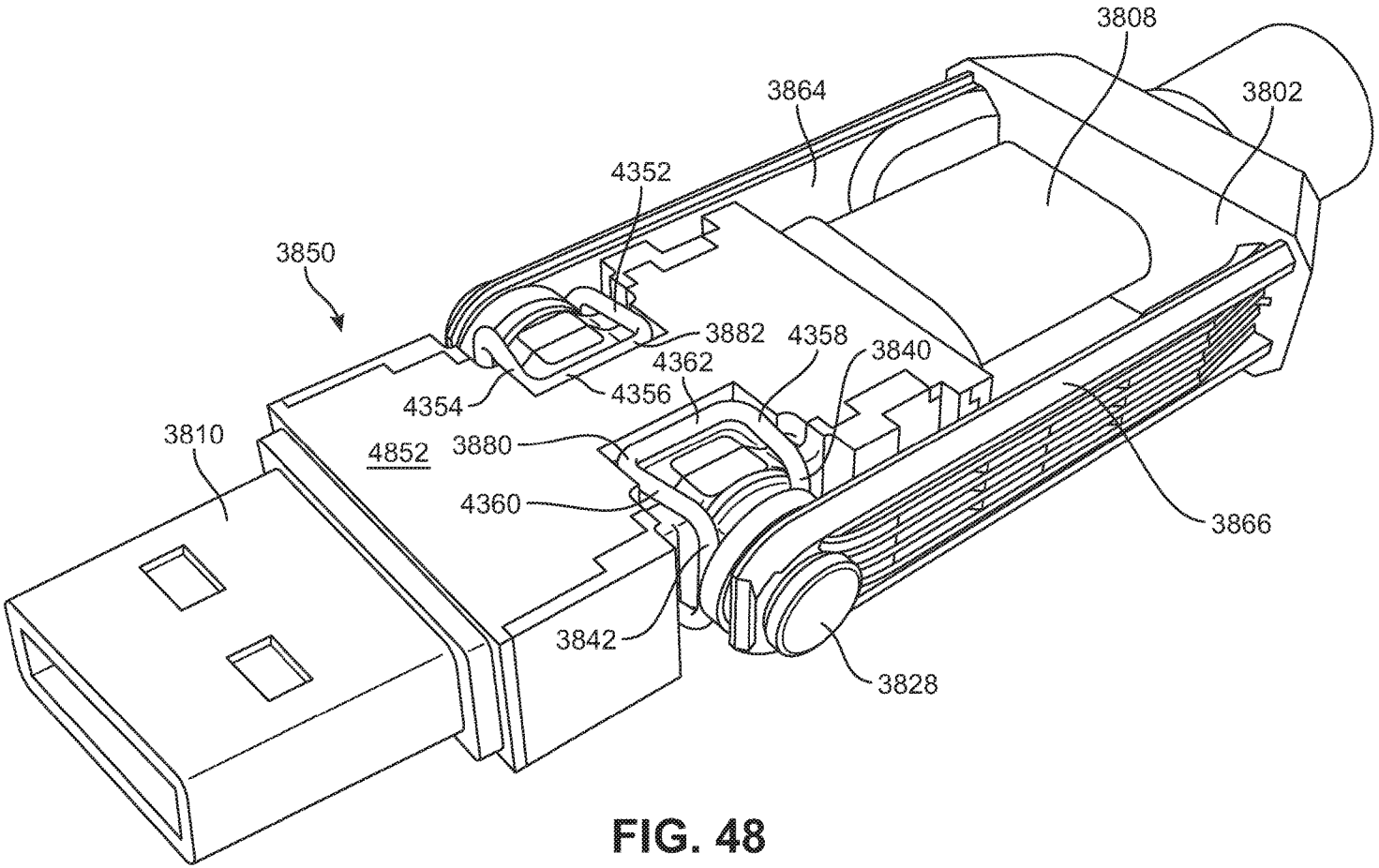
FIG. 48 is a schematic view of the connector of FIG. 38 in a second position.

Referring now to FIG. 39, connector 3800 is shown in a partially exploded view. As shown, plug head 3850 is separated from body 3802. Plug head 3850 includes a first housing component 3852 and a second housing component 4852 (see FIG. 48) that fit together to create a housing for other parts of plug head 3850. A portion of first housing component 3852 that extends between first plug 3808 and second plug 3810 has a substantially hourglass shape such that first housing component 3852 is wider at the first end and the second end than the middle portion therebetween. The narrower middle portion of first housing component 3852 is defined between a first housing groove 3872 and a second housing groove 3818. Second housing component 4852 is similar in shape to the portion of first housing component 3852 that extends between first plug 3808 and second plug 3810. For example, the second housing component also has an hourglass shape.

Plug head 3850 may include cover (not shown) that may cover or protect components within plug head 3850. The cover may be the same or similar to cover 3051 shown in FIGS. 29-31. For example, the cover may have the same general shape as cover 3051 and may be dimensioned to fit over plug head 3850.

Body 3802 includes wires that connect a cord (not shown) at a collar (not shown) to the first plug and the second plug, depending upon the position of the plug head. For example, in the position of FIG. 38, the wires connect the cord to first plug 3808. And in the position of FIG. 38, the wires connect the cord to second plug 3810. The wires of body 3802 extend from a point inside base 3862 to a point on first prong 3864 and second prong 3866. For example, as shown in FIG. 38, a first wire 3820, a second wire 3822, a third wire 3824, and a fourth wire 3826 extend from a point inside base 3862 to a point on second prong 3866. FIG. 40 illustrates these wires without body 3802 and how these wires are routed from base 3862 to a position that enables the wires to electrically connect to electrical contacts (e.g., eighth electrical contact 3954, explained in detail below) on plug head 3850. It is understood that first prong 3864 includes four wires identical to the wires on second prong 3866. The wires on the first prong are insulated from the wires on the second prong. The embodiment shown in FIGS. 38-48 includes four wires on the first prong and four wires on the second prong, which total to eight wires on body 3802. This means that the embodiment shown in FIGS. 38-48 is capable of connecting a plug with up to eight wires. In some embodiments, less than eight of the wires may be connected. In other embodiments, the number of wires may vary. For example, the number of wires may include four wires, six wires, or ten wires, etc.

The first and second prongs of the body have insulative separators provided between the wires to prevent the wires from contacting one another and causing a short circuit. For example, second prong 3866 includes a first separator 3830, a second separator 3832, and a third separator 3834. First separator 3830 is disposed between first wire 3820 and second wire 3822. Second separator 3832 is disposed between second wire 3822 and third wire 3824. Third separator 3834 is disposed between third wire 3824 and fourth wire 3826. The insulative separators may be made out of an insulative material, such as plastic. It is understood that the wires on the first prong may include insulative separators that are identical to the separators on the second prong.

FIG. 40 shows plug head 3850 with first housing component 3852 removed. This view better illustrates how a first sidewall 3902 is disposed opposite a second sidewall 3904. First sidewall 3902 is a mirror image of second sidewall 3904. First housing component 3852 and second housing component 4852 are disposed between and connect to first sidewall 3902 and second sidewall 3904 to create a housing to create a housing for other parts of plug head 3850.

In some embodiments, the first sidewall may include a pin that aligns with components of the body. For example, as shown in FIG. 39, first sidewall 3902 includes a pin 3912 that aligns with components of body 3802. Pin 3912 aligns with and fits within a second receiving aperture 4116 of body 3802. As shown in FIG. 38, a cap 3828 may be installed in second receiving aperture 4116 to protect inner components. As with previous embodiments, pin 3912 may assist in securing first prong 3866 to body 3802 such that plug head 3950 does not fall away from or out of body 3802. Additionally, pin 3912 enables plug head 3850 to rotate with respect to body 3802. It is understood that, as a mirror image of first sidewall 3902, second sidewall 3904 has a pin identical to pin 3912. This pin of second sidewall 3904 aligns with and fits within a first receiving aperture 4114 of body 3802 to secure second prong 3864 to second sidewall 3904 such that plug head 3850 can rotate with respect to body 3802.

The first sidewall may include a first set of electrical contacts. For example, FIG. 39 shows first sidewall 3902 including a first set of eight electrical contacts. It is understood that the first sidewall may include a different number of electrical contacts. The number of electrical contacts may depend on a variety of factors, such as how many wires connect to the plugs and/or other components. FIG. 39 illustrates a zoomed-in front view 3920 of first sidewall 3902 that shows the first set of electrical contacts. The first set of electrical contacts includes a first electrical contact 3940, a second electrical contact 3942, a third electrical contact 3944, a fourth electrical contact 3946, a fifth electrical contact 3948, a sixth electrical contact 3950, a seventh electrical contact 3952, and an eighth electrical contact 3954. It is understood that second sidewall 3904 has a second set of electrical contacts (not shown and facing away from the view shown in FIGS. 39 and 40) that are a mirror image of the first set of electrical contacts of first sidewall 3902.

As previously mentioned, FIG. 38 shows first plug 3808 in an active position in which first plug 3808 is electrically connected to the rest of the cable. FIG. 40 shows first wire 3820, second wire 3822, third wire 3824, and fourth wire 3826 in electrical connection with eighth electrical contact 3954, seventh electrical contact 3952, sixth electrical contact 3950, and fifth electrical contact 3948, respectively. When body 3802 is rotated such that first plug 3808 is in the stored position and second plug 3810 is in the active position, the wires of body 3802 are shifted such that the wires of body 3802 electrically connect to the electrical contacts that put second plug 3810 in contact with cord attached to the cord at collar 3860. More specifically, when second plug 3810 is in the active position, first wire 3820, second wire 3822, third wire 3824, and fourth wire 3826 are in electrical connection with fourth electrical contact 3946, third electrical contact 3944, second electrical contact 3942, and first electrical contact 3940, respectively. It is understood that the wires on first prong 3864 connect to electrical contacts on second sidewall 3904 in the same manner as the wires on second prong 3866 connect to electrical contacts on first sidewall 3902.

As shown in FIG. 40, plug head 3850 includes a printed circuit board assembly 4020 beneath first housing component 3852. Printed circuit board assembly 4020 has a first surface (facing upwardly in FIG. 40) and a second opposite surface (not shown and facing downwardly in FIG. 40). The first surface of printed circuit board assembly 4020 includes electrical contacts that are adjacent to second sidewall 3904. These electrical contacts include first electrical contact 4010, second electrical contact 4012, third electrical contact 4014, and fourth electrical contact 4016. The second surface of printed circuit board assembly 4020 also includes electrical contacts (not shown) that are opposite first electrical contact 4010, second electrical contact 4012, third electrical contact 4014, and fourth electrical contact 4016. The first and second surfaces of printed circuit board assembly 4020 include electrical contacts adjacent to first sidewall 3902 that are a mirror image of the electrical contacts on the first surface and second surface of printed circuit board assembly 4020 that are adjacent to second sidewall 3904. The electrical contacts adjacent to first sidewall 3902 on the first surface of printed circuit board assembly 4020 are partially shown in FIG. 40. The electrical contacts adjacent to first sidewall 3902 on the second surface of printed circuit board assembly 4020 are opposite the electrical contacts adjacent to first sidewall 3902 on the first surface of printed circuit board assembly 4020.

The first and second sidewalls may each include a set of wires. For example, as shown in FIG. 40, second sidewall 3904 includes a first set of wires including a first wire 4002, a second wire 4004, a third wire 4006, and a fourth wire 4006. A first terminal end of the first set of wires electrically connect (e.g., by solder or other attachment) to the electrical contacts disposed on the first surface of printed circuit board assembly 4020 adjacent to second sidewall 3904. In particular, first wire 4002 electrically connects to first electrical contact 4010; second wire 4004 electrically connects to second electrical contact 4012; third wire 4006 electrically connects to third electrical contact 4014; and fourth wire 4008 electrically connects to fourth electrical contact 4016.

Second sidewall 3904 includes a second set of wires (not shown) disposed on second sidewall 3904 on a portion of second sidewall 3904 that is hidden from view by printed circuit board assembly 4020. This is because the second set of wires are disposed on a portion of second sidewall 3904 that is below printed circuit board assembly 4020 in the view of FIG. 40. The second set of wires each have a first terminal end that electrically connects to the electrical contacts on the second surface of printed circuit board 4020 that are adjacent to second sidewall 3904. The second set of wires connects to these electrical contacts in the same manner that first wire 4002, second wire 4004, third wire 4006, and fourth wire 4008 electrically connect to first electrical contact 4120, second electrical contact 4122, third electrical contact 4124, and fourth electrical contact 4126, respectively.

Each of the first set of wires and second set of wires extends through second sidewall 3904 such that a second terminal end of the wires forms the second set of electrical contacts (not shown). As previously mentioned, the second set of electrical contacts of second sidewall 3904 are the mirror image of the first set of electrical contacts of first sidewall 3902.

First sidewall 3902 includes wires (not entirely shown and facing away from the view shown in FIG. 40) that are the mirror image of the first and second set of wires of second sidewall 3904. These wires of first sidewall 3902 each have a first terminal end that is connected to electrical contacts disposed on the first surface and second surface of printed circuit board 4020 adjacent to first sidewall 3902 in the same manner as first wire 4002, second wire 4004, third wire 4006, and fourth wire 4008 are electrically connected to first electrical contact 4010, second electrical contact 4012, third electrical contact 4014, and fourth electrical contact 4016, respectively. The wires of first sidewall 3902 also each extend through first sidewall 3902 such that a second terminal end of the wires forms the first set of electrical contacts.

In some embodiments, the body may be equipped with a plurality of detents. The plurality of detents may be located on one or both of the prongs of the body. For example, as shown in FIGS. 38 and 41-43, first prong 3864 includes a first detent 3804 and second prong 3866 includes a second detent 3806, In some embodiments, the plurality of detents may extend inwards from the prongs of body 3802. Additionally, in some embodiments, the detents of the plurality of detents may have the same or similar geometry. Further, in some embodiments, the plurality of detents may each include through holes that allow pins from securement axles to pass through the detents. For example, first detent 3804 includes first receiving aperture 4114, which forms a portion of a through hole. Similarly, second detent 3806 includes second receiving aperture 4116, which also forms a portion of a through hole. It is understood that first receiving aperture 4114 and receiving aperture 4116 may not be through holes in other embodiments. For example, these receiving apertures may each have a closed end in some embodiments.

First detent 3804 has a first plate 4136. Second detent 3806 has a second plate 4138. First plate 4136 and second plate 4130 are each generally flat. In some embodiments, the detents may be particularly shaped to interact with a spring or other mechanism to assist in rotating and securing the plug head. For example, as shown in FIG. 41, first detent 3804 and second detent 3806 may have a generally rectangular shape with two parallel straight edges and two parallel rounded edges. First prong 3864 includes a first circular portion 4140 that fits into an opening of a cover. For example, first circular portion 4140 fits within an opening similar to opening 3049 in cover 3051 to allow rotation of plug head 3850. First detent 3804 includes a first detent groove 4128 disposed between first plate 4136 and first circular portion 4140. First detent groove 4128 has the same generally rectangular shape of first plate 4136. Second prong 3866 includes a second circular portion 4142. For example, second circular portion 4142 fits within an opening similar to opening 3049 in cover 3051 to allow rotation of plug head 3850. Second detent 3806 includes a second detent groove 4122 disposed between second plate 4138 and second circular portion 4142. Second detent groove 4122 has the same generally rectangular shape of second plate 4148.

In some embodiments, the plug head may include mechanisms for connecting the plugs of plug head to the body and by extension the rest of the cable to which the connector is attached. For example, as shown, plug head 3850 may include set of springs. The set of springs includes first spring 3880 and second spring 3882. Although depicted as two separate springs, the set of springs could be formed of a single spring, or additionally may be formed of more than two springs. First spring 3880 may be wrapped around a portion of the interior of plug head 3850. That is, first spring 3880 may pass between a cover and plug head 3850. Therefore, first spring 3880 may be prevented from dislodging or moving by cover.

The geometry of the springs assists in securing plug head 3850 to body 3802, As shown, first spring 3880 includes first longitudinal portion 3870 that fits and extends within first housing groove 3818 of first housing component 3852. A second longitudinal portion 4362 of first spring 3880 is located opposite first longitudinal portion 3870. Second longitudinal portion 4362 fits and extends within a second housing groove that is opposite first housing groove 3818 on second housing component 4852. First spring 3880 is bent or shaped such that first longitudinal portion 3870. The first longitudinal portion and the second longitudinal portion grip or squeeze interior plug head assembly 3850 to prevent first spring 3880 from becoming dislodged or moved during use. First spring 3880 includes a first lateral portion 3834 and a second lateral portion 3836. When assembled on plug head assembly 3850, first lateral portion 3834 and second lateral portion 3836 extend from first longitudinal portion 3870 toward first sidewall 3902.

Figure 43:
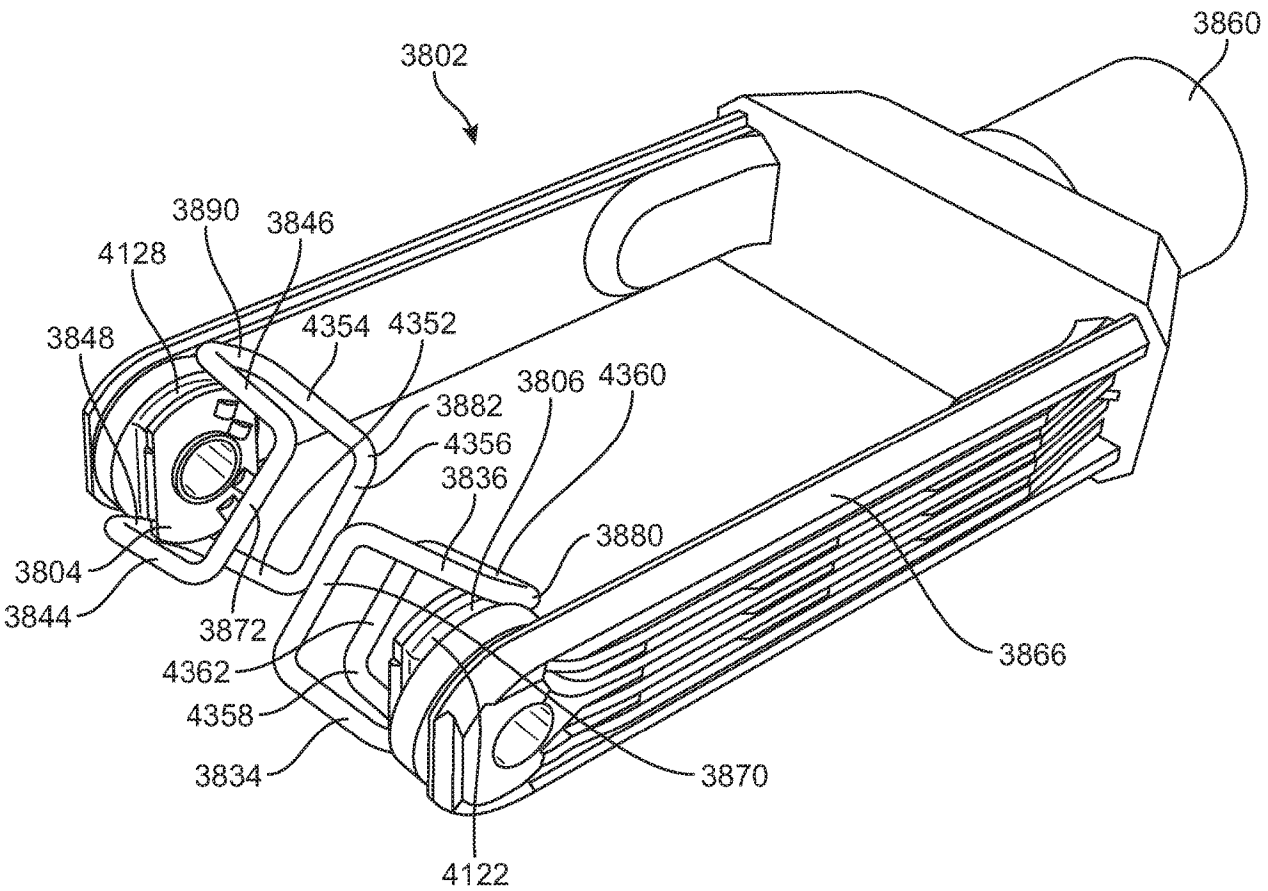
FIG. 43 is an isolated view of the body of FIG. 38 with the springs engaging the detent grooves.
Figure 44:
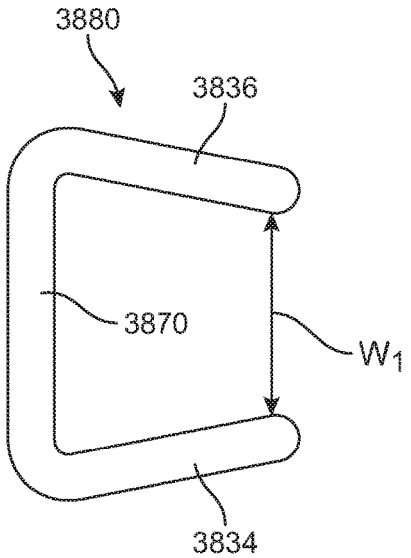
FIG. 44 is a top view of first spring when the first guiding portion and second guiding portion are against the straight portions of second detent groove.

Referring to FIGS. 43-47, first spring 3880 includes a third lateral portion 4358 that is opposite first lateral portion 3834 and a fourth lateral portion 4360 that is opposite second lateral portion 3836. First spring 3880 includes a first guiding portion 3840 and a second guiding portion 3842. First lateral portion 3834 and second lateral portion 3836 connect first longitudinal portion 3870 to first guiding portion 3840 and second guiding portion 3842. Third lateral portion 4358 and fourth lateral portion 4360 connect second longitudinal portion 4362 to first guiding portion 3840 and second guiding portion 3842. In some embodiments, first guiding portion 3840 and second guiding portion 3842 may be substantially parallel to each other. In other embodiments, for example, as shown in FIG. 44, first guiding portion 3840 and second guiding portion 3842 may angle toward one another. Additionally, first guiding portion 3840 and second guiding portion 3842 may be biased toward each other. As shown, first guiding portion 3840 may be substantially perpendicular to first lateral portion 3834 and third lateral portion 4358. Additionally, second guiding portion 3842 may also be substantially perpendicular to second lateral portion 3836 and fourth lateral portion 4360. First guiding portion 3840 and second guiding portion 4342 fit and extend within second detent groove 4122.

Second spring 3882 is identical to first spring 3880. Second spring 3882 includes components that are identical to those of first spring 3880, Second spring 3882 has a first longitudinal portion 3872, a second longitudinal portion 4356, a first lateral portion 3844, a second lateral portion 3846, a third lateral portion 4352, a fourth lateral portion 4354, a first guiding portion 3848, and a second guiding portion 3890. First longitudinal portion 3872 fits and extends within second housing groove 3816 of first housing component 3852. Second longitudinal portion 4356 fits and extends within a housing groove that is opposite second housing groove 3816 on second housing component 4852. Similar to first spring 3880, the first and second longitudinal portions of second spring 3882 grip or squeeze interior plug head assembly 3850 to prevent second spring 3882 from becoming dislodged or moved during use. First guiding portion 3848 and second guiding portion 3890 fit and extend within first detent groove 4128.

Figure 45:
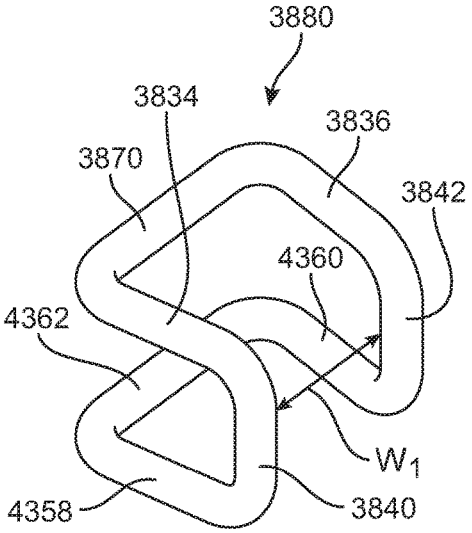
FIG. 45 is a different view of first spring when the first guiding portion and second guiding portion are against the straight portions of second detent groove'
Figure 46:
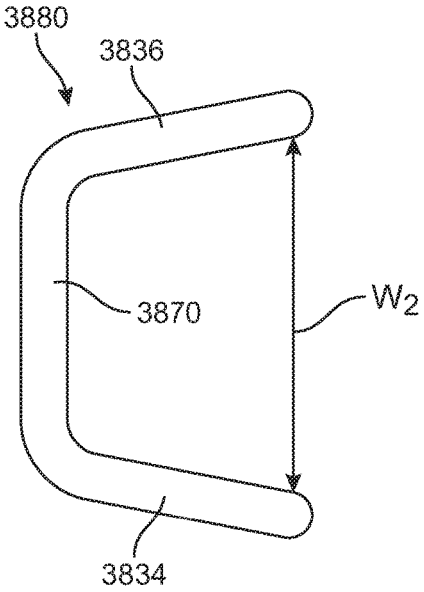
FIG. 46 is a top view of first spring when the first guiding portion and second guiding portion are against the rounded portions of second detent groove.
Figure 47:
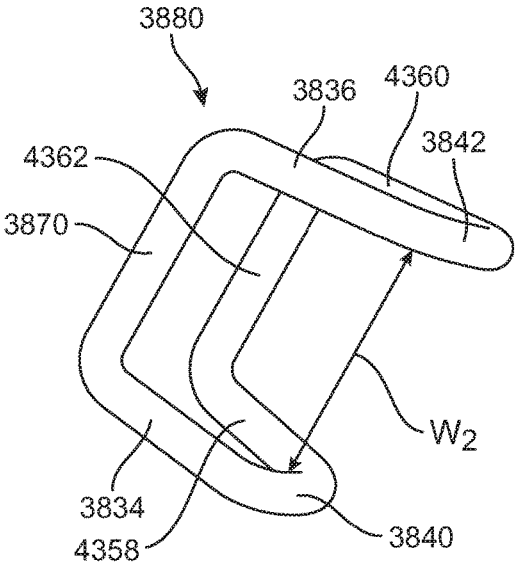
FIG. 47 is a different view of first spring when the first guiding portion and second guiding portion are against the straight portions of second detent groove.

First spring 3880 and second spring 3882 rotate about second detent groove 4122 and first detent groove 4128, respectively, when plug head assembly rotates about body 3802. In FIG. 43, plug head assembly 3850 has been removed to show how first spring 3880 and second spring 3882 rotate about second detent groove 4122 and first detent groove 4128, respectively. FIGS. 44-47, further show first spring 3880 isolated from all other components to clearly show how the spring stretches as it moves about second detent groove 4122, which happens as plug head assembly 3850 rotates about body 3802. FIG. 44 shows a top view of first spring 3880 when first guiding portion 3840 and second guiding portion 3842 are against the straight portions of second detent groove 4122, FIG. 45 shows a different view of first spring 3880 when first guiding portion 3840 and second guiding portion 3842 are against the straight portions of second detent groove 4122. FIG. 46 shows a top view of first spring 3880 when first guiding portion 3840 and second guiding portion 3842 are against the rounded portions of second detent groove 4122. FIG. 47 shows a different view of first spring 3880 when first guiding portion 3840 and second guiding portion 3842 are against the rounded portions of second detent groove 4122. $W_1$ is the distance between first guiding portion 3840 and second guiding portion 3842 when the two guiding portions are against the straight portions of second detent groove 4122. $W_2$ is the distance between first guiding portion 3840 and second guiding portion 3842 when the two guiding portions are against the rounded portions of second detent groove 4122. When first guiding portion 3840 and second guiding portion 3842 follow along the rounded portions of second detent groove 4122, these two guiding portions are spread apart from one another. Accordingly, $W_2$ is larger than $W_1$. It is understood that second spring 3882 spreads apart in the same way as first spring 3880.

The rounded portions of the detent grooves cause plug head 3850 to be biased or urged to rotate back to a position in which the first and second springs rest along the straight portions of the detent grooves. Therefore, as a user rotates plug head 3850 the user will feel feedback from the spring and detent mechanism. Plug head 3850 will snap into the position of FIG. 38 or the position of FIG. 48, depending on which position plug head 3850 is closest to when the first and second springs are moving along the rounded portions of the detent grooves. This feedback may be useful to the user in order to signify to the user that the device is in a ready state for use.

Figure 49:
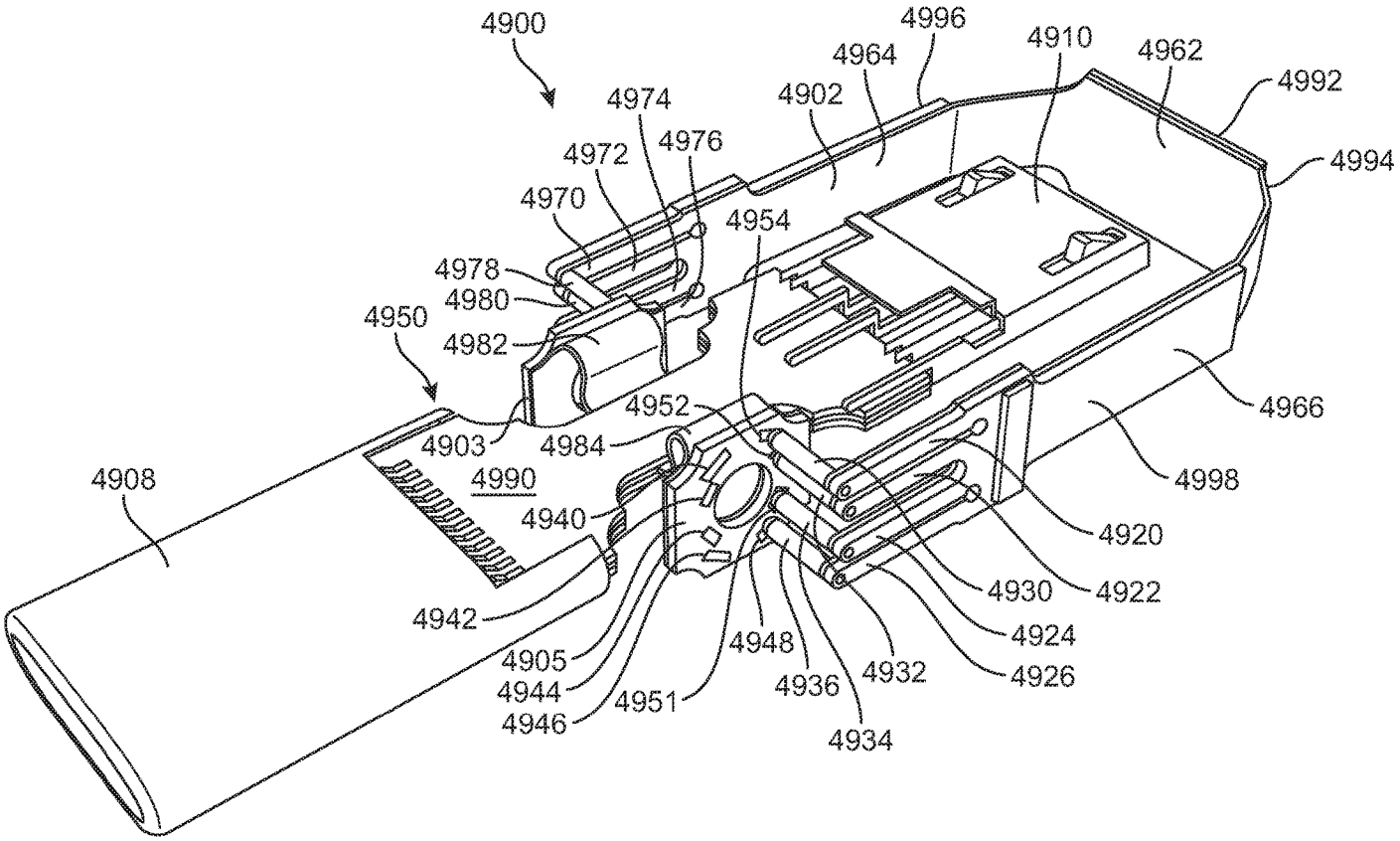
FIG. 49 is a schematic view of an embodiment of the connector.
Figure 50:
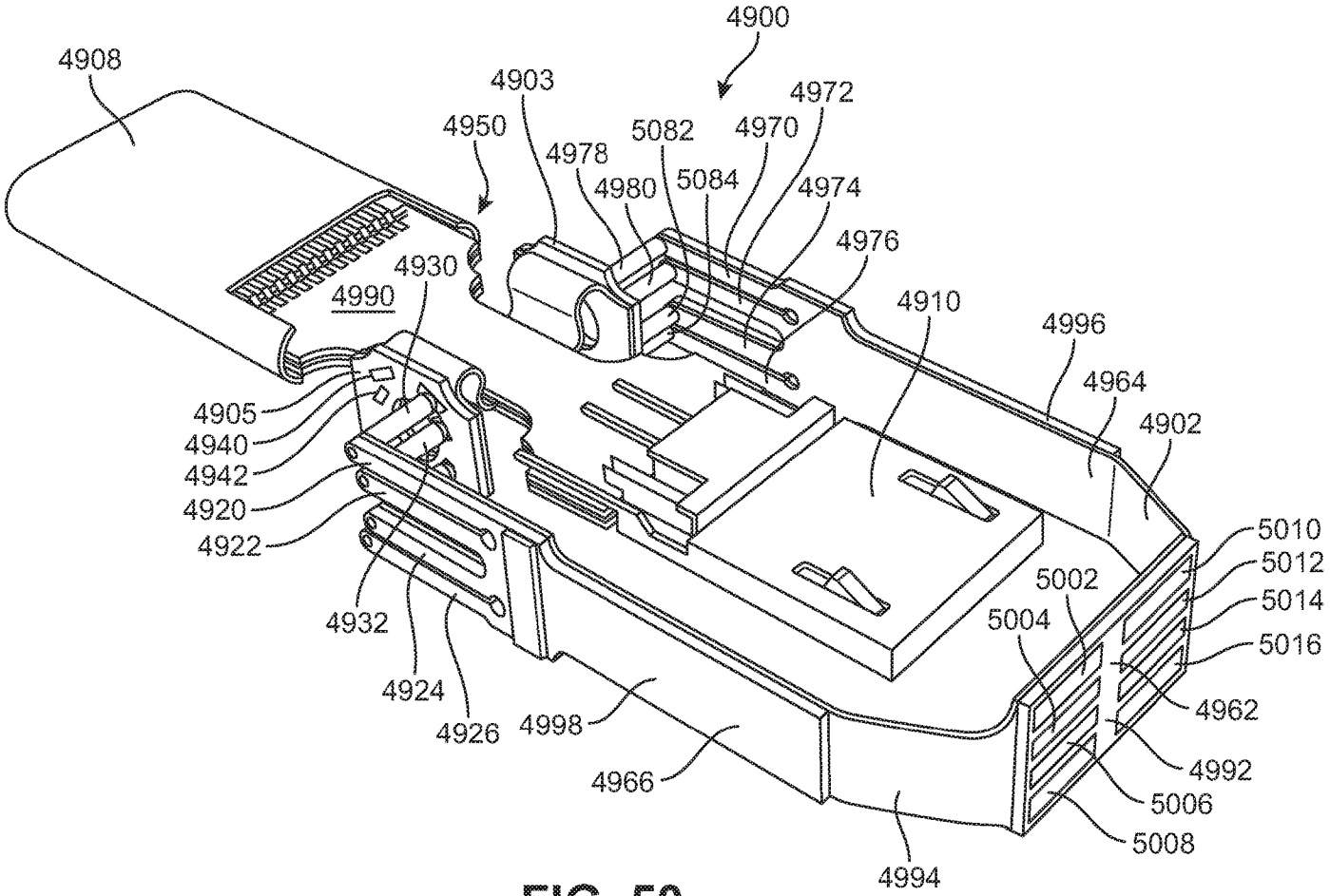
FIG. 50 is a different view of the connector of FIG. 49.
Figure 51:
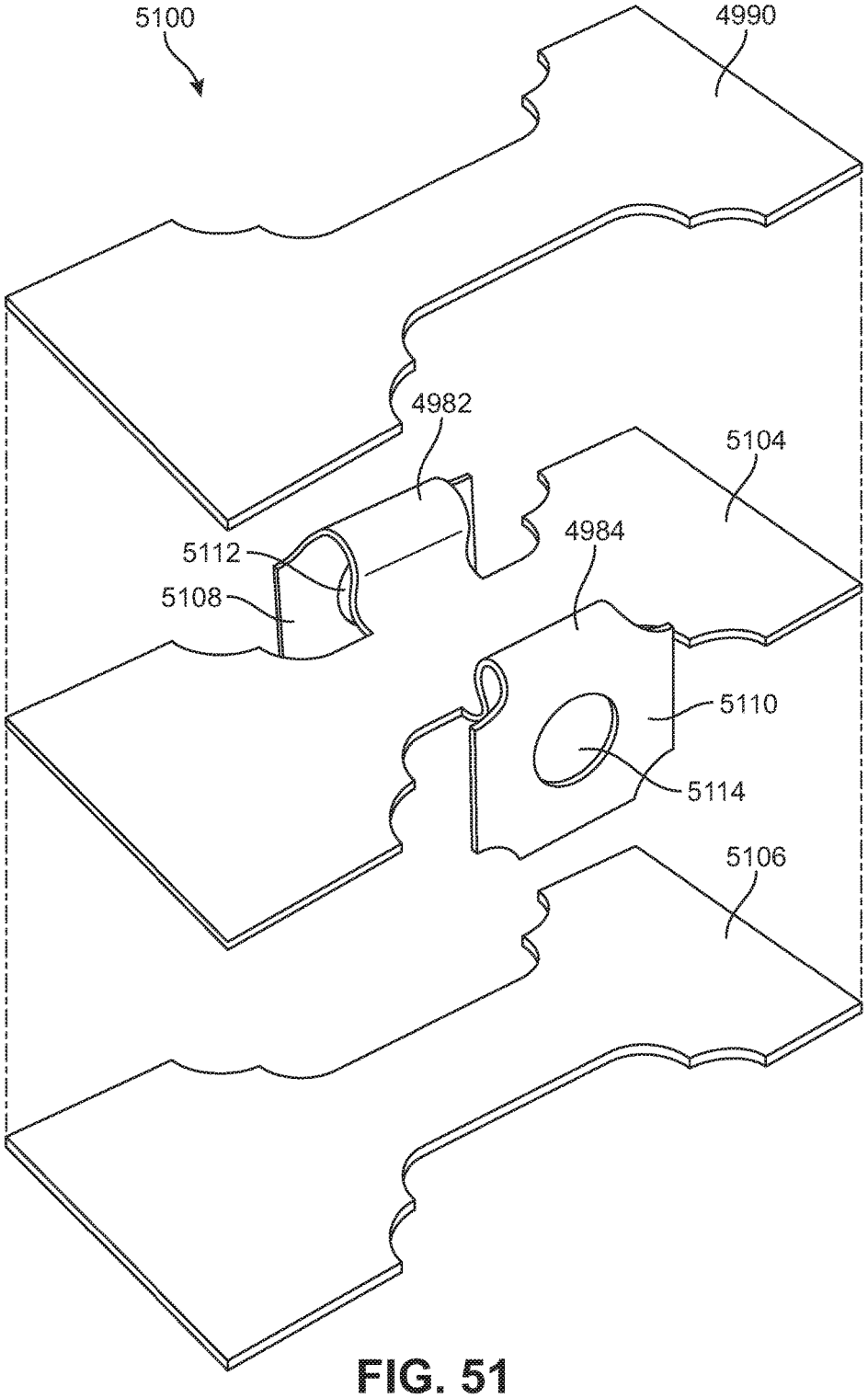
FIG. 51 shows an exploded view of a printed circuit board assembly.

FIGS. 49-51 illustrate an embodiment of a connector, Referring specifically to FIG. 49, a connector 4900 includes a plug head 4950 and a body 4902. FIGS. 49-50 show connector 4900 in a partially exploded view, as the plug head and body are shown without any housing components. It is understood that the plug head and body may include components, such as the housing components, shown in other embodiments. For example, in some embodiments, plug head 4950 may include housing components similar to first housing component 3852 and a second housing component 4852, In another example, body 4902 may include other components, such as those similar to cap 3828, first detent 3804, and second prong 3866. In the same example, the plug head and body may include springs, such as first spring 3880 and second spring 3882. This way, the plug head and body may interact as described above with respect to how the springs move about the grooves of the detents to cause the plug head to flip from a first position to a second position.

Plug head 4950 includes a first plug 4908 on a first end and a second plug 4910 on a second end opposite the first end. The plugs may be various types as discussed previously with regard to previous embodiments. Body 4902 is u-shaped with a first prong 4964 and a second prong 4966 extending from a base 4962. Each of first prong 4964 and second prong 4966 have a terminal end that connects to plug head 4950 such that first plug 4908 and second plug 4910 rotate about a point of attachment to body 4902 to allow for each plug to be used in connection with an electronic device. For example, FIG. 49 shows first plug 4908 in an active position in which first plug 4908 is electrically connected to the rest of the cable. In a similar manner to previous embodiments, in the stored position, a plug may not be electrically connected to the rest of the cable (not shown), For example, as shown in FIG. 49, second plug 4910 is in a stored position and therefore is not electrically connected to body 4902 or the rest of the cable (not shown) to which connector 4900 is attached. It is understood that the first prong 4964 has all of the same components as second prong 4966. The components of first prong 4964 are a mirror image of the components of second prong 4966.

Plug head 4950 may also include cover (not shown) that may cover or protect components within plug head 4950. The cover may be the same or similar to cover 3051 shown in FIGS. 29-31. For example, the cover may have the same general shape as cover 3051 and may be dimensioned to fit over plug head 4950.

In some embodiments, the body may include one or more printed circuit boards. For example, instead of individual wires, body 4902 includes a first printed circuit board 4994. In some embodiments, the printed circuit board may include a flexible material layer (e.g., polyamide) in which circuit traces (not shown) are printed. First printed circuit board 4994 may include circuit traces that connect a cord at a collar (not shown) to the first plug and the second plug, depending upon the position of the plug head. For example, in the position of FIG. 49, which is an active position for first plug 4908, the circuit traces (not shown) connect the cord to first plug 4908. And in an active position for second plug 4910, the circuit traces (not shown) connect the cord to second plug 4910. The circuit traces extend from a point inside base 4962 to a point on first prong 4964 and second prong 4966. For example, the circuit traces may have the same path as the wires shown in FIG. 40 and described above.

The paths of the circuit traces and the printed nature of the circuit traces keep the circuit traces from shorting one another. Additionally, the printed nature of the circuit traces makes assembly of body 4902 very simple, as first printed circuit board 4994 is a single one-piece unit containing multiple individual components. Assembling a single one-piece unit simplifies assembling multiple individual components and eliminates the need for solder points.

In embodiments in which the body includes a flexible printed circuit board, the body may include plates made of a material that is more rigid than the flexible printed circuit board. For example, FIG. 49 shows body 4902 including a first plate 4996, a second plate 4998, and a third plate 4992.

The plates give shape to body 4902. First plate 4996 is disposed along an outer surface of first printed circuit board 4994 at first prong 4964. Second plate 4998 is disposed along an outer surface of first printed circuit board 4994 at second prong 4966. Third plate 4992 is disposed along an outer surface of first printed circuit board 4994 at base 4962. The third plate may include electrical contacts that put the trace circuits of the body into electrical contact with a cord (not shown). For example, third plate 4992 may include a first electrical contact 5002, a second electrical contact 5004, a third electrical contact 5006, a fourth electrical contact 5008, a fifth electrical contact 5010, a sixth electrical contact 5012, a seventh electrical contact 5014, and an eighth electrical contact 5016.

The more rigid material (in comparison to the material of the printed circuit board) of the plates may give body 4902 more structure. The body may have a housing cover that protects the components of the body. For example, body 4902 may have a housing cover (not shown) that protects the first, second, and third plates, as well as the first printed circuit board. The housing cover may be similar to those shown in other embodiments, such as the embodiment shown in FIG. 12. The first and second plates may press against the interior surface of the housing cover such that the rods (discussed below) are biased toward the electrical contacts of the connection plates (discussed below) of the plug head.

The first printed circuit board may split into fingers at the ends of the first prong and the second prong. For example, as shown in FIGS. 49 and 50, first prong 4964 splits into four fingers, including a first finger 4970, a second finger 4972, a third finger 4974, and a fourth finger 4976. Similarly, FIGS. 49 and 50 show how second prong 4966 splits into four fingers, including a fifth finger 4920, a sixth finger 4922, a seventh finger 4924, and an eighth finger 4926. While four fingers are shown, it is understood that a different number of fingers may be selected. The number of fingers may be based on a variety of factors. For example, the number of fingers may be selected based on the number of connections between the body and the plug head and/or the number of connections between the body and a cord, etc. The fingers of the first printed circuit board may be attached to rods that electrically connect the circuit traces to electrical contacts on the plug head. For example, first prong 4964 may include a first rod 4978, a second rod 4980, a third rod 5082, and a fourth rod 5084. In another example, second prong may include a fifth rod 4930, a sixth rod 4932, a seventh rod 4934, and an eighth rod 4936. The trace circuits may extend from base 4962 to the tips/terminal ends of the fingers. The rods may be made of any material sufficient to electrically connect circuit traces in the body to the electrical contacts on the plug head. For example, the rods may be made of copper.

The plug head may include a printed circuit board assembly. For example, FIG. 51 shows an exploded view of a printed circuit board assembly 5100. The printed circuit board assembly may include a printed circuit board sandwiched between two plates. For example, FIG. 51 shows a second printed circuit board 5104 that is disposed between a fourth housing plate 4990 and a fifth housing plate 5106. The printed circuit board assembly may have an hourglass shape such that the printed circuit board assembly is wider at the first end and the second end than the middle portion therebetween. The narrower middle portion of the printed circuit board assembly provides a place for the rods to connect to the plug head in a manner allowing the plug head to flip between two positions (discussed in more detail below).

In some embodiments, the second printed circuit board may include a flexible material layer (e.g., polyamide) in which circuit traces (not shown) are printed. In some embodiments, the second printed circuit board may be made of the same material as the first printed circuit board. In other embodiments, the second printed circuit board may be made of a different material from the first circuit board. The circuit traces of the second printed circuit board may extend from a point of contact between the body and the plug head to each of the first plug and the second plug.

The second printed circuit board may include a flat portion between the fourth housing plate and the fifth housing plate. Additionally, the second printed circuit board may include two arms extending from a middle area of the second printed circuit board. For example, second printed circuit board 5104 includes a first arm having a first connection portion 5108. First connection portion 5108 includes a first receiving aperture 5112 that may receive a pin or other component that helps plug head 4950 rotate about body 4902. The first arm bends at an area indicated by reference number 4982. In this way, first connection portion 5108 is substantially perpendicular to second printed circuit board 5104 such that first connection portion 5108 receives first connection plate 4903 in a position ready to receive detents (not shown) and ends of the rods connected to first prong 4964. Second printed circuit board 5104 also includes a second arm having a second connection portion 5110. Second connection portion 5110 includes a second receiving aperture 5114 that may receive a pin or other component that helps plug head 4950 rotate about body 4902. The second arm bends at an area indicated by reference number 4984. In this way, second connection portion 5110 is substantially perpendicular to second printed circuit board 5104 such that second connection portion 5110 receives a second connection plate 4905 in a position ready to receive detents (not shown) and ends of the rods connected to second prong 4966.

The first and second connection plates may include electrical contacts that electrically connect the rods of the prongs to circuit traces on the second printed circuit board. For example, FIG. 49 shows second connection plate 4905 having a first electrical contact 4940, a second electrical contact 4942, a third electrical contact 4944, a fourth electrical contact 4946, a fifth electrical contact 4948, a sixth electrical contact 4951, a seventh electrical contact 4952, and an eighth electrical contact 4954. It is understood that first connection plate 4903 is a mirror image of second connection plate 4905. First connection plate 4903 includes electrical contacts that are identical to the electrical contacts on second connection plate 4905 and are positioned along the surface of first connection plate 4903 facing away from the view in FIGS. 49 and 50. The electrical contacts on first connection plate 4903 electrically connect with first rod 4978, second rod 4980, third rod 5082, and fourth rod 5084 in the same manner described with respect to the electrical contacts on second connection plate 4905 electrically connecting with fifth rod 4930, sixth rod 4932, seventh rod 4934, and eighth rod 4936.

When assembled, body 4902 attaches to plug head 4950 in a manner similar to how body 3802 attached to plug head 3850. As mentioned, in some embodiments, connector 4900 may include pins, detents, and springs similar to those shown and discussed with respect to FIGS. 38-48. In the active position of first plug 4908, shown in FIGS. 49-50, fifth rod 4930, sixth rod 4932, seventh rod 4934, and eighth rod 4936 align with and electrically connect to eighth electrical contact 4954, seventh electrical contact 4952, sixth electrical contact 4951, and fifth electrical contact 4948, respectively. When flipped to the active position of second plug 4910, fifth rod 4930, sixth rod 4932, seventh rod 4934, and eighth rod 4936 align with and electrically connect to first electrical contact 4940, second electrical contact 4942, third electrical contact 4944, and fourth electrical contact 4946, respectively. The electrical connections between the rods on first prong 4964 and electrical contacts on first connection plate 4903 switch between the active position of the first plug 4908 and the active position of the second plug 4910 in the same manner.

While the embodiment shown in FIGS. 49-51 includes 8 rods, it is understood that the first and second prongs may include a different number of rods. For example, the first and second prongs may each include two rods or four rods or six rods. The number of rods depends on a variety of factors, e.g. how many fingers the first and second prongs each have and/or how many electrical contacts are disposed on third plate 4992.

While various embodiments have been described, the description is intended to be exemplary, rather than limiting, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Various features described with respect to any illustrated embodiment may be interchanged with features described with respect to a different illustrated embodiment. More permutations of the features may be possible within the scope of the invention in which the plug head illustrated in one embodiment may be combined with the body illustrated in a different embodiment. For example, the various electrical connections, connectors, rotational elements, detents, contact elements, etc. of any illustrated embodiment may be combined with components illustrated in a different illustrated embodiment. Accordingly, the embodiments are not to be restricted except in light of the attached claims and their equivalents. Also, various modifications and changes may be made within the scope of the attached claims.

What is claimed is:

1. A cable for connecting various devices, the cable comprising:

a first connector and a second connector, a cord connecting the first connector to the second connector;

the first connector including a body and a plug head;

the body having a first end connected to the cord and an opposite second end;

the body being u-shaped and including a first prong and a second prong;

the first prong including a first set of electrical contacts and the second prong including a second set of electrical contacts;

the plug head including a plug head and a first plug and a second plug;

the first plug being secured to the plug head and the second plug being secured to the plug head, the first plug being located on an opposite side of the plug head from the second plug;

the plug head having a third set of electrical contacts electrically connected to the first plug and a fourth set of electrical contacts electrically connected to the second plug;

the plug head being rotatably secured between the first prong and the second prong of the body;

wherein, in a first position, the first set of electrical contacts and the second set of electrical contacts align with and electrically connect to the third set of electrical contacts; and wherein, in a second position, the first set of electrical contacts and the second set of electrical contacts align with and electrically connect to the fourth set of electrical contacts.

2. The cable according to claim 1, wherein the body includes a printed circuit board having circuit traces connecting the cord to both the first and second set of electrical contacts.

3. The cable according to claim 2, wherein the first set of electrical contacts are disposed on a first set of rods attached to the first prong.

4. The cable according to claim 1, wherein the first prong includes a first set of wires extending from the cord to the first set of electrical contacts.

5. The cable according to claim 4, wherein the second prong includes a second set of wire wires extending from the cord to the second set of electrical contacts.

6. The cable according to claim 1, wherein the first prong includes at least one detent and the plug head includes at least one spring connecting the at least one detent to the plug head, wherein a portion of the at least one spring nests within a groove of the at least one detent.

7. The cable according to claim 1, wherein the plug head includes a printed circuit board having circuit traces connecting the first plug to the third set of electrical contacts and the second plug to the fourth set of electrical contacts.

8. A cable for connecting various devices, the cable comprising:

a first connector and a second connector, a cord connecting the first connector to the second connector;

the first connector including a body and a plug head;

the body having a first end connected to the cord and an opposite second end;

the body being u-shaped and including a first prong and a second prong;

the first prong including a first set of electrical contacts and the second prong including a second set of electrical contacts;

the plug head including a plug head and a first plug and a second plug;

the first plug being secured to the plug head and the second plug being secured to the plug head, the first plug being located on an opposite side of the plug head from the second plug; and wherein the first prong includes at least one detent and the plug head includes at least one spring connecting the at least one detent to the plug head, wherein a portion of the at least one spring nests within a groove of the at least one detent.

9. The cable of claim 8, wherein the body includes a printed circuit board having circuit traces connecting the cord to a first set of electrical contacts disposed on the first prong.

10. The cable of claim 9, wherein the circuit traces connect the cord to a second set of electrical contacts disposed on the second prong.

11. The cable of claim 8, wherein when the first plug head is in a first position and a second plug head is in a second position, the first plug is electrically connected to the cord and the second plug is electrically disconnected from the cord.

12. The cable of claim 8, wherein the at least one detent has a generally rectangular shape with two parallel straight edges and two parallel rounded edges.

13. The cable of claim 12, wherein the rounded edges of the detent groove causes the plug head to be biased or urged to rotate back to a position in which the at least one spring rests along at least one of the two parallel straight edges of the detent groove.

14. A cable for connecting various devices, the cable comprising:

a first connector and a second connector, a cord connecting the first connector to the second connector;

the first connector including a body and a plug head;

the body having a first end connected to the cord and an opposite second end;

the body being u-shaped and including a first prong and a second prong;

the first prong including a first electrical contact, a second electrical contact, a third electrical contact, and a fourth electrical contact;

the plug head including a plug head and a first plug and a second plug;

the first plug being secured to the plug head and the second plug being secured to the plug head, the first plug being located on an opposite side of the plug head from the second plug;

the plug head having a fifth electrical contact, a sixth electrical contact; a seventh electrical contact, and an eighth electrical contact all electrically connected to the first plug and a ninth electrical contact, a tenth electrical contact, an eleventh electrical contact, and a twelfth electrical contact all electrically connected to the second plug;

the plug head being rotatably secured between the first prong and the second prong of the body;

wherein, in a first position, the first electrical contact; the second electrical contact, the third electrical contact, and the fourth electrical contact align with and electrically connect to the fifth electrical contact, the sixth electrical contact, the seventh electrical contact, and the eighth electrical contact, respectively; and wherein, in a second position, the first electrical contact, the second electrical contact, the third electrical contact; and the fourth electrical contact align with and electrically connect to the ninth electrical contact, the tenth electrical contact, the eleventh electrical contact, and the twelfth electrical contact, respectively.

15. The cable according to claim 14, wherein the body includes a printed circuit board having circuit traces connecting the cord to both the first and second set of electrical contacts.

16. The cable according to claim 15, wherein the first electrical contact, the second electrical contact, the third electrical contact, and the fourth electrical contact are all disposed on a first set of rods attached to the first prong.

17. The cable according to claim 14, wherein the first prong includes a first set of wires extending from the cord to the first set of electrical contacts.

18. The cable according to claim 17, wherein the second prong includes a second set of wires extending from the cord to the second set of electrical contacts.

19. The cable according to claim 14, wherein the first prong includes at least one detent and the plug head includes at least one spring connecting the at least one detent to the plug head, wherein a portion of the at least one spring nests within a groove of the at least one detent.

20. The cable according to claim 14, wherein the plug head includes a printed circuit board having circuit traces connecting the first plug to the fifth electrical contact, sixth electrical contact, seventh electrical contact, and eighth electrical contact, and the second plug to the ninth electrical contact, tenth electrical contact, eleventh electrical contact, and twelfth electrical contact.

* * * * *